US010125958B1

(12) United States Patent
Wronski et al.

(10) Patent No.: US 10,125,958 B1
(45) Date of Patent: Nov. 13, 2018

(54) RECESSED LUMINAIRE COMPONENTS FOR VARYING FINISHING SECTION INSTALLATIONS

(71) Applicant: Cooper Technologies Company, Houston, TX (US)

(72) Inventors: Grzegorz Wronski, Peachtree City, GA (US); Jared Michael Davis, Newnan, GA (US); Charles Richard Vasquez, Peachtree City, GA (US); Zhihong Lin, Shanghai (CN)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/433,927

(22) Filed: Feb. 15, 2017

(51) Int. Cl.

| | |
|---|---|
| ***F21V 21/04*** | (2006.01) |
| ***F21S 8/02*** | (2006.01) |
| ***F21V 29/00*** | (2015.01) |
| *F21V 29/503* | (2015.01) |
| *F21V 29/76* | (2015.01) |

(52) U.S. Cl.
CPC ..... *F21V 21/047* (2013.01); *F21S 8/026* (2013.01); *F21V 29/503* (2015.01); *F21V 29/763* (2015.01)

(58) Field of Classification Search
CPC .... F21V 21/047; F21V 29/503; F21V 29/763; F21S 8/02; F21S 8/026
See application file for complete search history.

(56) References Cited

U.S. PATENT DOCUMENTS

| | | | | |
|---|---|---|---|---|
| 4,475,147 | A * | 10/1984 | Kristofek | F21S 8/026 362/147 |
| 6,474,846 | B1 * | 11/2002 | Kelmelis | F21V 17/164 248/231.91 |
| 7,654,705 | B2 * | 2/2010 | Czech | F21S 8/02 362/147 |
| 8,511,867 | B1 | 8/2013 | Tam et al. | |
| 2004/0177572 | A1 * | 9/2004 | Burgess | F21V 21/04 52/220.8 |
| 2005/0183344 | A1 * | 8/2005 | Ziobro | F21V 21/04 52/20 |
| 2011/0141741 | A1 * | 6/2011 | Engstrom | F21V 21/03 362/257 |
| 2013/0050994 | A1 * | 2/2013 | Pieper | F21S 8/026 362/147 |
| 2013/0100676 | A1 * | 4/2013 | Wang | F21V 17/02 362/282 |
| 2013/0322084 | A1 * | 12/2013 | Ebisawa | F21V 21/04 362/269 |
| 2017/0234514 | A1 * | 8/2017 | Hildebrand | F21V 21/047 362/365 |

* cited by examiner

*Primary Examiner* — Alan Cariaso
(74) *Attorney, Agent, or Firm* — King & Spalding LLP

(57) ABSTRACT

Recessed luminaire components include a lathing ring that is installed in a ceiling using fold-over tabs that are coupled to the lathing ring. The recessed luminaire components further include a rimless housing can and a plurality of flange clips that are removably coupled to the rimless housing can. The rimless housing can and flange clip assembly is installed in the ceiling fitted with the lathing ring. The recessed luminaire components also include a snap fit lathing ring that is configured to be coupled a housing instead of being coupled to the ceiling for an alternative installation. The snap fit lathing ring may include one or more snap tabs that are configured to engage corresponding notches in the housing.

20 Claims, 39 Drawing Sheets

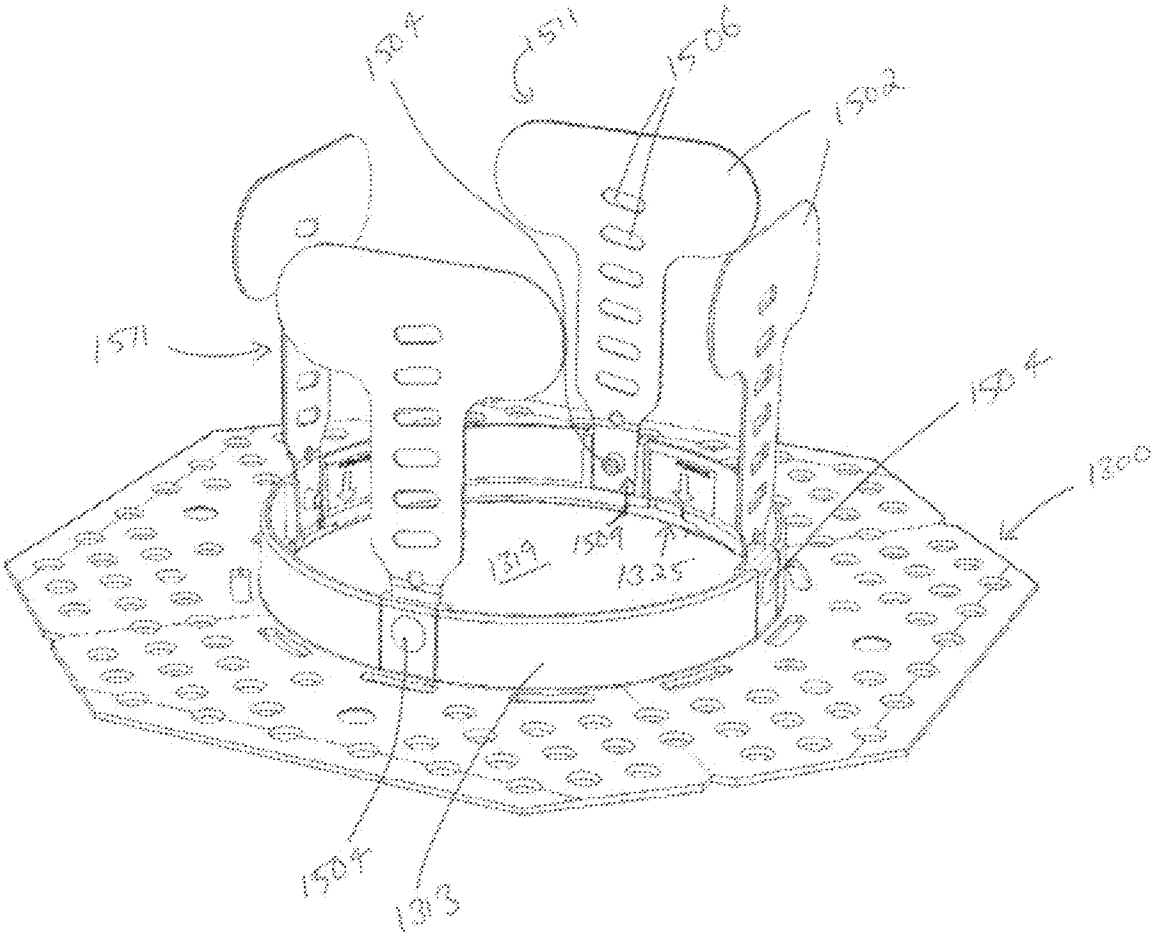
150a
150b
150c
150d
150e
150f
150g
150h
150i
150j
150k
150l
150m
150n
150o
150p
150q
150r
150s
150t
150u
150v
150w
150x
150y
150z
150aa
150ab
150ac
150ad
150ae
150af
150ag
150ah
150ai
150aj
150ak
150al
150am
150an
150ao
150ap
150aq
150ar
150as
150at
150au
150av
150aw
150ax
150ay
150az
150ba
150bb
150bc
150bd
150be
150bf
150bg
150bh
150bi
150bj
150bk
150bl
150bm
150bn
150bo
150bp
150bq
150br
150bs
150bt
150bu
150bv
150bw
150bx
150by
150bz
150ca
150cb
150cc
150cd
150ce
150cf
150cg
150ch
150ci
150cj
150ck
150cl
150cm
150cn
150co
150cp
150cq
150cr
150cs
150ct
150cu
150cv
150cw
150cx
150cy
150cz
150da
150db
150dc
150dd
150de
150df
150dg
150dh
150di
150dj
150dk
150dl
150dm
150dn
150do
150dp
150dq
150dr
150ds
150dt
150du
150dv
150dw
150dx
150dy
150dz
150ea
150eb
150ec
150ed
150ee
150ef
150eg
150eh
150ei
150ej
150ek
150el
150em
150en
150eo
150ep
150eq
150er
150es
150et
150eu
150ev
150ew
150ex
150ey
150ez
150fa
150fb
150fc
150fd
150fe
150ff
150fg
150fh
150fi
150fj
150fk
150fl
150fm
150fn
150fo
150fp
150fq
150fr
150fs
150ft
150fu
150fv
150fw
150fx
150fy
150fz
150ga
150gb
150gc
150gd
150ge
150gf
150gg
150gh
150gi
150gj
150gk
150gl
150gm
150gn
150go
150gp
150gq
150gr
150gs
150gt
150gu
150gv
150gw
150gx
150gy
150gz
150ha
150hb
150hc
150hd
150he
150hf
150hg
150hh
150hi
150hj
150hk
150hl
150hm
150hn
150ho
150hp
150hq
150hr
150hs
150ht
150hu
150hv
150hw
150hx
150hy
150hz
150ia
150ib
150ic
150id
150ie
150if
150ig
150ih
150ii
150ij
150ik
150il
150im
150in
150io
150ip
150iq
150ir
150is
150it
150iu
150iv
150iw
150ix
150iy
150iz
150ja
150jb
150jc
150jd
150je
150jf
150jg
150jh
150ji
150jj
150jk
150jl
150jm
150jn
150jo
150jp
150jq
150jr
150js
150jt
150ju
150jv
150jw
150jx
150jy
150jz
150ka
150kb
150kc
150kd
150ke
150kf
150kg
150kh
150ki
150kj
150kk
150kl
150km
150kn
150ko
150kp
150kq
150kr
150ks
150kt
150ku
150kv
150kw
150kx
150ky
150kz
150la
150lb
150lc
150ld
150le
150lf
150lg
150lh
150li
150lj
150lk
150ll
150lm
150ln
150lo
150lp
150lq
150lr
150ls
150lt
150lu
150lv
150lw
150lx
150ly
150lz
150ma
150mb
150mc
150md
150me
150mf
150mg
150mh
150mi
150mj
150mk
150ml
150mm
150mn
150mo
150mp
150mq
150mr
150ms
150mt
150mu
150mv
150mw
150mx
150my
150mz
150na
150nb
150nc
150nd
150ne
150nf
150ng
150nh
150ni
150nj
150nk
150nl
150nm
150nn
150no
150np
150nq
150nr
150ns
150nt
150nu
150nv
150nw
150nx
150ny
150nz
150oa
150ob
150oc
150od
150oe
150of
150og
150oh
150oi
150oj
150ok
150ol
150om
150on
150oo
150op
150oq
150or
150os
150ot
150ou
150ov
150ow
150ox
150oy
150oz
150pa
150pb
150pc
150pd
150pe
150pf
150pg
150ph
150pi
150pj
150pk
150pl
150pm
150pn
150po
150pp
150pq
150pr
150ps
150pt
150pu
150pv
150pw
150px
150py
150pz
150qa
150qb
150qc
150qd
150qe
150qf
150qg
150qh
150qi
150qj
150qk
150ql
150qm
150qn
150qo
150qp
150qq
150qr
150qs
150qt
150qu
150qv
150qw
150qx
150qy
150qz
150ra
150rb
150rc
150rd
150re
150rf
150rg
150rh
150ri
150rj
150rk
150rl
150rm
150rn
150ro
150rp
150rq
150rr
150rs
150rt
150ru
150rv
150rw
150rx
150ry
150rz
150sa
150sb
150sc
150sd
150se
150sf
150sg
150sh
150si
150sj
150sk
150sl
150sm
150sn
150so
150sp
150sq
150sr
150ss
150st
150su
150sv
150sw
150sx
150sy
150sz
150ta
150tb
150tc
150td
150te
150tf
150tg
150th
150ti
150tj
150tk
150tl
150tm
150tn
150to
150tp
150tq
150tr
150ts
150tt
150tu
150tv
150tw
150tx
150ty
150tz
150ua
150ub
150uc
150ud
150ue
150uf
150ug
150uh
150ui
150uj
150uk
150ul
150um
150un
150uo
150up
150uq
150ur
150us
150ut
150uv
150uw
150ux
150uy
150uz
150va
150vb
150vc
150vd
150ve
150vf
150vg
150vh
150vi
150vj
150vk
150vl
150vm
150vn
150vo
150vp
150vq
150vr
150vs
150vt
150vu
150vv
150vw
150vx
150vy
150vz
150wa
150wb
150wc
150wd
150we
150wf
150wg
150wh
150wi
150wj
150wk
150wl
150wm
150wn
150wo
150wp
150wq
150wr
150ws
150wt
150wu
150wv
150ww
150wx
150wy
150wz
150xa
150xb
150xc
150xd
150xe
150xf
150xg
150xh
150xi
150xj
150xk
150xl
150xm
150xn
150xo
150xp
150xq
150xr
150xs
150xt
150xu
150xv
150xw
150xx
150xy
150xz
150ya
150yb
150yc
150yd
150ye
150yf
150yg
150yh
150yi
150yj
150yk
150yl
150ym
150yn
150yo
150yp
150yq
150yr
150ys
150yt
150yu
150yv
150yw
150yx
150yy
150yz
150za
150zb
150zc
150zd
150ze
150zf
150zg
150zh
150zi
150zj
150zk
150zl
150zm
150zn
150zo
150zp
150zq
150zr
150zs
150zt
150zu
150zv
150zw
150zx
150zy
150zz

RECESSED LUMINAIRE COMPONENTS FOR VARYING FINISHING SECTION INSTALLATIONS

TECHNICAL FIELD

Embodiments of the present disclosure relate generally to light fixtures, and more particularly to recessed luminaires and components associated with the recessed luminaires.

BACKGROUND

Luminaires, such as ceiling-mounted, wall-mounted, or surface-mounted luminaires, commonly illuminate spaces in which people live, work, or play. One type of luminaire is the recessed luminaire, which is installed within an aperture formed in a ceiling. Typically, recessed luminaires may include at least: (a) a housing, such as a cylindrical can (herein 'recessed can') that defines a cavity, (b) a light source disposed in the cavity and oriented to emit light through an opening of the recessed can into the illumination area, such as a room, and (c) a finishing section that is disposed within the cavity of the recessed can and below the light source such that an integrated flange or a non-integrated trim ring of the finishing section may be disposed below and engage the ceiling to cover any space formed between a perimeter of the opening of the recessed can and a perimeter of the aperture formed in the ceiling. However, the integrated flange and/or trim ring of the finishing section can be aesthetically unappealing to an observer standing in the illuminated space. Further, cracks may be formed in the ceiling adjacent the aperture in the ceiling within which the recessed can is installed due to vibrations, thermal expansions or contractions, etc., of the recessed luminaire to the ceiling.

SUMMARY

In one aspect, the present disclosure can relate to a lighting system that includes a lathing ring. The lathing ring includes a collar that defines an annular opening, an outer flange that extends radially outward from an outer surface of the collar and comprising one or more perforated openings and one or more mounting holes formed therein, and an inner flange that is disposed adjacent to and above the outer flange, the inner flange extending radially inwards towards the annular opening from an inner surface of the collar. Further, the lighting system includes one or more fold-over tabs that are coupled to the collar of the lathing ring and comprising one or more installation slots. The lathing ring is coupled to a ceiling such that the ceiling is disposed between the outer flange of the lathing ring and the one or more fold-over tabs.

In another aspect, the present disclosure can relate to a lighting system that includes a housing assembly. The housing assembly includes a rimless housing can that includes a substantially cylindrical side wall that extends from a top annular edge to a bottom annular edge and defines an inner cavity, and one or more flange clips. Each flange clip is removably coupled to the substantially cylindrical side wall of the rimless housing can adjacent the bottom annular edge of the rimless housing such that a flange of each flange clip extends radially outward from the bottom annular edge of the rimless housing can. Further, the lighting system includes a lathing ring. The lathing ring includes a collar that defines an annular opening, an outer flange that extends radially outward from an outer surface of the collar, and an inner flange that is disposed adjacent to and above the outer flange. The inner flange extends radially inwards towards the annular opening from an inner surface of the collar. Further, the housing assembly is disposed in the annular opening defined by the collar of the lathing ring such that the flange of each flange clip that is removably coupled to the substantially cylindrical side wall of the rimless housing can engages the inner flange of the lathing ring.

In yet another aspect, the present disclosure can relate to a lighting system that includes a housing having a substantially cylindrical side wall that defines an annular opening and a flange that extends radially inwards towards the annular opening from an inner surface of the side wall. The flange includes one or more notches. Further, the lighting system includes a lathing ring that is coupled to the housing. The lathing ring includes an inner collar. The inner collar includes a plurality of wall sections that are detached from each other, and one or more snap tabs disposed between adjacent wall sections of the plurality of wall sections. Further, the lathing ring includes an outer collar disposed outside the inner collar and partially surrounding the inner collar, a groove formed between the inner collar and the outer collar, an outer flange that extends radially outward from the outer collar and comprising one or more perforations, and an inner flange that extends radially inwards towards the annular opening from the inner collar.

These and other aspect, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein:

FIG. 15 illustrates a perspective view of the lathing ring of FIG. 13 with the fold-over tabs coupled thereto, in accordance with example embodiments of the present disclosure;

Figure 1:
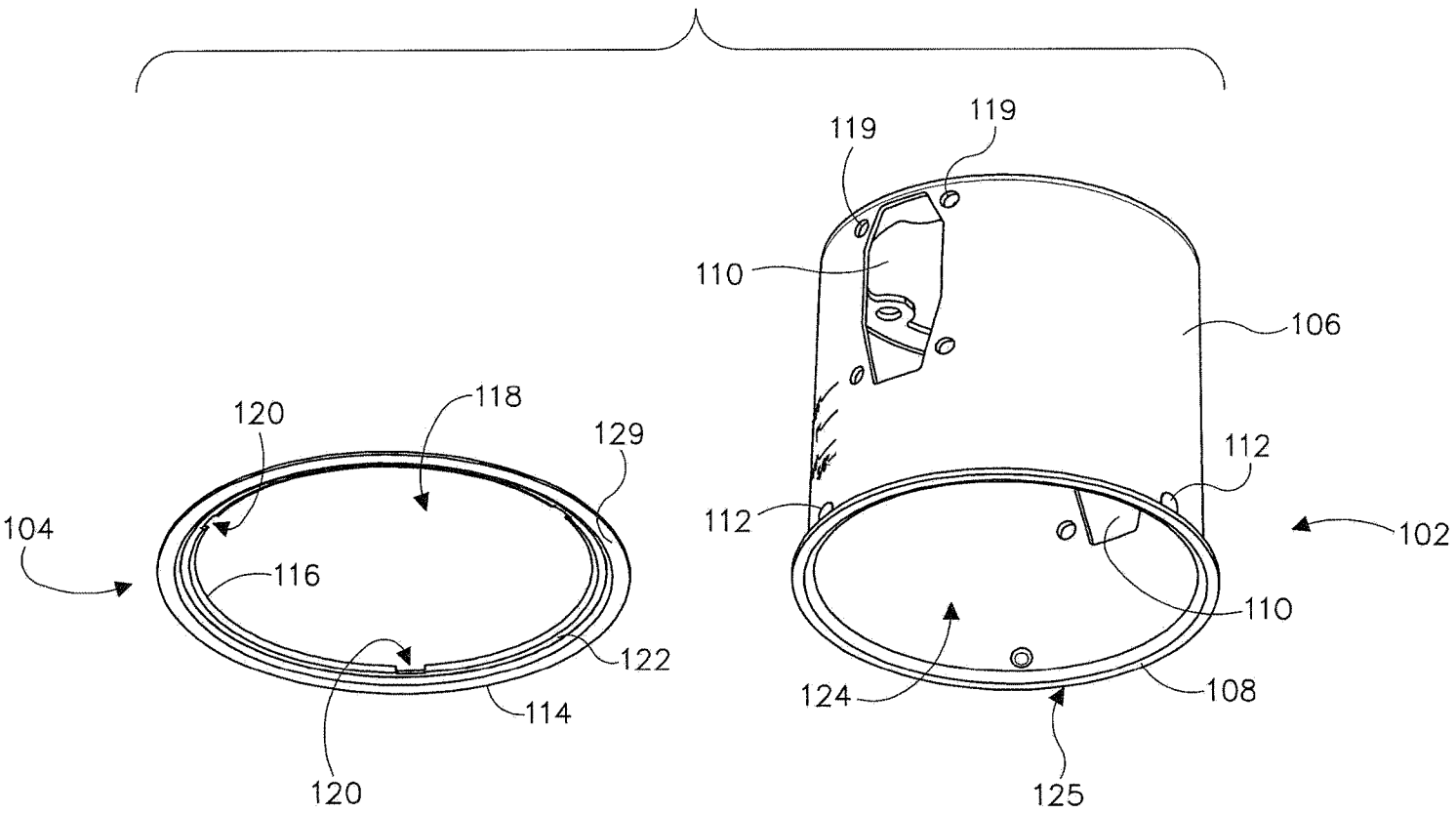
FIG. 1 illustrates a perspective view of a rimmed housing can and a detachable flange ring of a first example housing assembly of a recessed luminaire, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positioning may be exaggerated to help visually convey such principles.

DETAILED DESCRIPTION OF EXAMPLE EMBODIMENTS

In the following paragraphs, recessed luminaires and one or more components associated with the recessed luminaires that provide options to install different types of finishing sections for a flanged and/or flangeless appearance will be described in further detail by way of examples with reference to the attached drawings. In the description, well known components, methods, and/or processing techniques are omitted or are briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

In one example, the components associated with the recessed luminaire include a lathing ring that is coupled to a ceiling. The lathing ring may be used when a recessed luminaire installation that provides a flangeless appearance to the recessed luminaire finishing section is desired. Also, the lathing ring provides additional support to the ceiling around the aperture in the ceiling within which the recessed luminaire is installed. Further, the lathing ring prevents direct transfer of vibrations, thermal expansions, thermal contractions, etc., of the recessed luminaire to the ceiling, thereby avoiding the formation of cracks in the ceiling and preserving a structural integrity of the ceiling.

The lathing ring may include a collar that defines an opening, an external perforated flange that extends radially outward from the collar, and an inner flange that extends radially inward towards the opening and substantially perpendicular to the collar. Further, the collar includes one or more through apertures for coupling fold-over tabs to the lathing ring using fasteners. The fold-over tabs are configured to couple the lathing ring to the ceiling. Alternatively, the lathing ring may be designed to snap onto a recessed luminaire housing, thereby making the installation of the lathing ring independent of the ceiling (particularly, the thickness of the ceiling). The snap fit lathing ring may include one or more snap tabs that are configured to engage corresponding notches in the recessed luminaire housing.

In addition to the lathing ring, the components associated with the recessed luminaire include a rimless recessed luminaire housing and one or more flange clips that can be removably coupled to the rimless recessed luminaire housing such that the flanges of the one or more flange clips extend radially outward from a bottom edge of the recessed luminaire housing. The rimless recessed luminaire housing with the one or more flange clips coupled thereto is installed in the ceiling that is fitted with the lathing ring. The flanges of the one or more flange clips assist with the installation of the rimless recessed luminaire housing in the ceiling, particularly, to align and to prevent over-insertion of the rimless recessed luminaire housing in the ceiling during installation.

Instead of the rimless recessed luminaire housing, in some examples, the components associated with the recessed luminaire include a rimmed recessed luminaire housing and a detachable flange ring that is removably coupled to the rimmed recessed luminaire housing to align and to prevent over-insertion of the rimmed recessed luminaire housing in the ceiling during installation. The rimmed recessed luminaire housing with the detachable flange ring is configured to be installed in the ceiling without the lathing ring. The rimmed recessed luminaire housing with the detachable flange ring allows the installation of finishing sections that have a narrower or shorter integrated flange or non-integrated trim ring than conventional recessed luminaires.

The technologies of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "example embodiments" given herein are intended to be non-limiting and among others supported by representations of the present technology.

Moving now to discuss the figures, FIGS. 1-12 will describe an example embodiment of a recessed luminaire having a rimmed recessed luminaire housing and a detachable flange ring; FIGS. 13-23 will describe another example embodiment of a recessed luminaire having a rimmed recessed luminaire housing that is installed in a ceiling fitted with a lathing ring for providing a flangeless appearance of a finishing section; FIGS. 24-38 will describe yet another example embodiment of a recessed luminaire having a rimless recessed luminaire housing and one or more flange clips for installation in a ceiling fitted with the lathing ring; and FIGS. 39-46 will describe a snap fit lathing ring.

Figure 2:
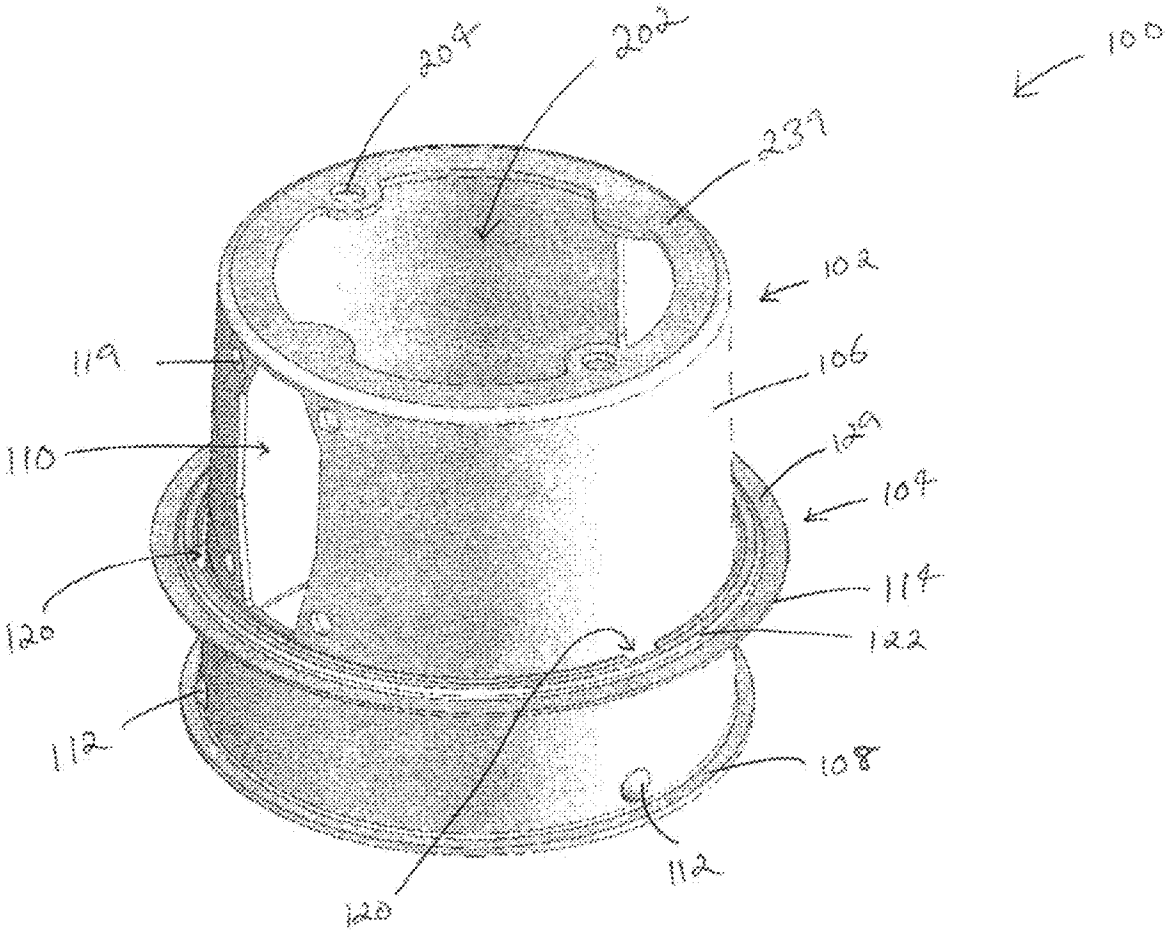
FIGS. 2-4 illustrate how the detachable flange ring is coupled to a rimmed housing can to form the first example housing assembly of the recessed luminaire, in accordance with example embodiments of the present disclosure.
Figure 4:
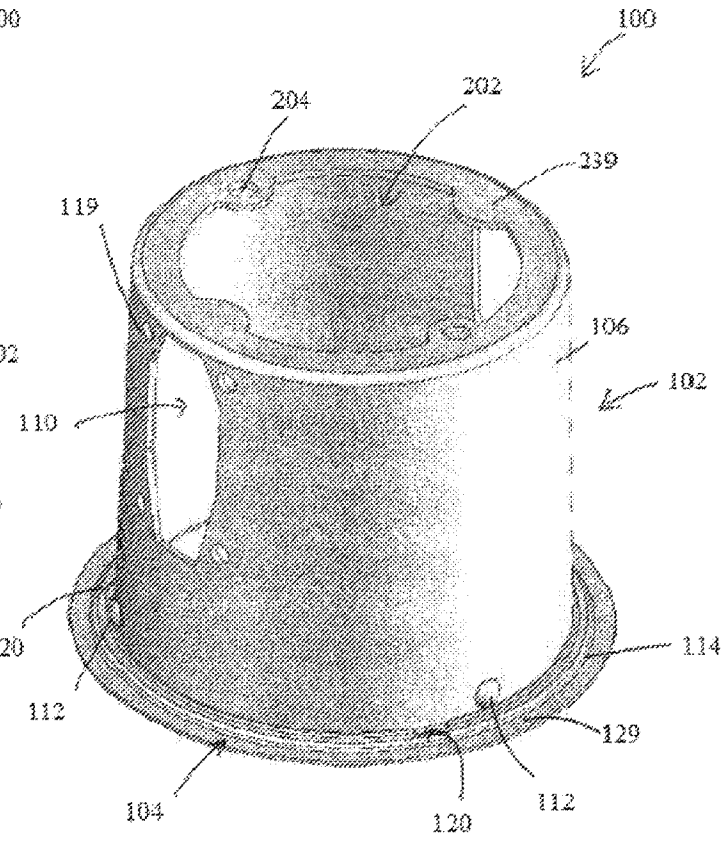
Figure 3:
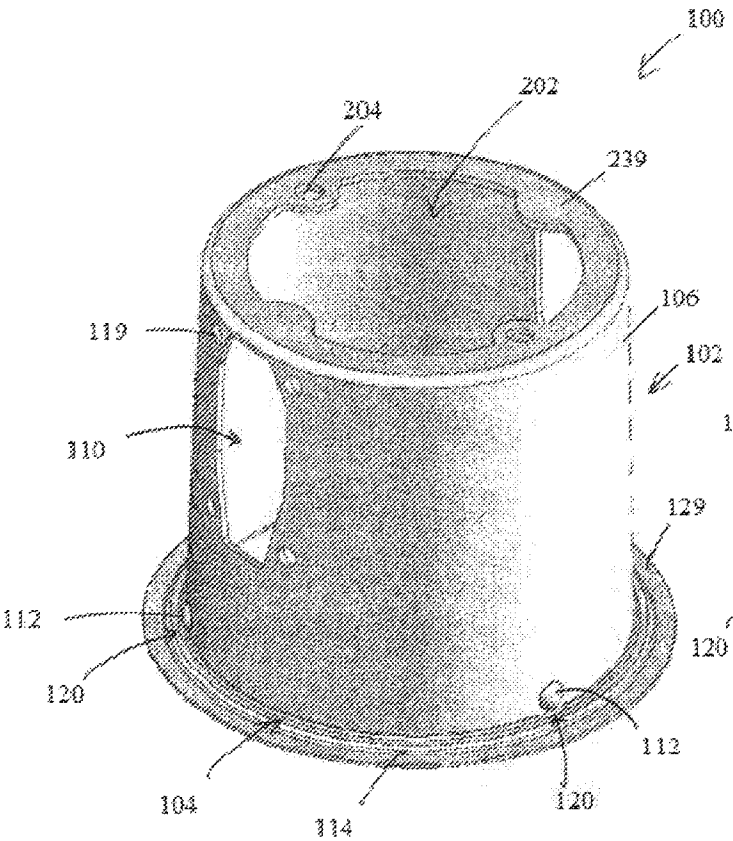
Figure 5:
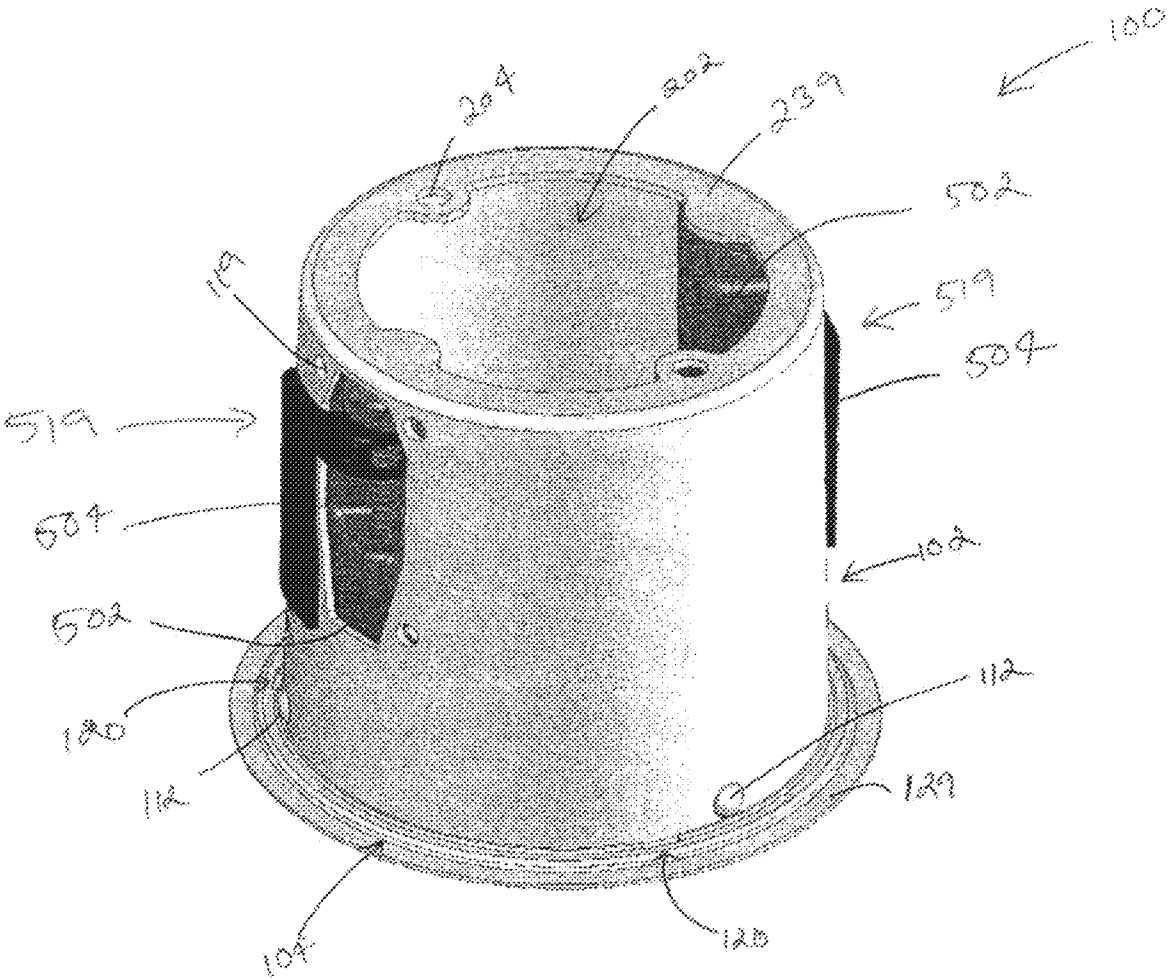
FIG. 5 illustrates a perspective view of the first example housing assembly of the recessed luminaire with a pawl assembly coupled thereto, in accordance with example embodiments of the present disclosure.
Figure 6:
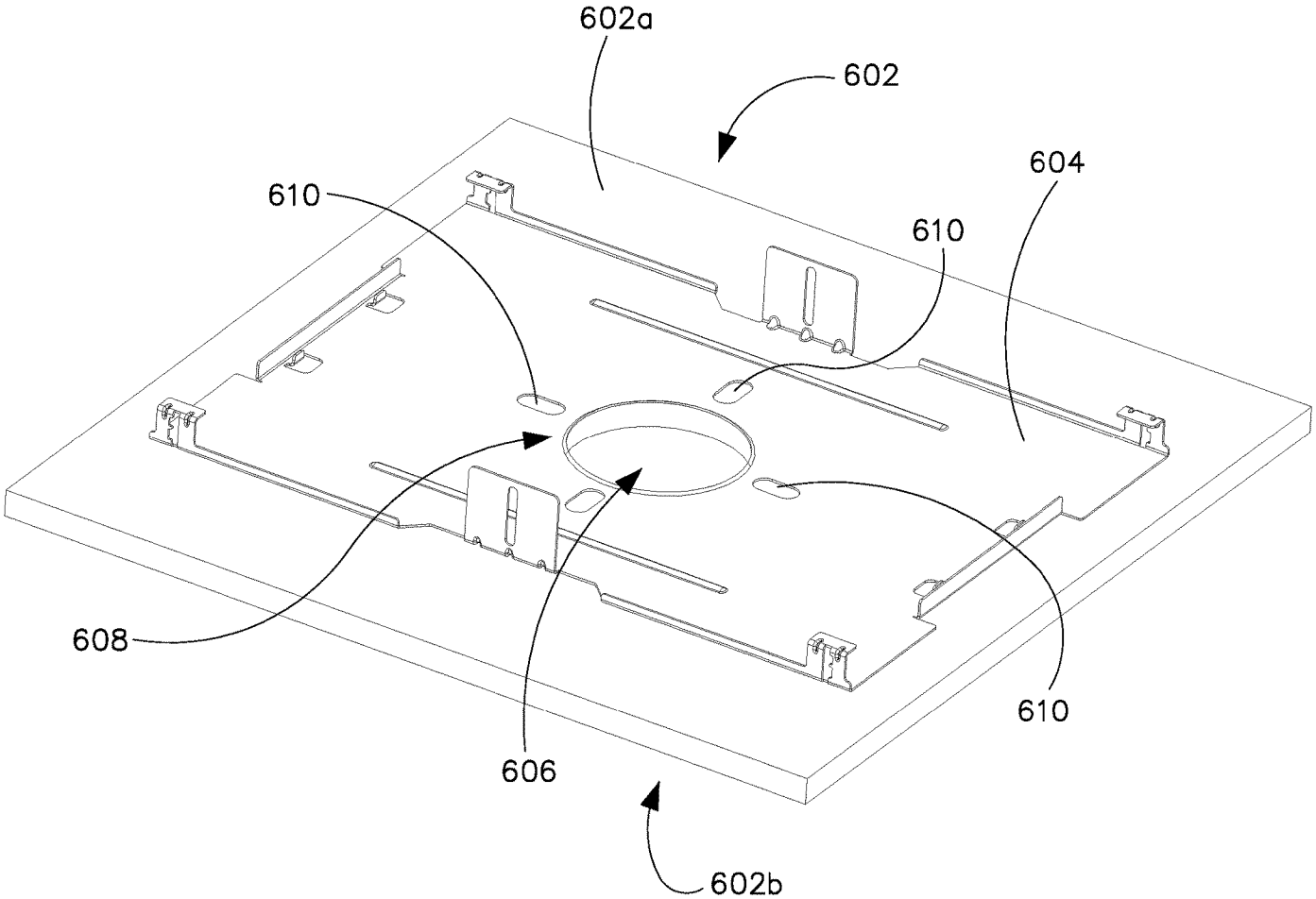
FIG. 6 illustrates a perspective view of a plaster ground plate disposed on a ceiling, in accordance with example embodiments of the present disclosure.
Figure 7:
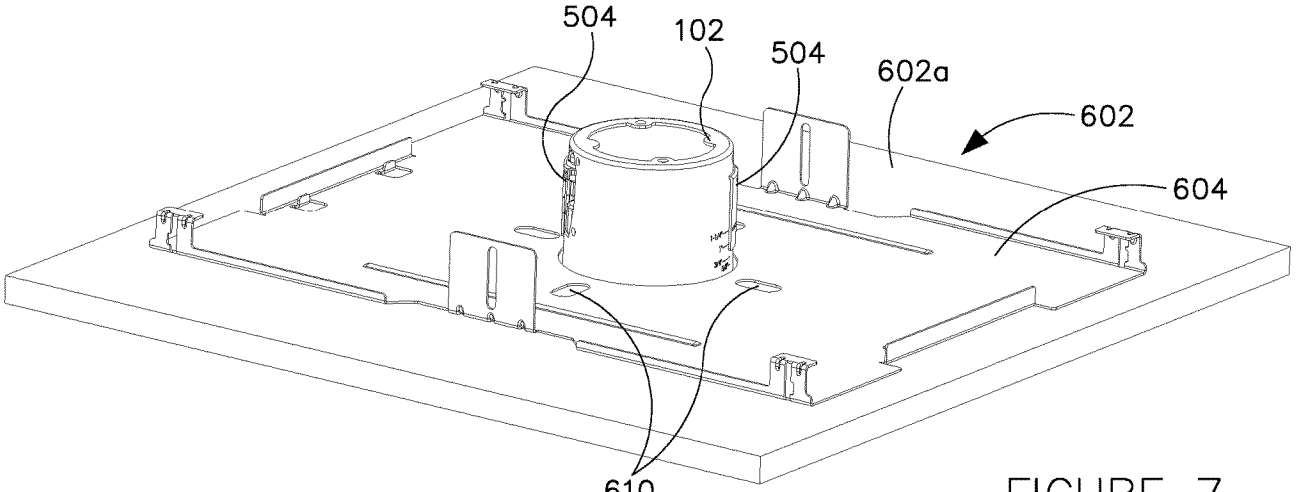
FIGS. 7-9 illustrate an installation of the first example housing assembly of the recessed luminaire in the ceiling, in accordance with example embodiments of the present disclosure.
Figure 8:
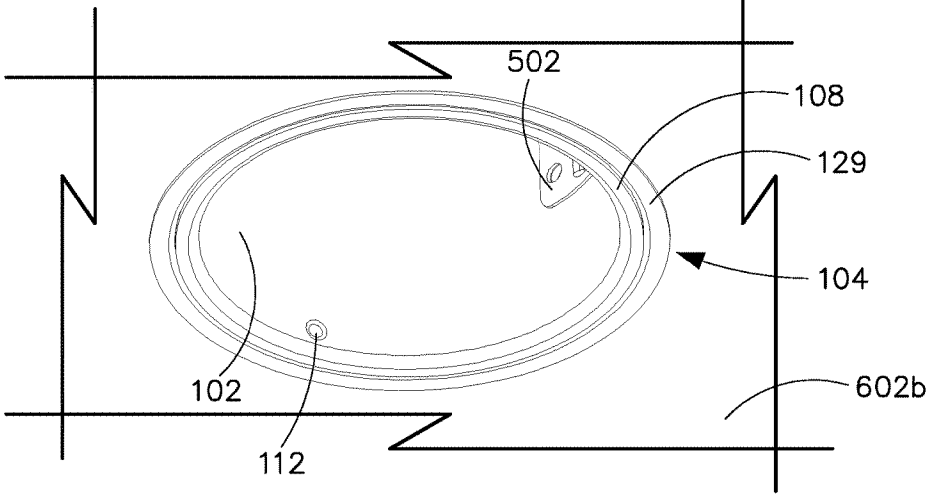
Figure 9:
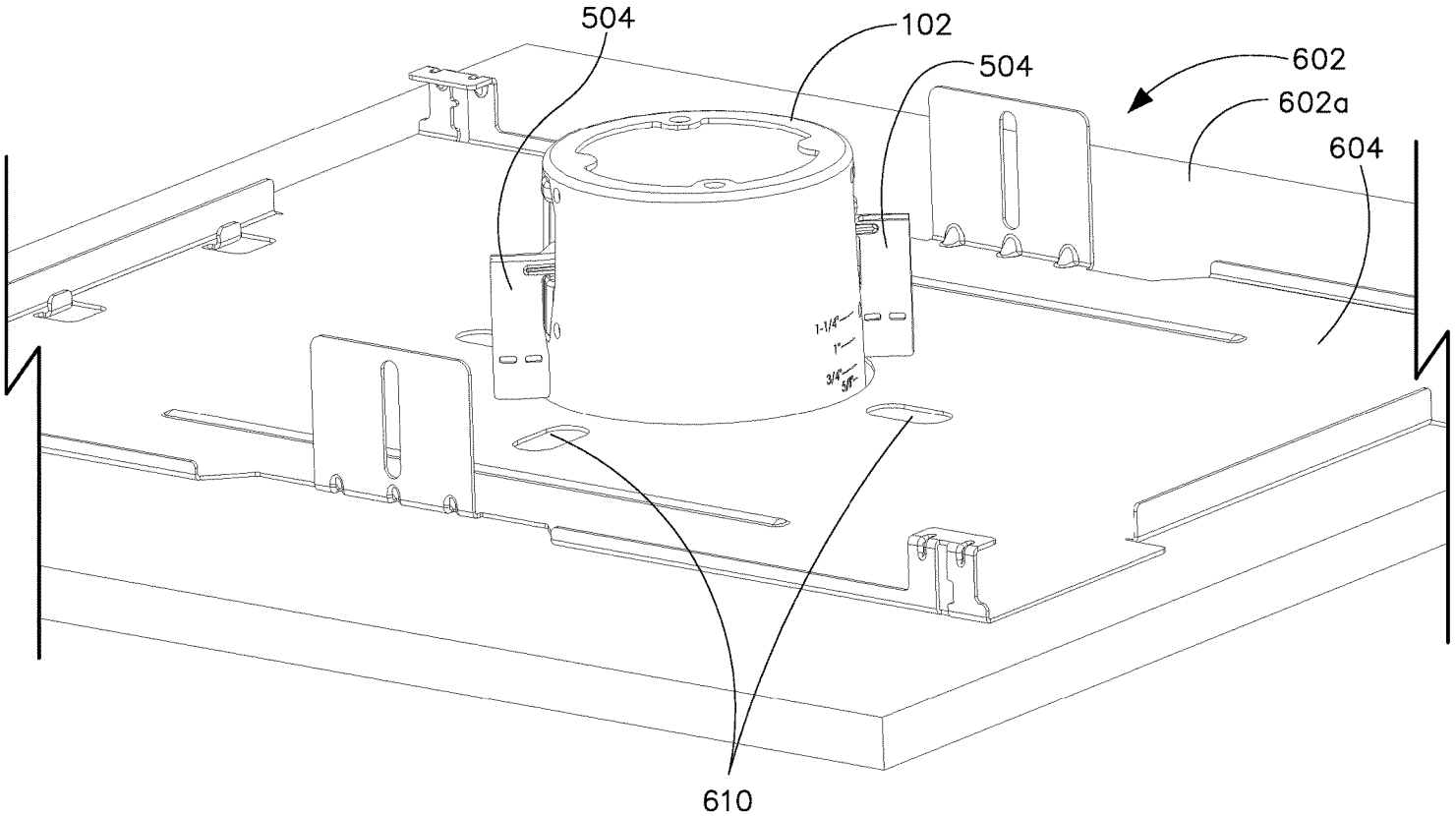
Figure 10:
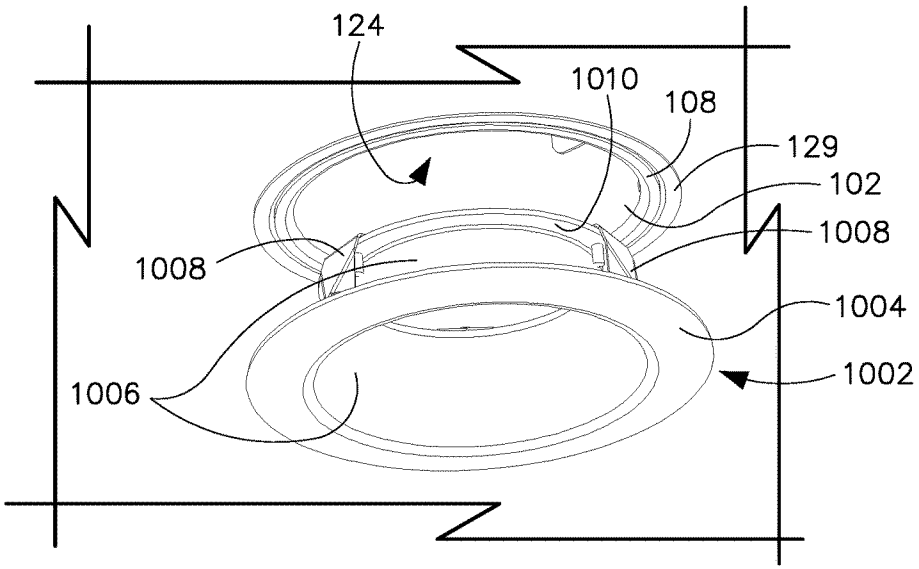
FIGS. 10-11 illustrate an installation of a first example finishing section in the first example housing assembly of the recessed luminaire, in accordance with example embodiments of the present disclosure.
Figure 11:
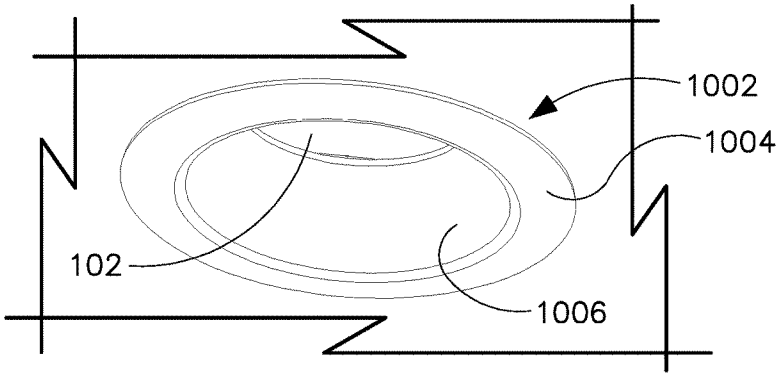
Figure 12:
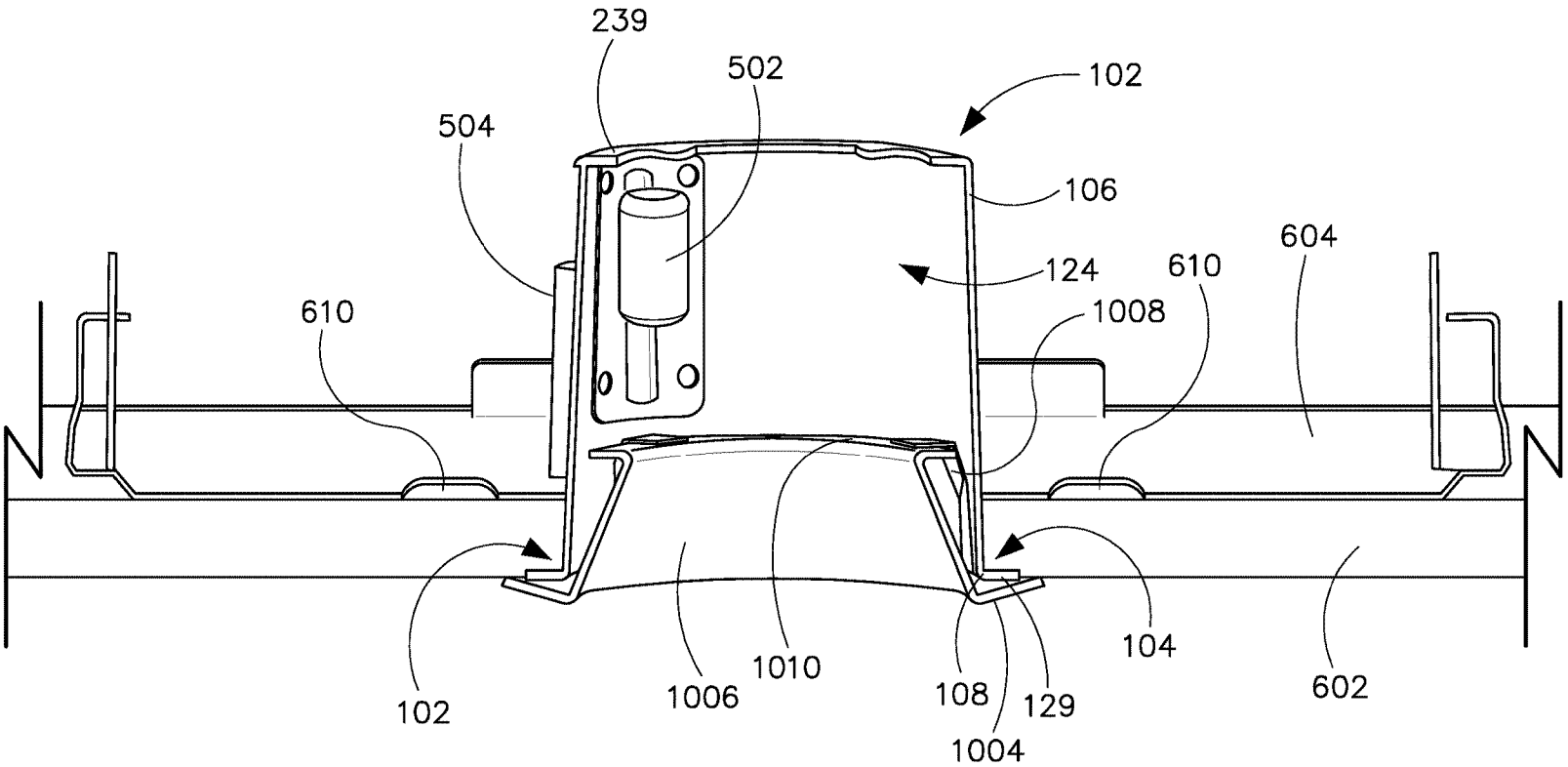
FIG. 12 illustrates an example cross-section view of the recessed luminaire with the first example housing assembly installed in the ceiling and the first example finishing section disposed in the first example housing assembly, in accordance with example embodiments of the present disclosure.

Recessed Luminaire with a Rimmed Housing can and a Detachable Flange Ring for Installation of Finishing Sections Having Narrower Flange/Trim Ring FIG. 1 illustrates a perspective view of a rimmed housing can and a detachable flange ring of a first example housing assembly of a recessed luminaire, in accordance with example embodiments of the present disclosure; FIGS. 2-4 illustrate how the detachable flange ring is coupled to a rimmed housing can to form the first example housing assembly of the recessed luminaire, in accordance with example embodiments of the present disclosure; FIG. 5 illustrates a perspective view of the first example housing assembly of the recessed luminaire with a pawl assembly coupled thereto, in accordance with example embodiments of the present disclosure; FIG. 6 illustrates a perspective view of a plaster ground plate disposed on a ceiling, in accordance with example embodiments of the present disclosure; FIGS. 7-9 illustrate an installation of the first example housing assembly of the recessed luminaire in the ceiling, in accordance with example embodiments of the present disclosure; FIGS. 10-11 illustrate an installation of a first example finishing section in the first example housing assembly of the recessed luminaire, in accordance with example embodiments of the present disclosure; and FIG. 12 illustrates an example cross-section view of the recessed luminaire with the first example housing assembly installed in the ceiling and the first example finishing section disposed in the first example housing assembly, in accordance with example embodiments of the present disclosure.

Referring to FIGS. 1-12, a housing assembly 100 of a recessed luminaire may include a rimmed recessed luminaire housing 102 (herein 'rimmed housing can 102') that has a substantially cylindrical side wall 106 and a rim 108 that extends radially outward and substantially perpendicular to the side wall 106 from a bottom edge of the side wall 106. Alternatively, in other example embodiments, the rimmed recessed luminaire housing 102 may have a side wall having any other appropriate geometric or non-geometric shape without departing from a broader scope of the present disclosure. For example, the side wall 106 may taper towards the top by as much as five degrees. Similarly, in other example embodiments, the rim 108 may be inclined upwards or downwards at an angle without departing from a broader scope of the present disclosure.

The side wall 106 of the rimmed housing can 102 may define a substantially cylindrical cavity 124 that is configured to house a light assembly 3804 (shown in FIG. 38) of the recessed luminaire and/or electrical components associated with the light assembly 3804. Further, the bottom edge of the side wall 106 may define a light emitting opening 125 that provides access to the cavity 124 and allows light emitted by a light source of the light assembly 3804 to exit to an illumination area, such as a room. In addition to the light emitting opening 125, the side wall 106 of the rimmed housing can 102 may include one or more mounting assembly openings 110 to receive a respective retention system, such as a pawl assembly 519 (shown in FIG. 5). The pawl assembly 519 is an example retention system and one of ordinary skill in the art can understand and appreciate that the pawl assembly 519 can be replaced by any other appropriate retention system, such as remodel springs, other non-spring based retention systems, etc., without departing from a broader scope of the present disclosure.

The side wall 106 of the rimmed housing can 102 may also include one or more coupling apertures 119 that are disposed around each mounting assembly opening 110 for coupling the pawl assembly 519 to the rimmed housing can 102 using appropriate fasteners, such as screws, rivets, etc. For example, as illustrated in FIG. 5, the pawl assembly 519 may include a pawl housing 502 that is coupled to the side wall 106 of the rimmed housing can 102 by aligning coupling apertures 509 on the pawl housing 502 with the coupling apertures 119 of the side wall 106 and passing fasteners (not shown) therethrough. The pawl assembly 519 also includes a threaded screw 506 that passes through the pawl housing 502 and a pawl 504 that is coupled to the threaded screw 506. The pawl assembly 519 may be configured to mount the rimmed housing can 102 in the ceiling 602 (shown in FIG. 6) as will be described in greater detail below in association with FIGS. 7-9. Furthermore, the side wall 106 of the rimmed housing can 102 may also include one or more locking projections 112 that are disposed adjacent the rim end of the rimmed housing can 102 and extend out from an external surface of the side wall 106.

In addition to the side wall 106 and the rim 108, the rimmed housing can 102 includes a top surface 239 that extends radially inward from a top edge of the side wall 106 towards the cavity 124. The top surface 239 may define a heat sink opening 202 to receive a heat sink assembly 3802 (shown in FIG. 38) therethough. The heat sink assembly 3802 may be thermally coupled to the light module 3804 and configured to transfer heat away from the light module 3804 that is disposed in the cavity 124 formed by the side wall 106 of the rimmed housing can 102. The heat sink assembly 3802 and/or the light module 3804 may be coupled adjacent the top surface 239 of the rimmed housing can 102 using fasteners that are passed through the coupling apertures 204 disposed on the top surface 239 of the rimmed housing can 102.

In addition to the rimmed housing can 102, the housing assembly 100 of the recessed luminaire may include a detachable flange ring 104. As illustrated in FIG. 1, the detachable flange ring 104 may include an inner annular edge 116 that defines an opening 118, an outer annular edge 114, and a ring body 199 disposed between inner annular edge 116 and the outer annular edge 114. The ring body 199 may have a substantially Z-shaped cross-sectional profile (shown in FIG. 12) that includes a planar coupling base 122 and a flange 129 that is disposed adjacent to and below the planar coupling base 122. Further, the ring body 199 may include one or more notches 120 that are formed in the planar coupling base 122 and along the inner annular edge 116. The diameter of the opening 118 defined by the detachable flange ring 104 may be larger than the diameter of the substantially cylindrical side wall 106 of the rimmed housing can 102 to allow the detachable ring 104 to be disposed over and around the side wall 106 of the rimmed housing can 102 as illustrated in FIGS. 2-4.

Referring to FIGS. 2-4, the detachable flange ring 104 may be removably coupled to the rimmed housing can 102 by inserting the substantially cylindrical side wall 106 of the rimmed housing can 102 through the opening 118 defined by the detachable flange ring 104 as illustrated in FIG. 2. While inserting the rimmed housing can 102 through the opening 118 defined by the detachable flange ring 104, the notches 120 formed in the planar coupling base 122 of the detachable flange ring 104 may be aligned with the locking projections 112 on the side wall 106 of the rimmed housing can 102 to allow the detachable flange ring 104 to pass over the locking projections 112 as illustrated in FIG. 3. Once the detachable flange ring 104 passes over the locking projections 112 on the side wall 106, the rim 108 of the rimmed housing can 102 may engage the detachable flange ring 104 such that: (a) the planar coupling base 122 of the detachable flange ring 104 rests on the rim 108 of the rimmed housing flange 102, and (b) the flange 129 of the detachable flange ring 104 may be flush with the rim 108 of the rimmed housing can 102 and extend radially outward from the rim 108 of the rimmed housing can 102. Then, the detachable flange ring 104 may be locked and securely coupled to the rimmed housing can 102 by rotating the detachable flange ring 104 such that the notches 120 formed in the planar coupling base 122 of the detachable flange ring 104 are not aligned with the locking projections 112 on the side wall 106 of the rimmed housing can 102 as illustrated in FIG. 4.

To decouple the detachable flange ring 104 from the rimmed housing can 102, the detachable flange ring 104 may be rotated such that the notches 120 of the detachable flange ring 104 align with the locking projections 112 of the rimmed housing can 104. Then, the detachable flange ring 104 may be pulled up and removed from the rimmed housing can 102.

Once the detachable flange ring 104 is removably coupled to the rimmed housing can 102, the flange 129 of the detachable flange ring 104 may act as an extension of the rim 108 of the rimmed housing can 102. In particular, the flange 129 of the detachable flange ring 104 may be configured to assist with alignment and installation of the rimmed housing can 102 in the ceiling 602. For example, the detachable flange ring 104 may prevent an over-insertion of the rimmed housing can 102 in the ceiling 602 when the flange 129 of the detachable flange ring 104 engages the ceiling 602 as illustrated in FIG. 8. The diameter of the rimmed housing can 102 including the rim 108 may be lesser than the diameter of the aperture 606 (shown in FIG. 6) in the ceiling 602. Accordingly, during installation, if the rimmed housing can 102 is inserted through the aperture 606 in the ceiling 602 without the detachable flange ring 104, the rimmed housing can 102 may pass through the aperture 606 in the ceiling 602 without being impeded. However, when the detachable flange ring 104 is coupled to the rimmed housing can 102, the flange 129 of the detachable flange ring 104 may be wide enough to engage the ceiling 602 and act as a stop mechanism to prevent over-insertion and allow proper installation of the rimmed housing can 102 in the ceiling 602.

The width of the flange 129 of the detachable flange ring 104 may be configured to be just enough to engage the ceiling 602, thereby allowing an installation of a finishing section 1002 having a narrower trim flange 1004 (shown in FIG. 10) than conventional recessed luminaires. Detachable flange rings with a wider flange may be used. However, such detachable flange rings with wider flanges may require a finishing section with a wider flange to conceal the flange 129 of the detachable flange rings 104 and/or the rim 108 of the rimmed housing can 102. Finishing sections with wider flanges may be aesthetically unappealing to an observer in an illumination area and therefore undesirable.

Additionally, the detachable flange ring 104 allows the same rimmed housing can 102 to be used in other recessed lighting installations. For example, the detachable flange ring 104 may be coupled to the rimmed housing can 102 for an installation that allows a finishing section having a narrower flange to be coupled to the recessed housing can 102 as illustrated in FIGS. 1-12. In other examples, the detachable flange ring 104 may be removed for using the same rimmed housing can 102 in flangeless installations as illustrated in FIGS. 13-23.

Referring to FIGS. 6-9, the rimmed housing can 102 with the detachable flange ring 104 and the pawl assembly 519 may be installed in the ceiling 602 by inserting the rimmed housing can 102 through the aperture 606 in the ceiling 602 till the flange 129 of the detachable flange ring 104 engages a bottom surface 602*b* (surface that is visible to an observer in the illumination area, such as a room) of the ceiling 602. As illustrated in FIG. 6, a plaster ground plate 604 may be disposed on the ceiling 602 for ceiling adjustments and T-grid installations. In particular, the plaster ground plate 604 may be disposed on the top surface 602*a* of the ceiling 602 such that an opening 608 in the plaster ground plate 604 is aligned with the aperture 606 of the ceiling 602. It is noted that hanger bars are omitted from FIG. 6 for the sake of clarity, i.e., to clearly illustrate the plaster ground plate 604. Once the rimmed housing can 102 is inserted in the ceiling 602 and the flange 129 of the detachable flange ring 104 engages the ceiling 602, as illustrated in FIG. 9, the pawl 504 of the pawl assembly 519 that is coupled to the rimmed housing can 102 may be adjusted such that the pawl 504 engages the top surface 602*a* of the ceiling 602 (or the plaster ground plate 604) and clamps the ceiling 602 between the pawl 504 and the flange 129 of the detachable flange ring 104. Then, as illustrated in FIGS. 10-11, the finishing section 1002 may be coupled to the rimmed housing can 102 by inserting the finishing section 1002 in the cavity 124 defined by the rimmed housing can 102 till the trim flange 1004 of the finishing section engages the bottom surface 602*b* of the ceiling 602 and conceals the flange 129 of the detachable flange ring 104 and the rim 108 of the rimmed housing can 102. The finishing section 1002 may be retained in the rimmed housing can 102 by friction using friction clips 1008 that engage the inner surface of the rimmed housing can's side wall 106 as illustrated in FIG. 12. The friction clips 1008 may be coupled to the top collar 1010 of the finishing section 1002 that extends radially outward from a top annular edge of a body 1006 of the finishing section 1002.

Even though the present disclosure describes a plaster ground plate 604 being installed on the ceiling 602, one of ordinary skill in the art can understand and appreciate that in other example embodiments, the plaster ground plate 604 may be omitted without departing from a broader scope of the present disclosure. Further, even though FIGS. 1-12 describe the rimmed housing can 102 being used along with the detachable flange ring 104 in a recessed luminaire installation where the trim flange 1004 of the finishing section 1002, though narrower than in conventional recessed luminaires, is still visible; one of ordinary skill in the art can understand and appreciate that in other example embodiments, the rimmed housing can 102 can be used in other types of installations, such as recessed luminaire installations that provide a flangeless appearance to the finishing section without departing from a broader scope of the present disclosure. For example, the rimmed housing can 102 may be used with a lathing ring 1300 in a recessed luminaire installation that provide a flangeless appearance to the finishing section, as illustrated in FIGS. 13-23.

Figure 13:
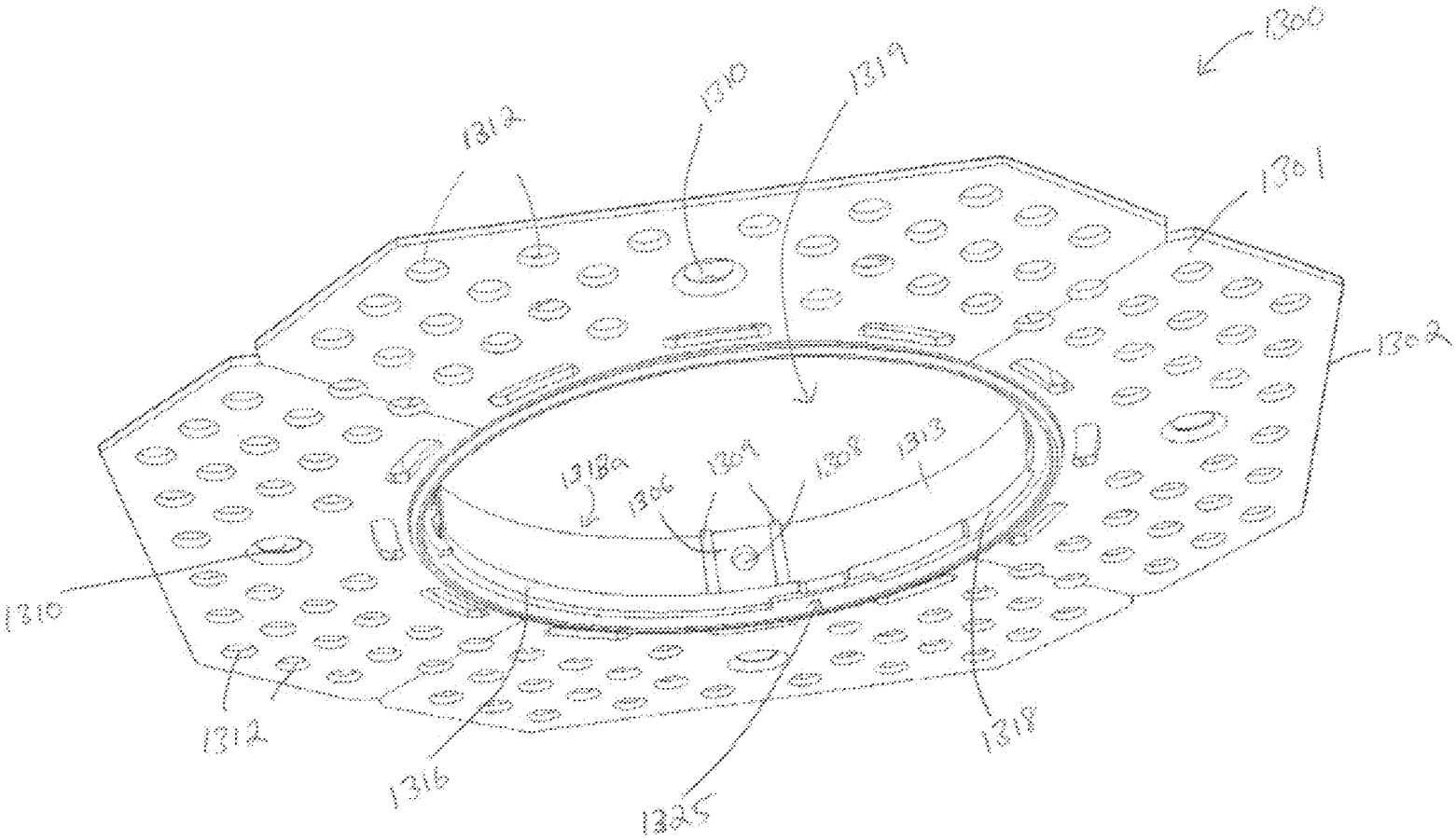
FIG. 13 illustrates a perspective view of a lathing ring, in accordance with example embodiments of the present disclosure.
Figure 14:
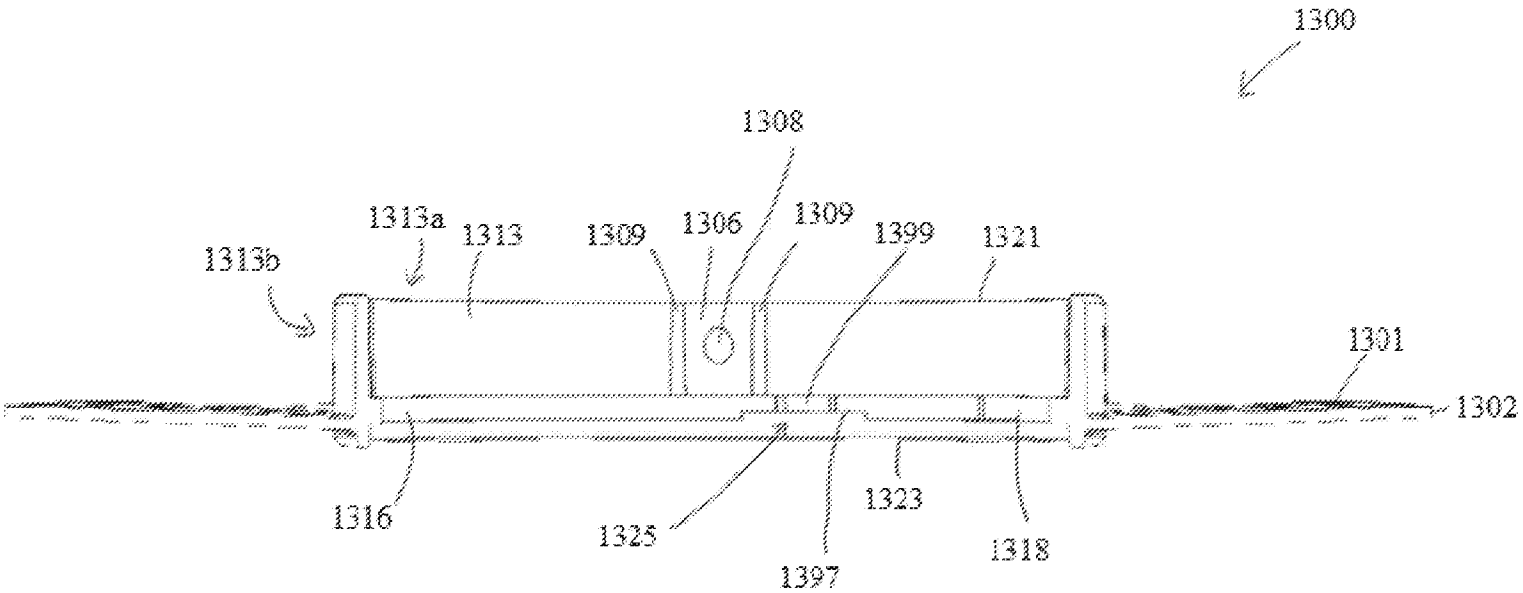
FIG. 14 illustrates a cross-section view of the lathing ring of FIG. 13, in accordance with example embodiments of the present disclosure.
Figure 16A:
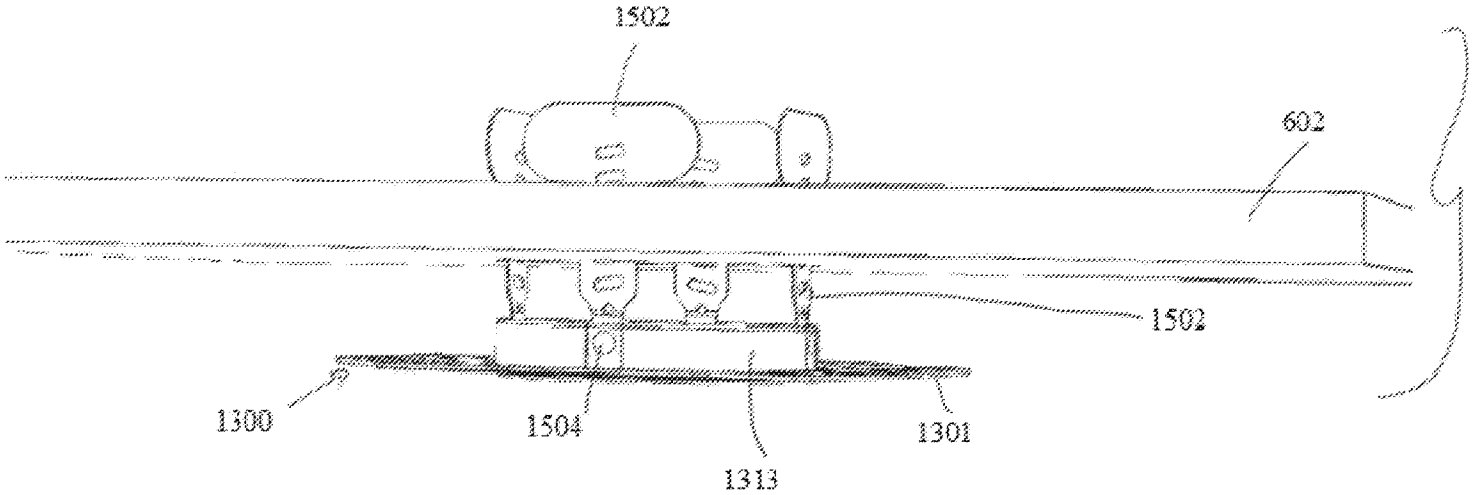
FIGS. 16A and 16B (collectively "FIG. 16") and 17-18 illustrate how the lathing ring is installed in the ceiling using the fold-over tabs, in accordance with example embodiments of the present disclosure.
Figure 16B:
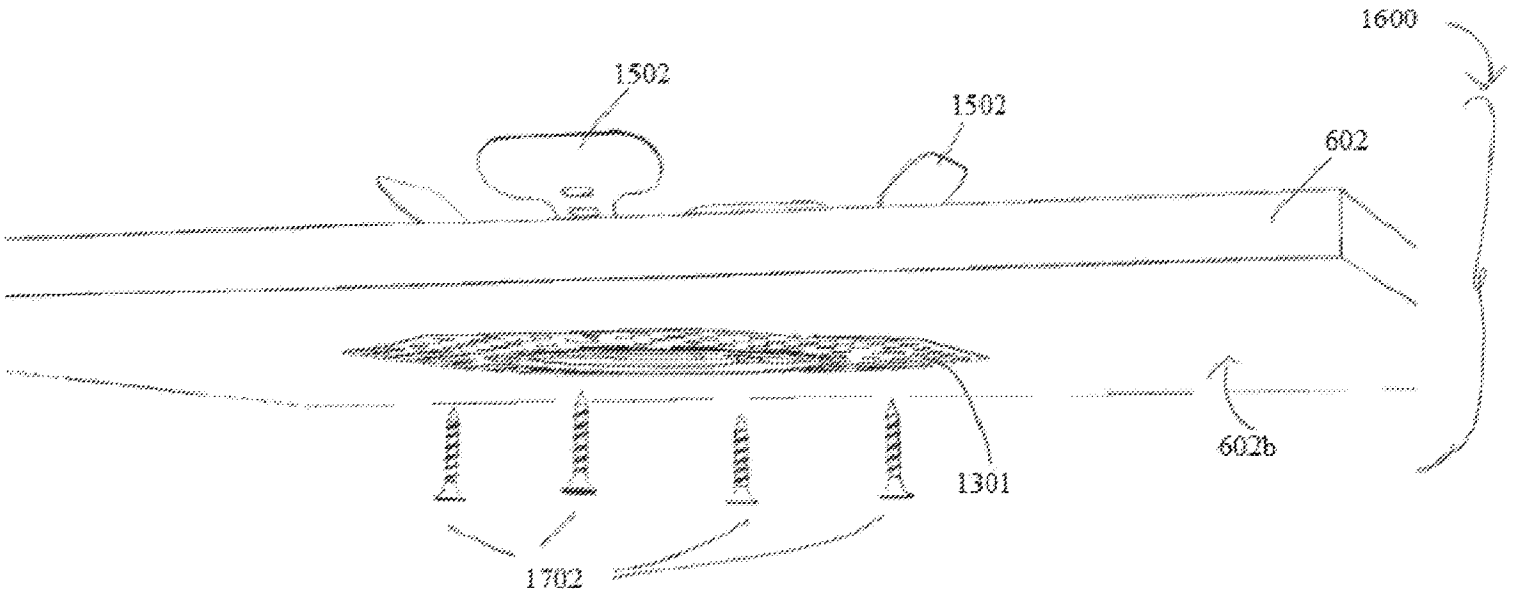
Figure 17:
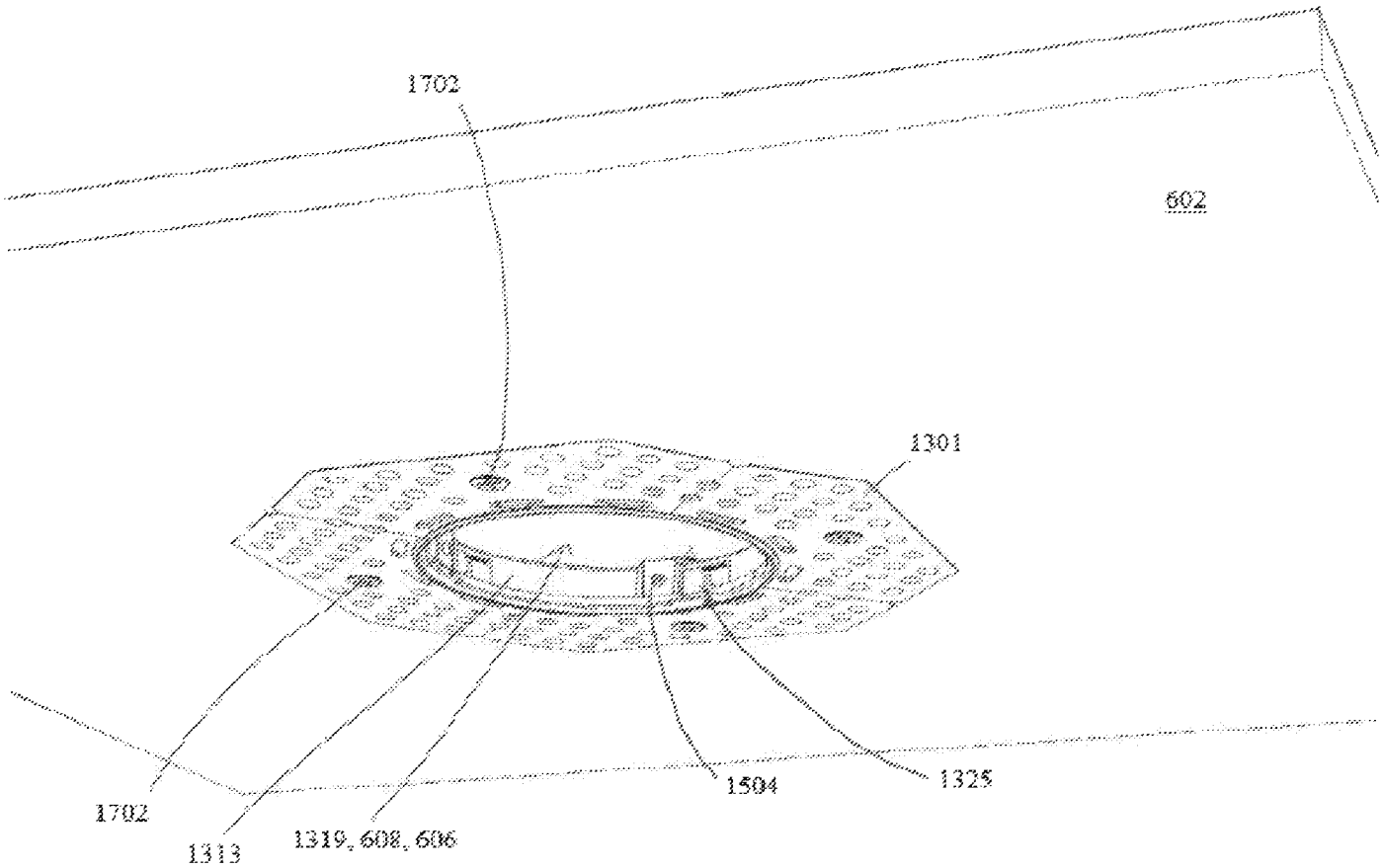
Figure 18:
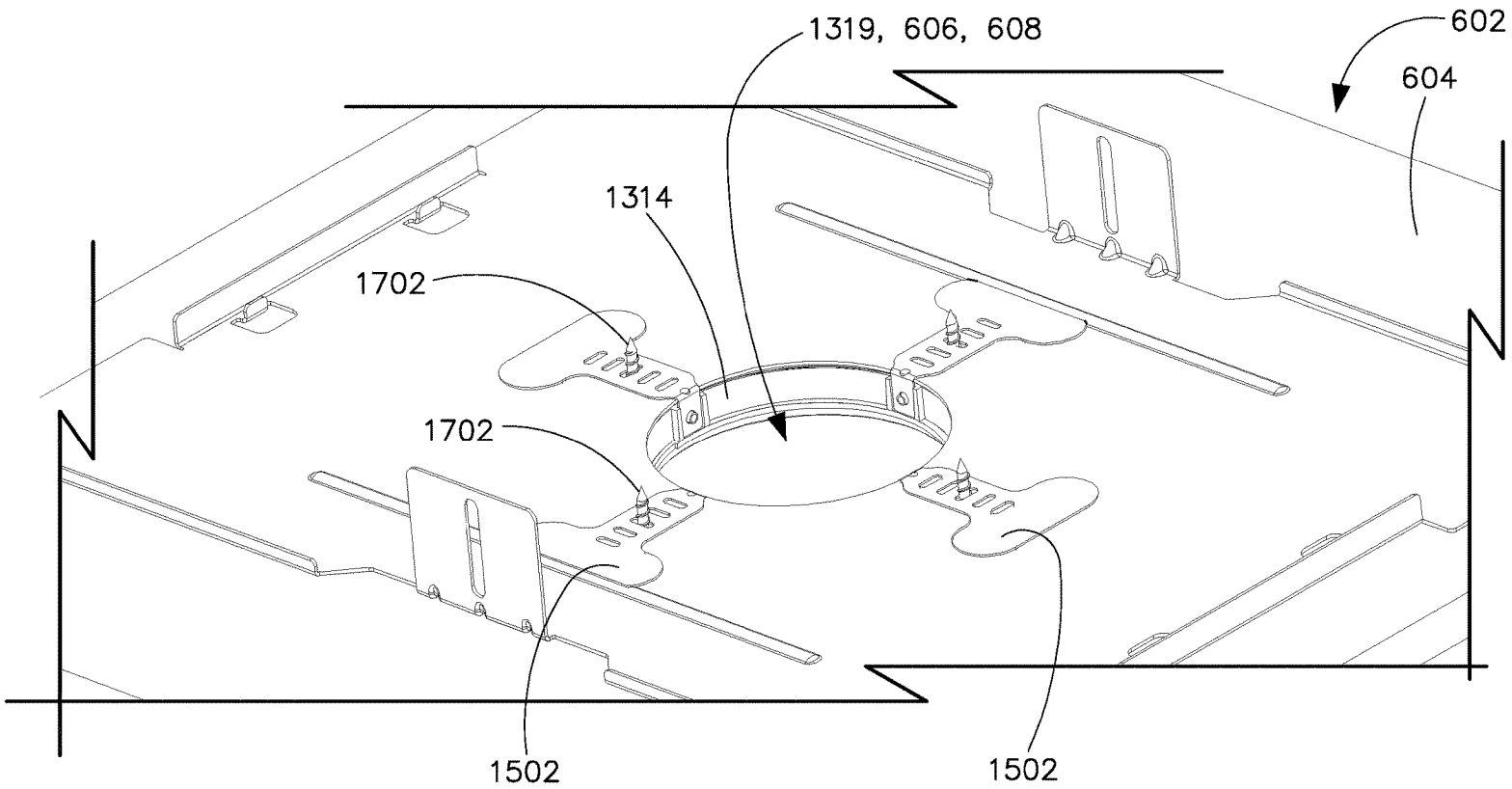
Figure 20:
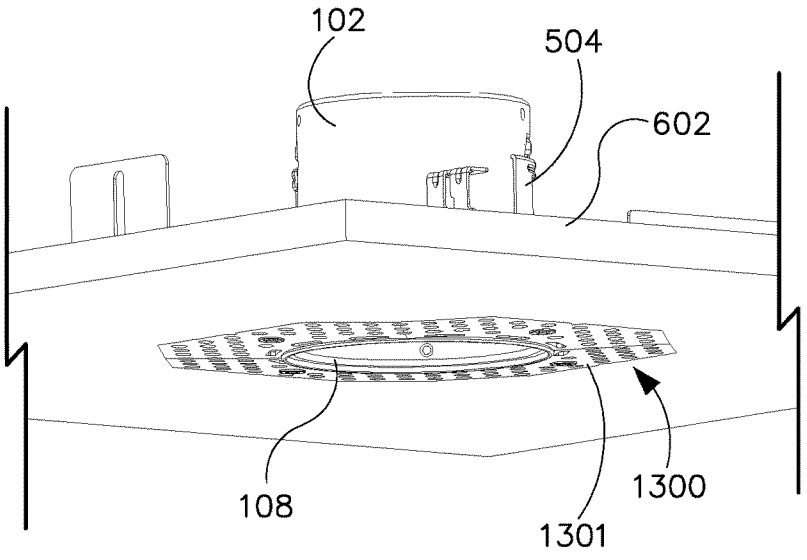
FIGS. 19-20 illustrate an installation of a second example rimmed housing can of the recessed luminaire in the ceiling fitted with the lathing ring, in accordance with example embodiments of the present disclosure.
Figure 19:
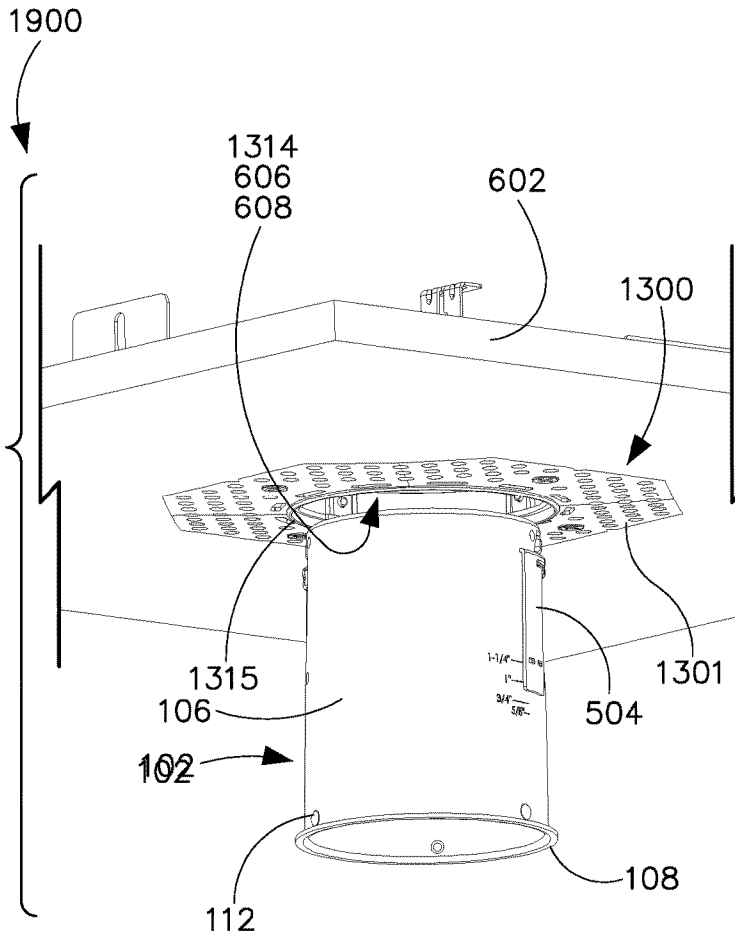
Figure 22A:
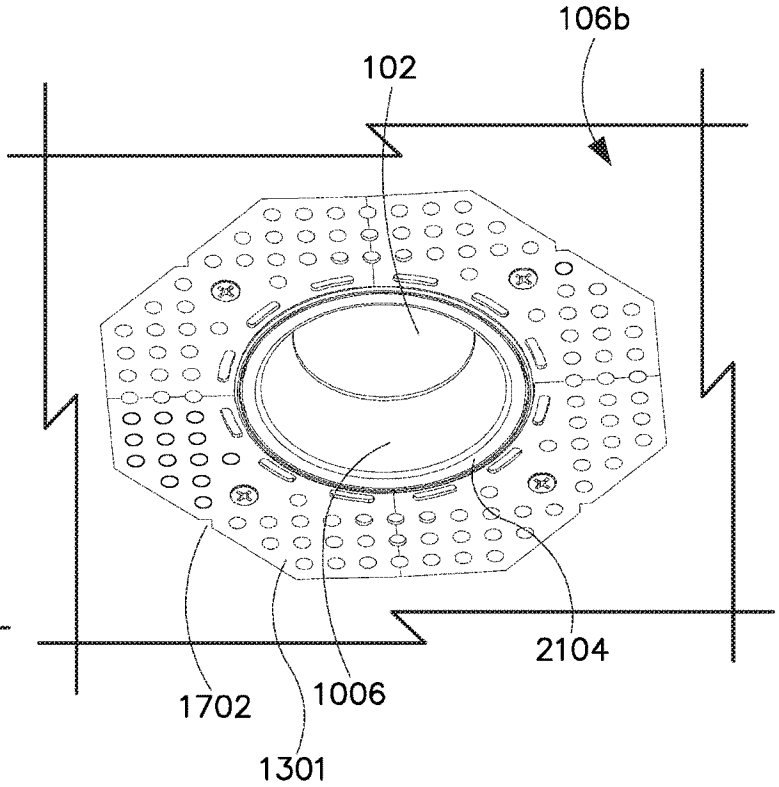
FIGS. 21, 22A, and 22B (FIGS. 22A and 22B collectively "FIG. 22") illustrate an installation of a second example finishing section in the second example rimmed housing can of the recessed luminaire which in turn is installed in the ceiling fitted with the lathing ring, in accordance with example embodiments of the present disclosure.
Figure 21:
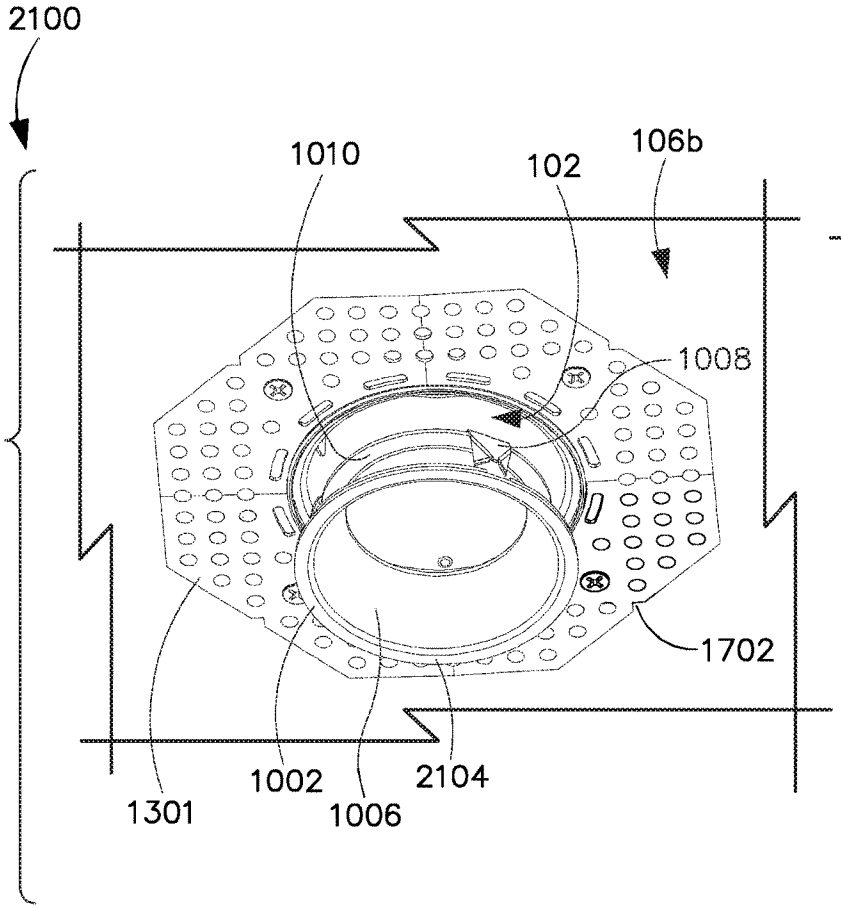

Recessed Luminaire with a Rimmed Housing can and a Lathing Ring for Providing a Flangeless Appearance to a Finishing Section Installed in the Rimmed Housing can FIG. 13 illustrates a perspective view of a lathing ring, in accordance with example embodiments of the present disclosure; FIG. 14 illustrates a cross-section view of the lathing ring of FIG. 13, in accordance with example embodiments of the present disclosure; FIG. 15 illustrates a perspective view of the lathing ring of FIG. 13 with the fold-over tabs coupled thereto, in accordance with example embodiments of the present disclosure; FIGS. 16-18 illustrate how the lathing ring is installed in the ceiling using the fold-over tabs, in accordance with example embodiments of the present disclosure; FIGS. 19-20 illustrate an installation of a second example rimmed housing can of the recessed luminaire in the ceiling fitted with the lathing ring, in accordance with example embodiments of the present disclosure; FIGS. 21-22 illustrates an installation of a second example finishing section in the second example rimmed housing can of the recessed luminaire which in turn is installed in the ceiling fitted with the lathing ring, in accordance with example embodiments of the present disclosure; and FIG. 23 illustrates an example cross-section view of the recessed luminaire with the second example rimmed housing can installed in the ceiling fitted with the lathing ring and the second example finishing section disposed in the second example rimmed housing can, in accordance with example embodiments of the present disclosure.

Referring to FIGS. 13-23, the lathing ring 1300 may include an annular collar 1313 that defines an opening 1319. The annular collar 1313 may extend from a top annular edge 1321 to a bottom annular edge 1323 and has an inner surface 1313*a* and an outer surface 1313*b*. Further, the lathing ring 1300 may include an outer flange 1301 that extends radially outward from the outer surface 1313*b* of the annular collar 1313 (herein 'collar 1313'). The outer flange 1301 may extend slightly upward forming an acute angle with the collar 1313 and may be slightly feathered to the outer edge 1302 allowing for an even transition to a ceiling surface (e.g., bottom surface 602*b* of ceiling 602). In certain example embodiments, the outer edge 1302 of the outer flange 1301 may define an octagonal shape as illustrated in FIG. 13. However, in other example embodiments, the outer edge 1302 of the outer flange 1301 may define any other appropriate non-geometric or geometric shape, such as circle, rectangle, square, etc., without departing from a broader scope of the present disclosure.

Further, the outer flange 1301 of the lathing ring 1300 may include a plurality of perforated openings 1312 that are formed circumferentially around the outer flange 1301 and extend through the thickness of the outer flange 1301. The perforated openings 1312 facilitate plastering on the outer flange 1301 since these perforated openings 1312 provide an area for the plaster to adhere itself. Additionally, the outer flange 1301 may include one or more mounting holes 1310 formed around and through the outer flange 1301. The one or more mounting holes 1310 may be configured to receive fasteners 1702 therethrough to couple the lathing ring 1300 to the ceiling 602 as illustrated in FIGS. 17, 18, and 23.

Furthermore, the lathing ring 1300 may include an inner flange 1316 that is disposed above the outer flange 1301 and extends radially inward towards the opening 1319 from the inner surface 1313*a* of the annular collar 1313. The inner flange 1316 may have a first set of notches 1318 formed therein to allow the pawl 504 coupled to the rimmed housing can 102 to pass therethough without being impeded by the inner flange 1316 during installation of the rimmed housing can 102 in the ceiling 602. Additionally, the inner flange 1316 may have a second set of notches 1325 formed therein to allow a portion of one or more flange clips (2502/2602) (shown in FIGS. 25 and 36) to pass therethrough while impeding the feet/flange portion of the flange clips 2502 or 3602 during installation to prevent over-insertion of the housing assembly as will be described in FIGS. 28-32. Also, the inner flange 1316 of the lathing ring 1300 may be narrower than the outer flange 1301.

Even though the present disclosure describes the inner flange 1316 of the lathing ring 1300 as having a first set of notches 1318 and a second set of notches 1325, one of ordinary skill in the art can understand and appreciate that in other example embodiments, the inner flange 1316 may not include the first set of notches 1318 and/or a second set of notches 1325 without departing from a broader scope of the present disclosure. For example, when installing a rimmed housing can 102 in a ceiling 602 fitted with the lathing ring 1300, both set of notches (1318, 1325) are optional. Further, in another example, if a retention system other than a pawl 504 is used, then, the inner flange 1316 of the lathing ring 1300 may include a thinner first set of notches 1318. Alternatively, the first set of notches 1318 may be configured according to the shape of the retention system or the first set of notches 1318 may be omitted.

Furthermore, even though the present disclosure describes the second set of notches 1325 formed in the inner flange 1316 of the lathing ring 1300 as being configured to impede the feet/flange portion of the flange clips 2502 or 3602 during installation to prevent over-insertion of the housing assembly, one of ordinary skill in the art can understand and appreciate that in other example embodiments, the second set of notches 1325 are optional even when the flange clips 2502 or 3602 are used. However, when present, the second set of notches 1325 assist in guiding the installation of the recessed housing can such that the recessed housing can in installed in a specific position as desired in some lighting applications, for example, in wall wash lighting applications.

As illustrated in FIGS. 13 and 14, the lathing ring 1300 may include one or more tab apertures 1308 disposed on the collar 1313 above the inner flange 1316. The tab apertures 1308 may extend from the inner surface 1313*a* of the collar 1313 through the outer surface 1313*b* of the collar 1313. Further, the collar 1313 may include guide rails 1309 disposed on either side of each tab aperture 1308. The guide rails 1309 may be configured to guide a coupling portion 1509 of a fold-over tab 1502 (shown in FIG. 15) into a groove 1306 formed between the guide rails 1309 in the collar 1313 of the lathing ring 1300 such that an aperture in the coupling portion 1509 of the fold-over tab 1502 may be axially aligned with the tab aperture 1308 of the collar 1313. As illustrated in FIG. 15, once the coupling portion 1509 of a fold-over tab 1502 is disposed in the groove 1306 formed between the guide rails 1309 and the aperture in the coupling portion 1509 of the fold-over tab 1502 is axially aligned with the tab aperture 1308 of the collar 1313, a fastener 1504 may be passed through the axially aligned apertures of the fold-over tab 1502 and the collar 1313 to couple the fold-over tab 1502 to the lathing ring 1300.

In certain example embodiments, multiple fold-over tabs 1502 may be coupled to the lathing ring 1300. In addition to the coupling portion 1509, the fold-over tabs 1502 may include a ceiling installation portion 1511 that comprises one or more installation slots 1506. The ceiling installation portion 1511 of the fold-over tabs 1502 may be flexible and may be configured to bend with respect to the coupling portion 1509. For example, the ceiling installation portion of the fold-over tabs 1502 may bend from a first position illustrated in FIGS. 15 and 16 where the ceiling installation portion 1511 and the coupling portion 1509 of the fold-over tabs 1502 are in the same plane to a second position illustrated in FIG. 18 where the ceiling installation portion 1511 and the coupling portion 1509 of the fold-over tabs 1502 are in different planes such that they form an angle between them. Even though FIG. 18 illustrates the ceiling installation portion 1511 of the fold-over tabs 1502 being bent such that it is substantially perpendicular to the coupling portion 1509, one of ordinary skill in the art can understand appreciate that in other example embodiments, the ceiling installation portion 1511 of the fold-over tabs 1502 may be bent more or less than shown in FIG. 18.

Referring to FIGS. 16-18, to couple the lathing ring 1300 to the ceiling 602, the fold-over tabs 1502 may be coupled to the lathing ring 1300 as described above and as illustrated in FIG. 15. Further, the lathing ring 1300 equipped with the fold-over tabs 1502 may be inserted through the aperture 606 of the ceiling 602 and the aperture 608 of the plaster ground plate 604 disposed on the ceiling 602. Even though the present disclosure describes installing the lathing ring 1300 in a ceiling 602 fitted with the plaster ground plate 604, one of ordinary skill in the art can understand and appreciate that in other example embodiments, installing the lathing ring in a ceiling without the plaster ground plate 604 is within the broader scope of the present disclosure. For example, in retrofit installations, the lathing ring 1300 may be installed in a ceiling that is not fitted with the plaster ground plate 604.

In particular, the lathing ring 1300 equipped with the fold-over tabs 1502 may be inserted through the apertures (606, 608) of the ceiling 602 and the plaster ground plate 604 till the outer flange 1301 of the lathing ring 1300 engages the bottom surface 602*b* of the ceiling 602. While inserting the lathing ring 1300 through the apertures (606, 608) of the ceiling 602 and the plaster ground plate 604, the ceiling installation portion 1511 of the fold-over tabs 1502 may be in the same plane as the coupling portion 1509 of the fold-over tabs 1502. That is, the ceiling installation portion 1509 of the fold-over tabs 1502 may be substantially perpendicular to the inner and/or outer flanges (1301, 1306) of the lathing ring 1300 as illustrated in FIG. 16. Responsive to inserting the lathing ring 1300 equipped with the fold-over tabs 1502 through the apertures (606, 608) of the ceiling 602 and the plaster ground plate 604, as illustrated in FIG. 18, the ceiling installation portion 1511 of the fold-over tabs 1502 may be bent to a second position where: (a) the ceiling installation portion 1511 engages the plaster ground plate 604 such that the plaster ground plate 604 and the ceiling is held between the ceiling installation portion 1511 of the fold-over tabs 1502 and the outer flange 1301 of the lathing ring 1300. In other words, the ceiling installation portion 1511 of the fold-over tabs 1502 may be bent such that they are substantially parallel with the ceiling 602. Then, as illustrated in FIG. 18, the lathing ring 1300 may be coupled to the ceiling 602 using fasteners 1702 that pass through the one or more mounting holes 1310 of the lathing ring's outer flange 1301, the ceiling 602, the mounting apertures 610 (shown in FIG. 6) of the plaster ground plate 604, and exit through one of the installation slots 1506 of the respective fold-over tabs 1506 that is axially aligned with the mounting holes 1310 of the lathing ring 1300.

In other example embodiments, the installation slots 1506 of the fold-over tabs 1502 may be sized such that installation slots 1506 allow a sheet-rock screw to thread into it and clamp the lathing ring 1300 to the ceiling 602 without the plaster ground plate 604. That is, the plaster ground plate 604 may be optional for the installation of the lathing ring 1300 in the ceiling 602.

Turning to FIGS. 19-20, responsive to installing the lathing ring 1300 in the ceiling 602, the rimmed housing can 102 with the pawl assembly 519 coupled thereto may be installed in the ceiling 602 that is fitted with the lathing ring 1300. In particular, initially, the rimmed housing can 102 with the pawl assembly 519 may be positioned below the ceiling 602 fitted with the lathing ring 1300 such that: (a) the rimmed housing can 102 is axially aligned with the aperture 606 defined by the ceiling 602, the opening 608 of the plaster ground plate 604, and the opening 1319 defined by the lathing ring 1300 that is installed in the ceiling 602; and (b) the pawls 504 that are coupled to the rimmed housing can 102 are aligned with the first set of notches 1318 formed in the inner flange 1316 of the lathing ring 1300. Responsively, the rimmed housing can 102 may be pushed up towards the ceiling 602 such that: (a) the side wall 106 of the rimmed housing can 102 passes through the aperture 606 and openings (608, 1319) defined by the ceiling 602, the plaster ground plate 604, and the lathing ring 1300, respectively; and (b) the pawls 504 coupled to the rimmed housing can 102 passes through the first set of notches 1318 formed in the in the inner flange 1316 of the lathing ring 1300, till the rim 108 of the rimmed housing can 102 engages and is impeded by the inner flange 1316 of the lathing ring 1300. Then, the pawls 504 of the pawl assemblies 519 coupled to the rimmed housing can 102 may be adjusted such that the pawls 504 engage the top surface 602*a* of the ceiling 602 (or the plaster ground plate 604) and clamps the ceiling 602 between the pawls 504 and the outer flange 1301 of the lathing ring 1300.

Further, as illustrated in FIGS. 21-22, the finishing section 1002 may be coupled to the rimmed housing can 102 by inserting the finishing section 1002 in the cavity 124 defined by the rimmed housing can 102 till the trim flange 2104 of the finishing section 1002 engages the bottom surface of the rim 108 of the rimmed housing can 102. The finishing section 1002 may be retained in the rimmed housing can 102 by friction using friction clips 1008 that engage the inner surface of the rimmed housing can's side wall 106 as illustrated in FIG. 23. The friction clips 1008 may be coupled to the top collar 1010 of the finishing section 1002 that extends radially outward from a top annular edge of a body 1006 of the finishing section 1002. The trim flange 2104 of the finishing section 1002 may be narrower than the trim flange 1004 of the finishing section 1002 illustrated in FIGS. 10-12

Figure 22B:
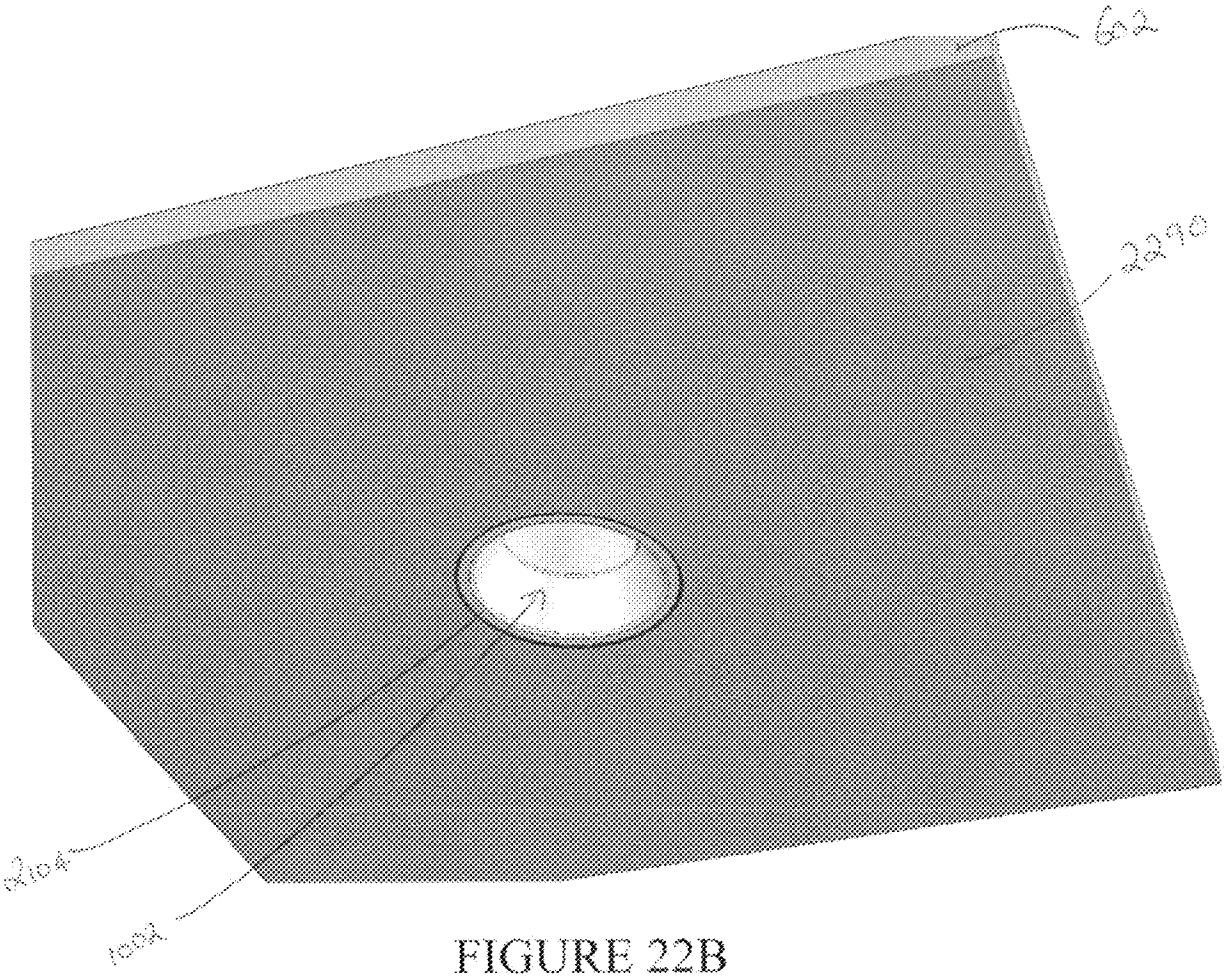
Figure 23:
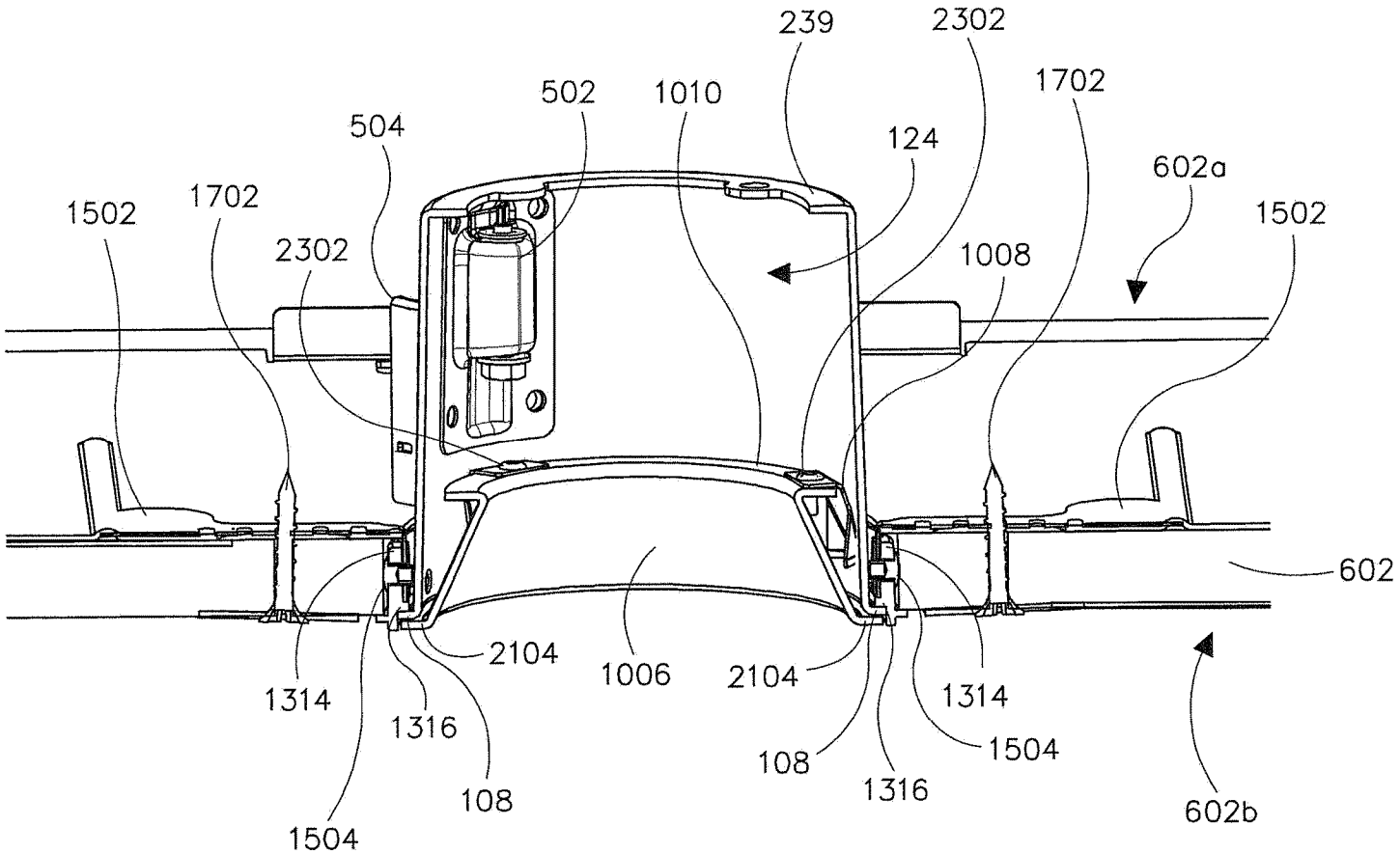
FIG. 23 illustrates an example cross-section view of the recessed luminaire with the second example rimmed housing can installed in the ceiling fitted with the lathing ring and the second example finishing section disposed in the second example rimmed housing can, in accordance with example embodiments of the present disclosure.

As illustrated in FIGS. 19-23, the width of both the rim 108 of the rimmed housing can 102 and the trim flange 2104 of the finishing section 1002 are configured such that they fit within the annular collar 1313 of the lathing ring 1300 to provide a flangeless appearance to the finishing section 1002, i.e., once plaster is applied to the bottom surface of the lathing ring 1300, e.g., on the outer flange 1301 and collar 1313 of the lathing ring 1300, and a portion of the trim flange 1004 as illustrated in FIG. 22B.

In certain example embodiments, the lathing ring 1300 may be fabricated using die cast aluminum. However, in other exemplary embodiments, any suitable material known to persons having ordinary skill in the art, such as sheet metal or a polymer material, is used to fabricate the lathing ring 1300. Further, in some example embodiments, the width of the rim 108 of the rimmed housing can 102 illustrated in FIGS. 19-23 may be smaller than the width of the rim 108 of the rimmed housing can 102 illustrated in FIGS. 1-11. In other example embodiments, the width of the rim 108 of the rimmed housing can 102 illustrated in FIGS. 19-23 may be substantially similar to the width of the rim 108 of the rimmed housing can 102 illustrated in FIGS. 1-11.

Even though the example embodiments of FIGS. 1-23 illustrate recessed luminaires that have a rimmed housing can 102, one of ordinary skill in the art can understand and appreciate that in other example embodiments, any other appropriate housing cans may be used without departing from the broader scope of the present disclosure. For example, the recessed luminaires may have a rimless housing can, i.e., a housing can without the integral rim 108 as illustrated in FIGS. 24-38. The installation of a recessed luminaire with a rimless housing can will be described in greater detail below in association with FIGS. 24-38.

Recessed Luminaire with a Rimless Housing can and Flange Clips

Figure 24:
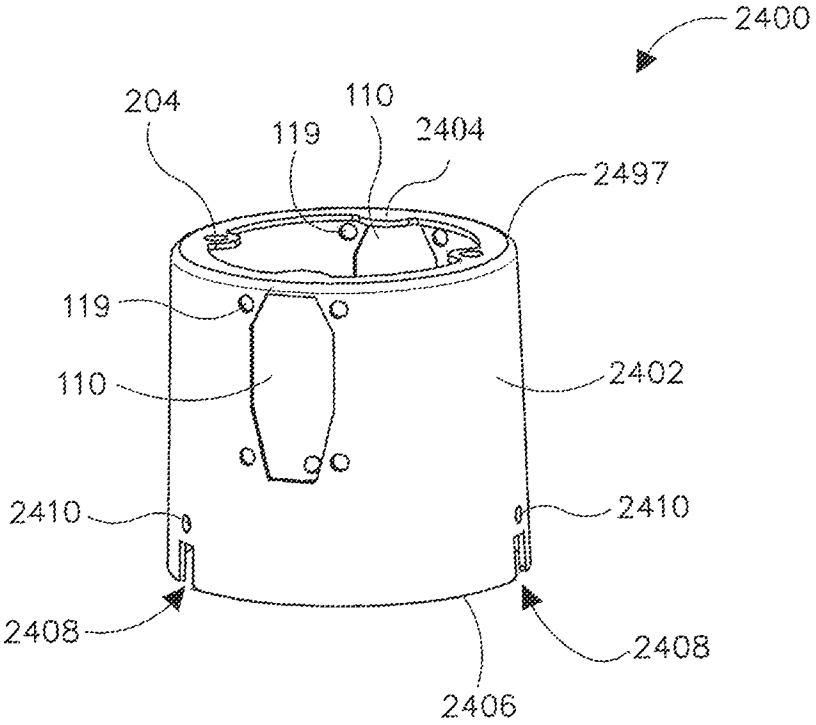
FIG. 24 illustrates a perspective view of an example rimless housing can, in accordance with example embodiments of the present disclosure.
Figure 26:
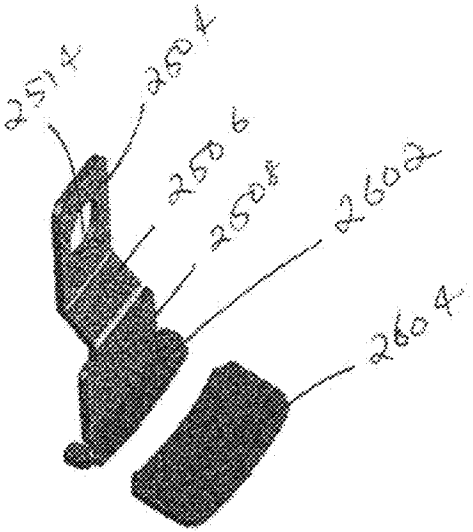
FIG. 26 illustrates a perspective view of the example flange clip of FIG. 25 with the detachable portion being removed for a rimless installation with the lathing ring, in accordance with example embodiments of the present disclosure.
Figure 25:
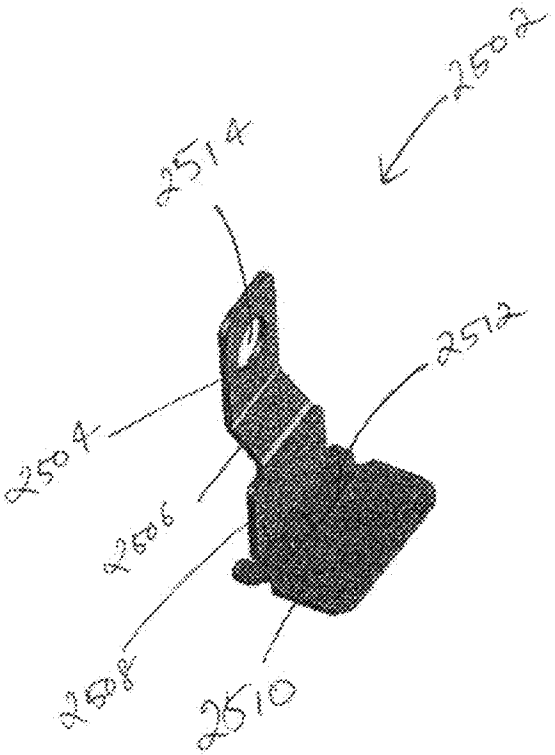
FIG. 25 illustrates a perspective view of an example flange clip that has a detachable portion, in accordance with example embodiments of the present disclosure.
Figure 27:
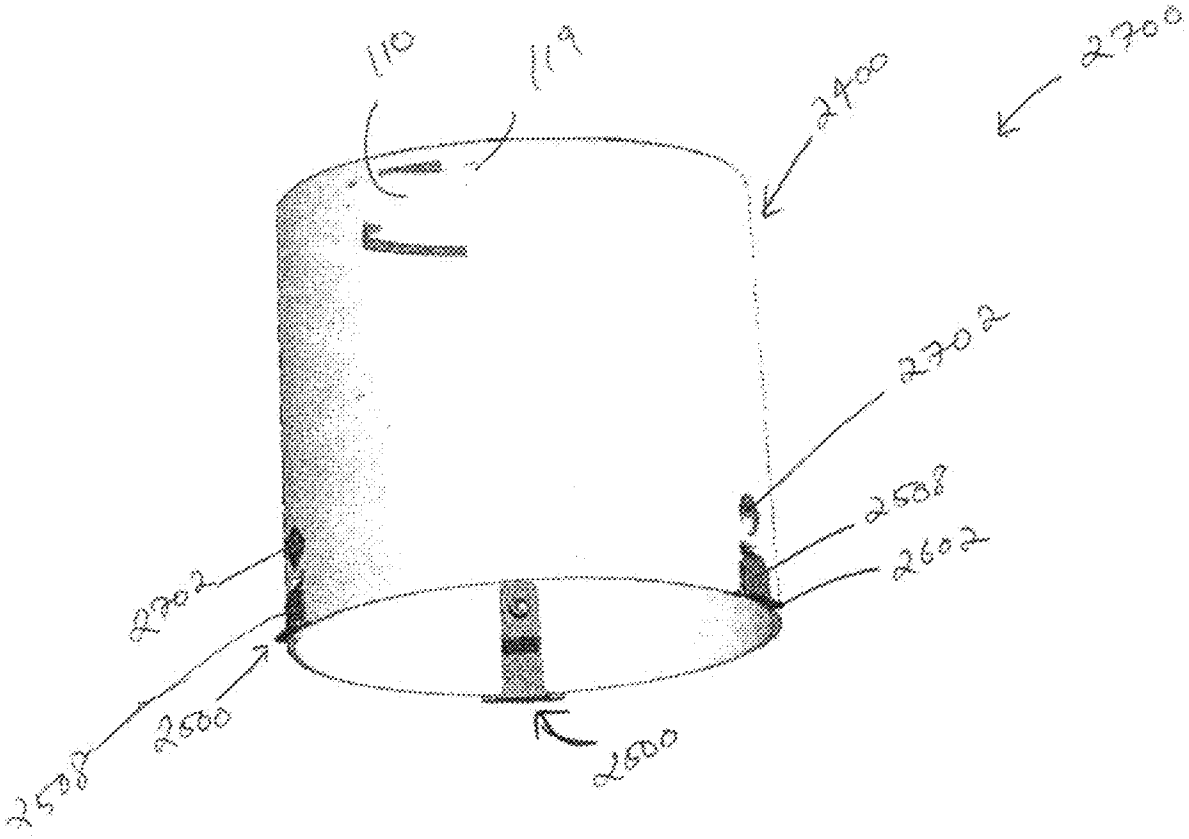
FIG. 27 illustrates a perspective view of a third example housing assembly with the example rimless housing can and example flange clips coupled thereto, in accordance with example embodiments of the present disclosure.
Figure 29:
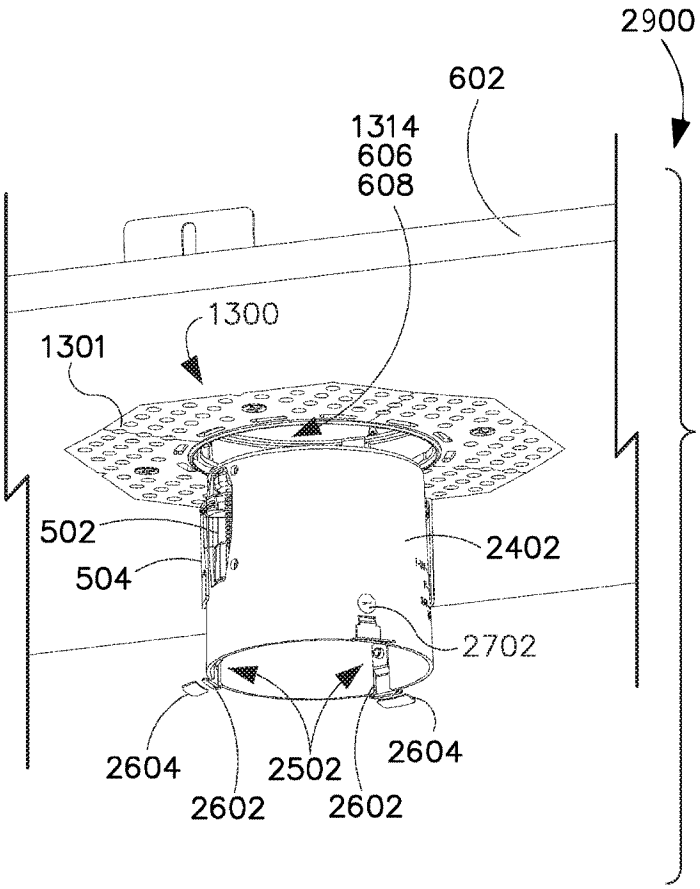
FIGS. 28-32 illustrate how the third example housing assembly is installed in a ceiling fitted with a lathing ring, in accordance with example embodiments of the present disclosure.
Figure 28:
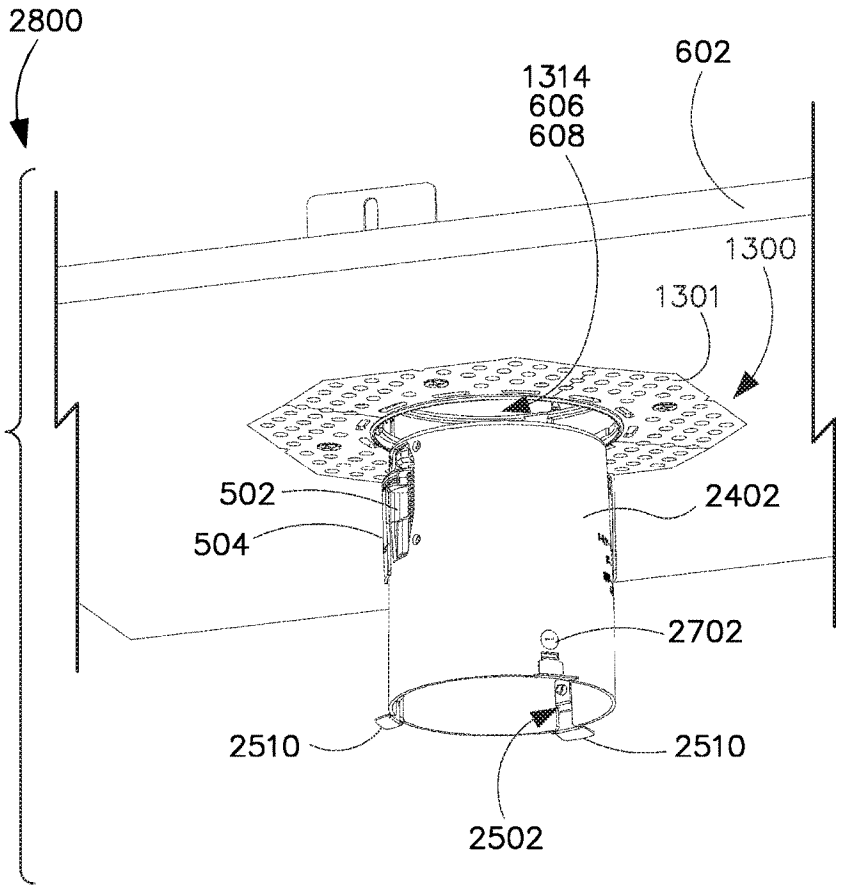
Figure 31:
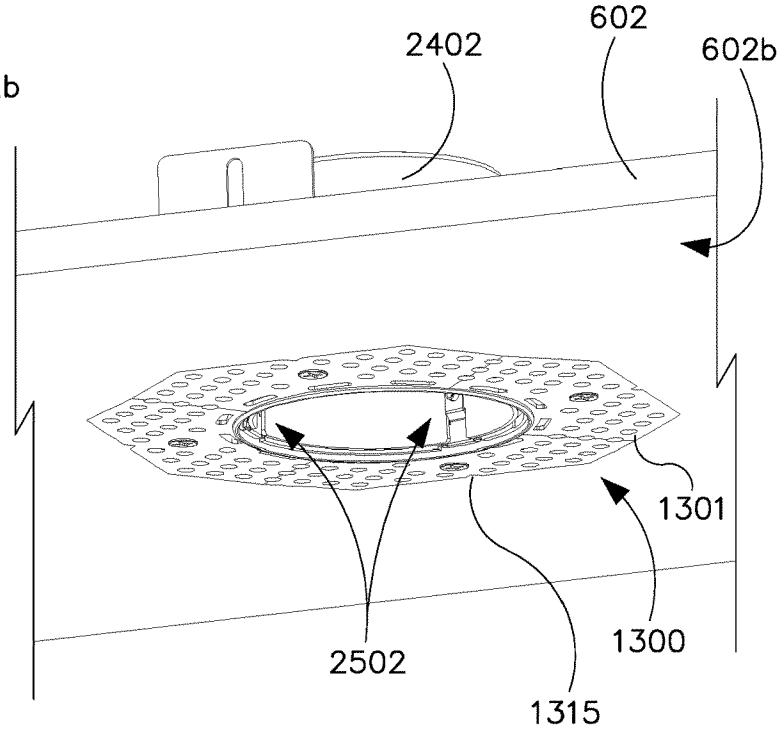
Figure 30:
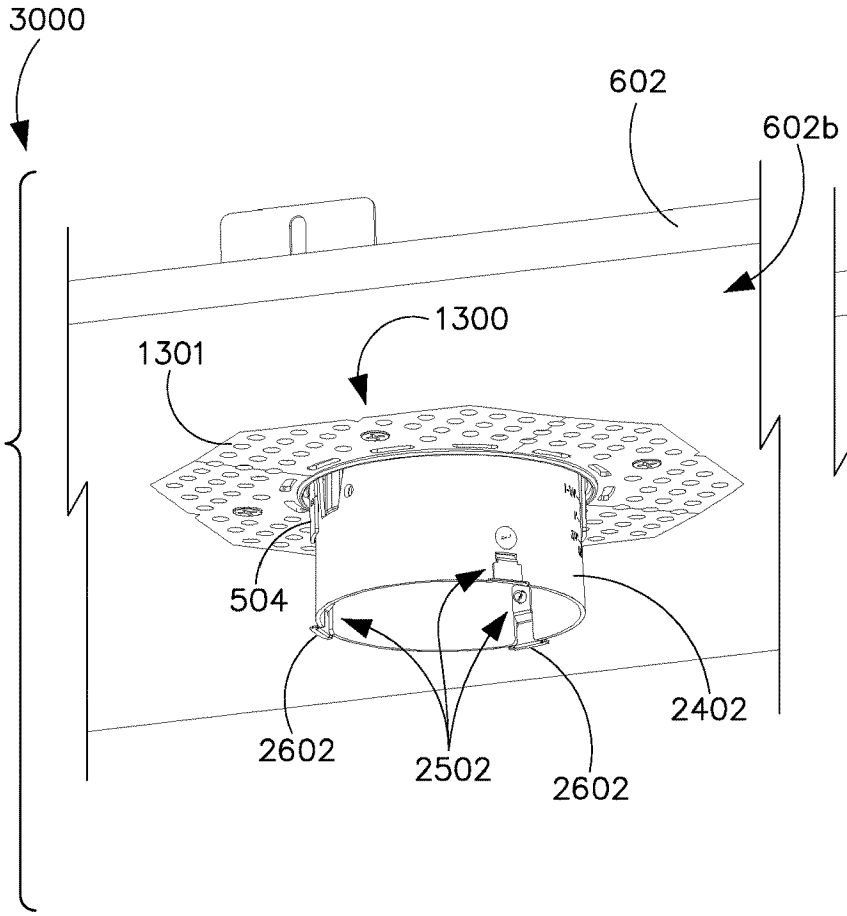
Figure 32:
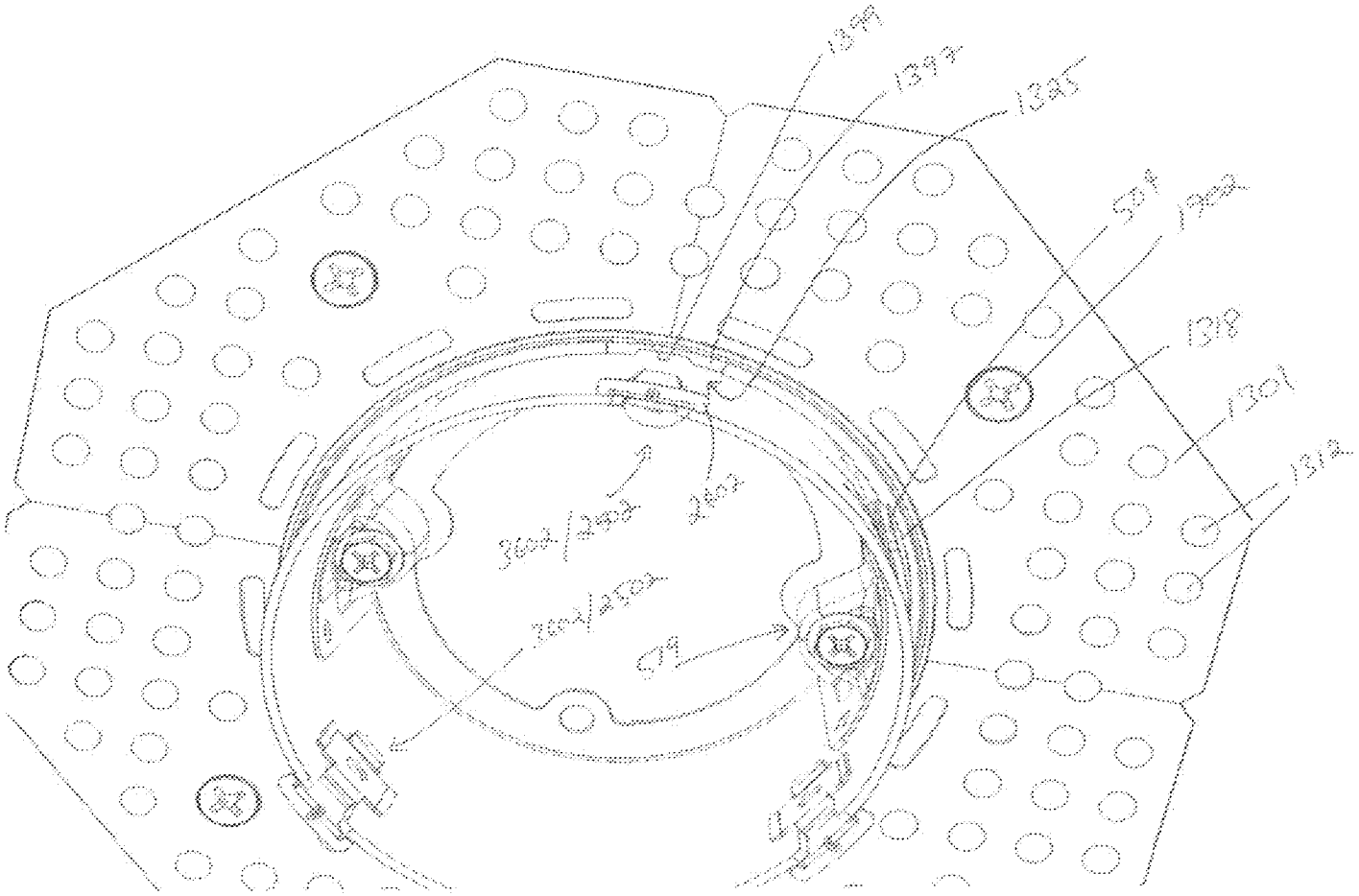
Figure 34:
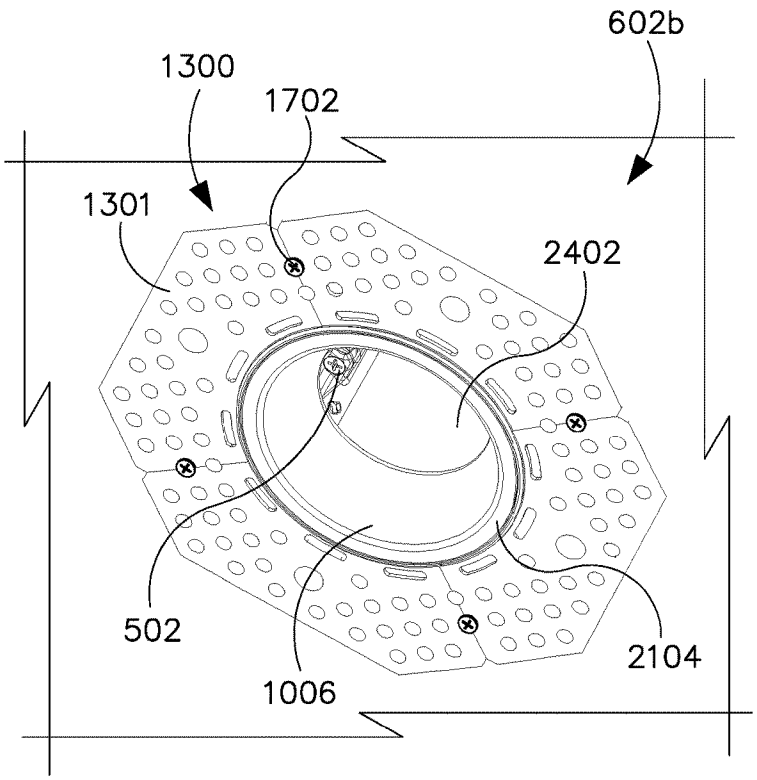
FIG. 33-34 illustrate an installation of the second example finishing section in the third example housing assembly of the recessed luminaire which in turn is installed in the ceiling fitted with the lathing ring, in accordance with example embodiments of the present disclosure.
Figure 33:
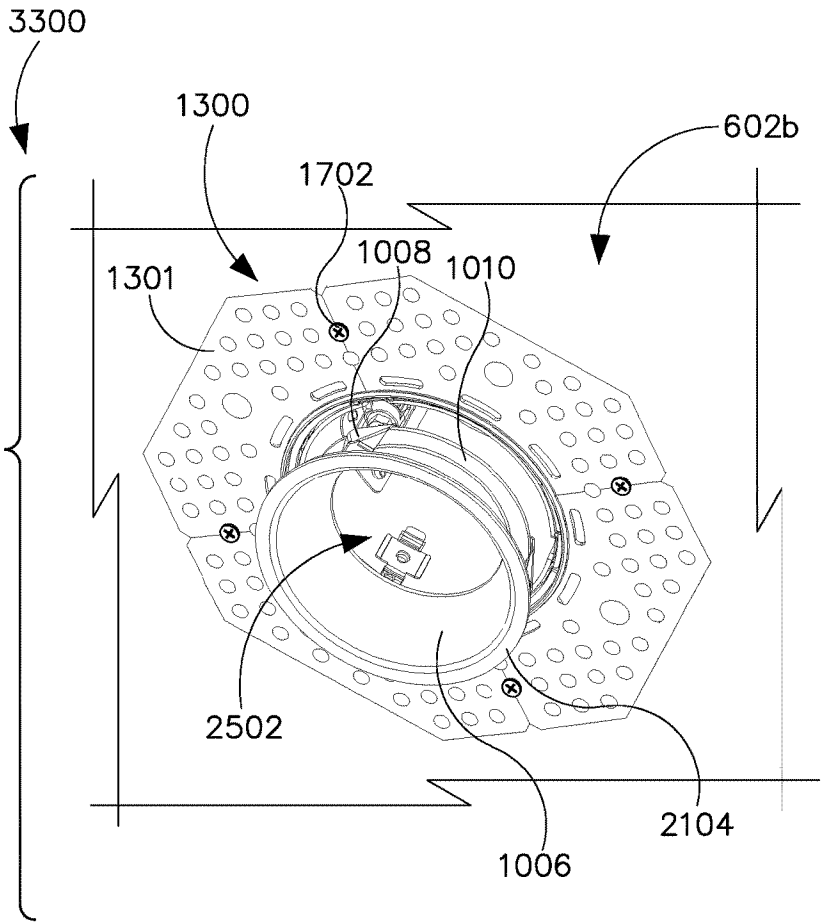
Figure 35:
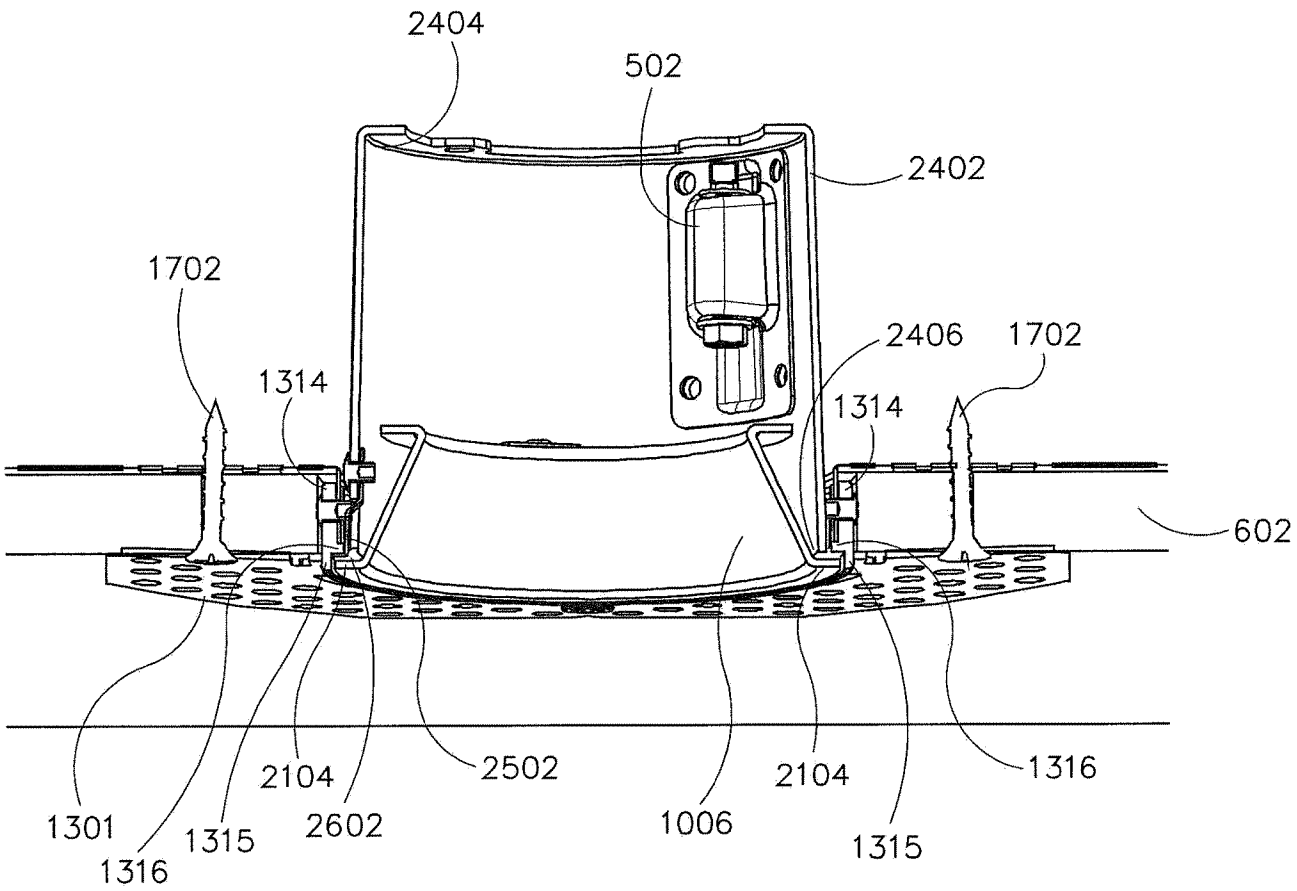
FIG. 35 illustrates an example cross-section view of the recessed luminaire with the third example housing assembly installed in the ceiling fitted with the lathing ring and the second example finishing section disposed in the example rimless housing can of the third example housing assembly, in accordance with example embodiments of the present disclosure.
Figure 36:
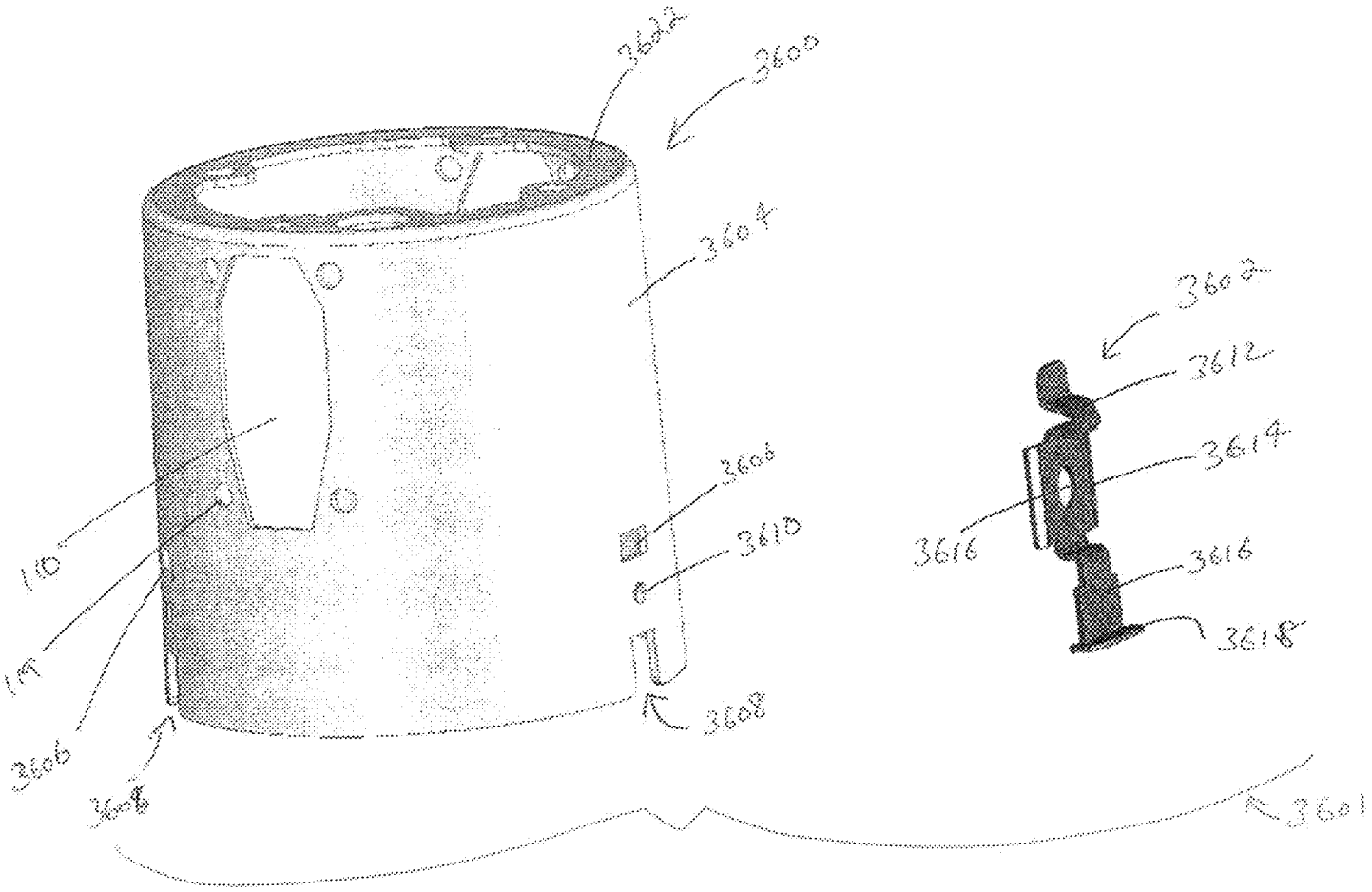
FIG. 36 illustrates a perspective view of the example rimless housing can and a snap fit flange clip of a fourth example housing assembly of a recessed luminaire, in accordance with example embodiments of the present disclosure.
Figure 37:
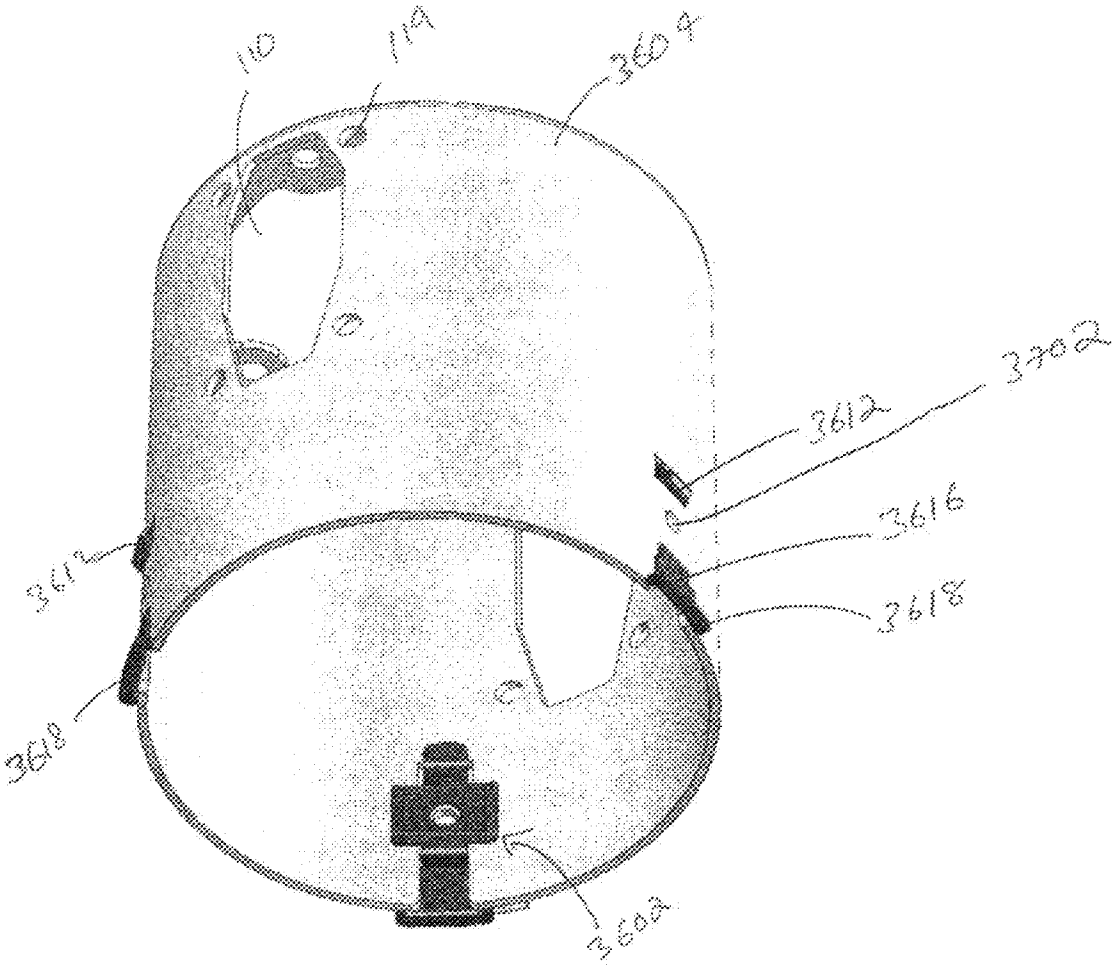
FIG. 37 illustrates a perspective view of the fourth example housing assembly of the recessed luminaire, in accordance with example embodiments of the present disclosure.
Figure 38:
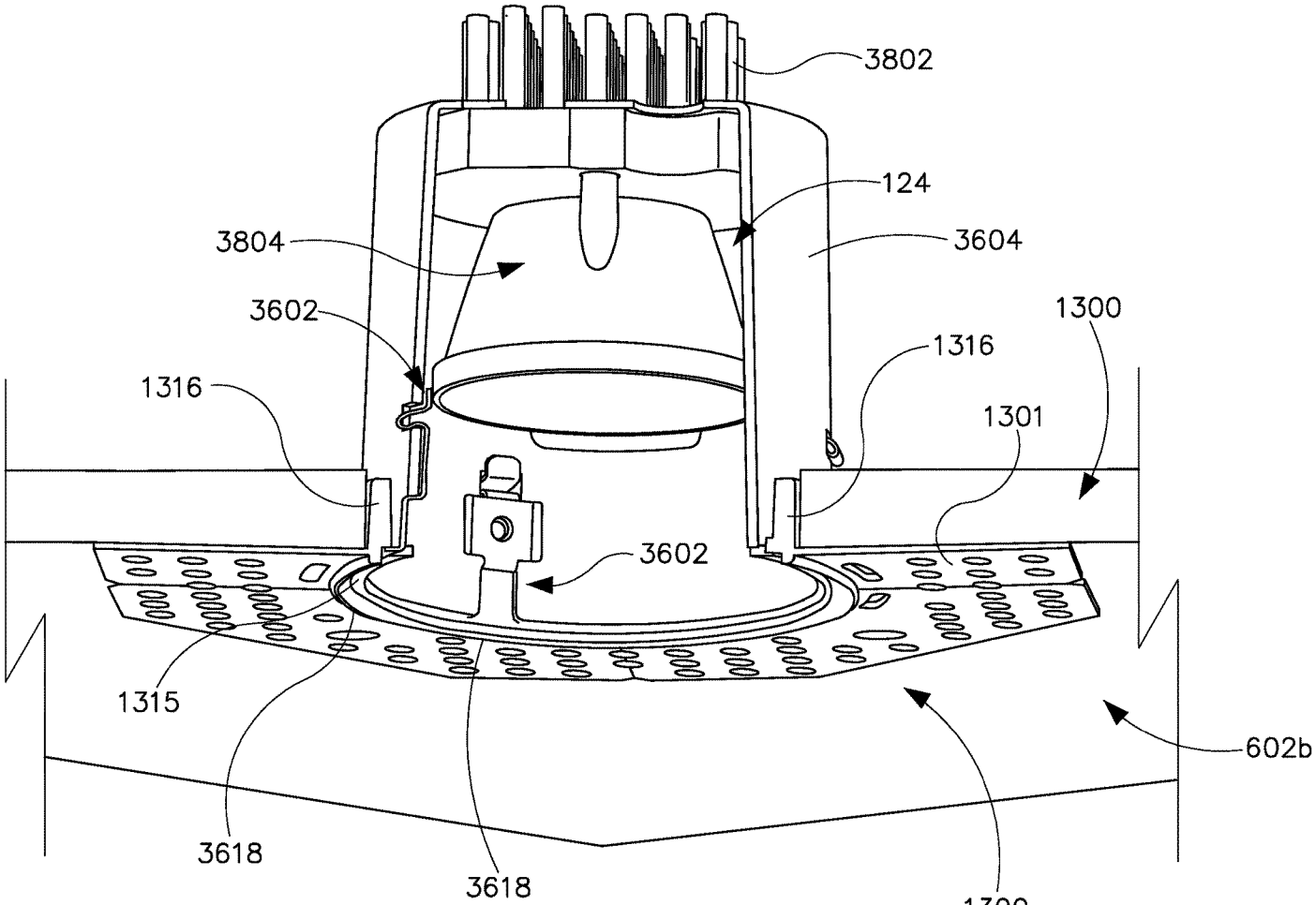
FIG. 38 illustrates an example cross-section view of the recessed luminaire with the fourth example housing assembly installed in the ceiling fitted with the lathing ring and the second example finishing section disposed in the example rimless housing can of the fourth example housing assembly, in accordance with example embodiments of the present disclosure.

FIG. 24 illustrates a perspective view of an example rimless housing can, in accordance with example embodiments of the present disclosure; FIG. 25 illustrates a perspective view of an example flange clip that has a detachable portion, in accordance with example embodiments of the present disclosure; FIG. 26 illustrates a perspective view of the example flange clip of FIG. 25 with the detachable portion being removed, in accordance with example embodiments of the present disclosure; FIG. 27 illustrates a perspective view of a third example housing assembly with the example rimless housing can and example flange clips coupled thereto, in accordance with example embodiments of the present disclosure; FIGS. 28-32 illustrate how the third example housing assembly is installed in a ceiling fitted with a lathing ring, in accordance with example embodiments of the present disclosure; FIG. 33-34 illustrate an installation of the second example finishing section in the third example housing assembly of the recessed luminaire which in turn is installed in the ceiling fitted with the lathing ring, in accordance with example embodiments of the present disclosure; FIG. 35 illustrates an example cross-section view of the recessed luminaire with the third example housing assembly installed in the ceiling fitted with the lathing ring and the second example finishing section disposed in the example rimless housing can of the third example housing assembly, in accordance with example embodiments of the present disclosure; FIG. 36 illustrates a perspective view of the example rimless housing can and a snap fit flange clip of a fourth example housing assembly of a recessed luminaire, in accordance with example embodiments of the present disclosure; FIG. 37 illustrates a perspective view of the fourth example housing assembly of the recessed luminaire, in accordance with example embodiments of the present disclosure; and FIG. 38 illustrates an example cross-section view of the recessed luminaire with the fourth example housing assembly installed in the ceiling fitted with the lathing ring and the second example finishing section disposed in the example rimless housing can of the fourth example housing assembly, in accordance with example embodiments of the present disclosure.

Referring to FIGS. 24-35, the housing assembly 2700 of the recessed luminaire may include a rimless housing can 2400 and one or more one or more flange clips 2502. As in the rimmed housing can 102, the rimless housing can 2400 may include a substantially cylindrical side wall 2402 that extends from the top annular edge 2497 to the bottom annular edge 2406 and defines a cavity 124. Further, as in the rimmed housing can 2402, the side wall 106 of the rimless housing can 2400 may include one or more mounting assembly openings 110 to receive a respective mounting assembly, such as the pawl assembly 519. The side wall 2402 of the rimless housing can 2400 may also include one or more coupling apertures 119 that are disposed around each mounting assembly opening 110 for coupling the pawl assembly 519 to the rimless housing can 2400 using appropriate fasteners, such as screws, rivets, etc. Furthermore, the rimless housing can 2400 may include one or more flange notches 2408 that are formed in the side wall 2402 at the bottom annular edge 2406 of the rimless housing can 2400. Additionally, the side wall 2402 of the rimless housing can 2400 may include a flange aperture 2410 that is disposed above and adjacent each flange notch 2408.

Similar to rimmed housing can 102, the rimless housing can 2400 may include a top surface 2404 that extends radially inward from a top edge 2497 of the side wall 106 towards the cavity 124. The top surface 2404 may define a heat sink opening 202 to receive a heat sink assembly 3802 (shown in FIG. 38) therethough. The heat sink assembly 3802 may be configured to transfer heat away from the light module 3804 that is disposed in the cavity 124 formed by the side wall 106 of the rimless housing can 2400 and coupled to the heat sink assembly 3802. The heat sink assembly 3802 and/or the light module 3804 may be coupled adjacent the top surface 2404 of the rimless housing can 2400 using fasteners that are passed through the coupling apertures 204 disposed on the top surface 2404 of the rimless housing can 2400.

In other words, the rimless housing can 2400 may be substantially similar to the rimmed housing can 102 of FIGS. 1-23 except that the rimless housing can 2400 does not include a rim 108 as in the rimmed housing can 102. Instead, the rimless housing can 2400 includes flange notches 2408 and flange apertures 2410 that are configured to removably couple one or more flange clips 2502 to the rimless housing can 2400.

As illustrated in FIGS. 25-26, a flange clip 2502 may include an angled middle portion 2501, a coupling portion 2504 disposed on one end of the angled middle portion 2501, and a flange 2510 disposed on the opposite end of the angled middle portion 2501. The angled middle portion 2501 may include a first leg 2506 and a second leg 2508 that are arranged such that they define an obtuse angle. The coupling portion 2504 disposed adjacent the first leg 2506 may include a coupling aperture 2514. Further, the flange 2510 disposed adjacent the second leg 2508 of the angled middle portion 2501 may include a perforation 2512 formed therein that allows a portion 2604 of the flange 2510 to be detached from the flange clip 2502. An installer may detach the portion 2604 of the flange 2510 when a flange clip with a narrower flange 2602 is required.

Even though FIGS. 25-26 illustrate a single flange clip 2502 having a wide flange 2510 with perforations 2512 that allow a portion of the wide flange 2510 to be detached along the perforations 2512 for reducing the width of the flange (narrow flange 2602), one of ordinary skill in the art can understand and appreciate that in other example embodiments, two separate flange clips, one having a wide flange and other having a narrow flange, may be provided without departing from a broader scope of the present disclosure.

Referring to FIG. 27, the flange clips 2502 may be removably coupled to the rimless housing can 2400 using fasteners 2702, such as rivets, screws, etc. In particular, to removably couple a flange clip 2502 to the rimless housing can 2400, the flange clip 2502 may be positioned such that: (a) the coupling portion 2504 of the flange clip 2502 engages the inner surface of the rimless housing can's side wall 2402, (b) the coupling aperture 2514 in the coupling portion 2504 of the flange clip 2502 is aligned with the flange aperture 2410 of the rimless housing can's side wall 2402, (c) the angled middle portion 2501 of the flange clip 2502 extends out from the side wall 2402 of the rimless housing can 2400 through the corresponding flange notch 2408 on the side wall 2402 of rimless housing can 2400, and (d) the flange 2510 of the flange clip 2502 is flush with and extends radially out from the bottom annular edge 2406 of the rimless housing can 2400. Then, a fastener 2702 may be passed through the aligned coupling aperture 2514 and flange aperture 2410 of the flange clip 2502 and the rimless housing can 2402, respectively, to form the housing assembly 2700. Similarly, other flange clips 2502 may be removably coupled to the rimless housing can 2400 as illustrated in FIG. 27.

As illustrated in FIGS. 28-32, once the housing assembly 2700 is configured, the housing assembly 2700 may be installed in a ceiling 602 fitted with a lathing ring 1300. The lathing ring 1300 and the installation of the lathing ring 1300 in the ceiling 602 have been described above in greater detail in association with FIGS. 13-18 and will not be repeated herein for sake of brevity. To install the housing assembly 2700 in the ceiling 602 that is fitted with the lathing ring 1300, initially, a portion 2604 of the flange 2510 may be detached from each flange clip 2502. Then, the housing assembly 2700 with the pawl assemblies 519 may be positioned below the ceiling 602 fitted with the lathing ring 1300 such that: (a) the rimless housing can 2400 is axially aligned with the aperture 606 defined by the ceiling 602, the opening 608 of the plaster ground plate 604, and the opening 1319 defined by the lathing ring 1300 that is installed in the ceiling 602; (b) the pawls 504 that are coupled to the rimless housing can 2402 are aligned with the first set of notches 1318 formed in the inner flange 1316 of the lathing ring 1300; and (c) the flanges 2602 of the flange clips 2502 that are coupled to the rimless housing can 2402 are aligned with the second set of notches 1325 formed in the inner flange 1316 of the lathing ring 1300. As illustrated in FIG. 14, each of the second set of notches 1325 may include: (a) a flange receiving notch 1397 that is formed on a bottom surface of the inner flange 1316 of the lathing ring 1300, and (b) a pass through notch 1399 that is formed in the flange receiving notch 1397. The pass through notch 1399 may be deeper than the flange receiving notch 1397 and may extend from the flange receiving notch 1397 to a top surface of the lathing ring's inner flange 1316.

Once the housing assembly 2700 is positioned below the ceiling 602 fitted with the lathing ring 1300 as described above, the rimless housing can 2400 may be pushed up towards the ceiling 602 such that: (a) the side wall 2402 of the rimless housing can 2400 passes through the aperture 606 and openings (608, 1319) defined by the ceiling 602, the plaster ground plate 604, and the lathing ring 1300, respectively; (b) the pawls 504 coupled to the rimless housing can 2400 passes through the first set of notches 1318 formed in the in the inner flange 1316 of the lathing ring 1300; (c) a portion of the fasteners 2702 that project out from the side wall 2402 of the rimless housing can 2400 (e.g., screw head) passes through the respective pass through notches 1399 of the second set of notches 1325; and (d) the flange 2602 of the flange clips 2502 are received in the respective flange receiving notches 1397 of the second set of notches 1325 in the lathing ring 1300, as illustrated in FIG. 32. An installer may continue pushing the housing assembly 2400 through the aperture 606 and openings (608, 1319) defined by the ceiling 602, the plaster ground plate 604, and the lathing ring 1300, respectively, till the flanges 2602 of the flange clips 2502 that are coupled the rimless housing can 102 engage and are impeded by the inner flange 1316 of the lathing ring 1300. Responsively, the pawls 504 of the pawl assemblies 519 coupled to the rimless housing can 2400 may be adjusted such that the pawls 504 engage the top surface 602*a* of the ceiling 602 (or plaster ground plate) and clamps the ceiling 602 between the pawls 504 and the outer flange 1301 of the lathing ring 1300.

After installing the housing assembly 2700 in the ceiling 602 that is fitted with the lathing ring 1300, as illustrated in FIGS. 33-35, the finishing section 1002 may be coupled to the rimless housing can 2400 by inserting the finishing section 1002 in the cavity 124 defined by the rimless housing can 102 till the trim flange 2104 of the finishing section 1002 engages a bottom surface of the flanges 2602 of the flange clips 2502 that are coupled to the rimless housing can 2400. The finishing section 1002 may be retained in the rimless housing can 2400 by friction using friction clips 1008 that engage the inner surface of the rimmed housing can's side wall 106 as illustrated in FIGS. 33 and 35. The friction clips 1008 may be coupled to the top collar 1010 of the finishing section 1002 that extends radially outward from a top annular edge of a body 1006 of the finishing section 1002.

Even though FIGS. 24-35 illustrate flange clips 2502 that are coupled to the rimless housing can 2400 using fasteners 2702, one of ordinary skill in the art can understand and appreciate that in other example embodiments, flange clips that can be coupled to the housing can using any other appropriate coupling mechanism are within the broader scope of the present disclosure. For example, FIGS. 36-38 illustrate flange clips 3602 that use a snap mechanism for coupling to the rimless housing can.

Referring to FIGS. 36-38, the rimless housing can 3600 illustrated in FIGS. 36-38 may be substantially similar to the rimless housing can 2400 illustrated in FIGS. 24-35 except that the rimless housing can 3600 illustrated in FIGS. 36-38 may have snap slots 3606 in addition to the to the flange notch 3608 and the flange aperture 3610. Accordingly, the description of the rimless housing can will not be repeated herein for the sake of brevity. The snap slots 3606, the flange notches 3608, and the flange apertures 3610 of the rimless housing can 3600 may be configured to couple one or more snap fit flange clips 3602 to the rimless housing can 3600. In particular, each snap fit flange clip 3602 may include a middle portion 3616 comprising a hole 3614, a snap portion 3622 that comprises a snap feature 3612 disposed on one end of the middle portion 3616, and a feet portion 3619 comprising a flange 3618 disposed on an opposite end of the middle portion 3616.

As illustrated in FIGS. 37 and 38, the snap fit flange clips 3602 may be coupled to the rimless housing can 3600 by snap fit mechanism. In particular, to couple a snap fit flange clip 3602 to the rimless housing can 3600, the snap feature 3612 of the snap fit flange clip 3602 may be snapped into the snap slot 3606 of the rimless housing can 3600 such that: (a) a portion of the snap feature 3612 protrudes out from the side wall 3604 of the rimless housing can 3600 through the snap slot 3606 of the rimless housing can 3600, (b) the middle portion 3616 of the snap fit flange clip 3602 engages the inner surface of the rimless housing can's side wall 3604, (c) the hole 3614 of the middle portion 3616 of the snap fit flange clip 3602 is aligned with the flange aperture 3610 of the rimless housing can 3600, (d) the feet portion 3619 of the snap fit flange clip 3602 extends out from the side wall 3604 of the rimless housing can 3600 through the corresponding flange notch 3608 on the side wall 3604 of rimless housing can 3600, and (e) the flange 3618 of the snap fit flange clip 3602 is flush with and extends radially out from the bottom annular edge of the rimless housing can 3600. Similarly, other snap fit flange clips 3602 may be snapped to the rimless housing can 2400 as illustrated in FIG. 37.

The hole 3614 in the middle portion 3616 of the snap fit flange clip 3602 that is aligned with the flange aperture 3610 of the rimless housing can 3600 during installation may be provided as an alternate or additional coupling mechanism for coupling the snap fit flange clip 3602 to the rimless housing can 3600 using fasteners. Accordingly, in some example embodiments, the middle portion 3616 of the snap fit flange clip 3602 may not include the hole 3614.

The installation of the rimless housing can 3600 fitted with the snap fit flange clips 3602 in the ceiling 602, and the installation of the finishing section 1002 in the rimless housing can 3600 may be substantially similar to the installation of the rimless housing can 2400 fitted with the flange clips 2502 in the ceiling 602, and the installation of the finishing section 1002 in the rimless housing can 2400, respectively, which is described above in association with FIGS. 24-35. Accordingly, the description regarding the installation of the rimless housing can 3600 fitted with the snap fit flange clips 3602 in the ceiling 602, and the installation of the finishing section 1002 in the rimless housing can 3600 will not repeated herein for the sake of brevity.

Even though FIGS. 13-38 illustrate a lathing ring that is coupled to a ceiling using fold-over tabs, one of ordinary skill in the art can understand and appreciate that in other example embodiments, recessed luminaires with lathing rings that can be coupled to the housing instead of the ceiling may be used without departing from a broader scope of the present disclosure. For example, FIGS. 39-46 illustrate a snap fit lathing ring that can be coupled to a housing instead of the ceiling 602. The snap fit lathing ring can be used in new constructions and/or old constructions independent of the ceiling thickness. That is, the same snap fit lathing ring can be used in different ceiling installations despite the different thicknesses of the ceiling since the installation of the snap fit lathing ring is not dependent on the ceiling.

Recessed Luminaire with a Snap Fit Lathing Ring

Figure 39:
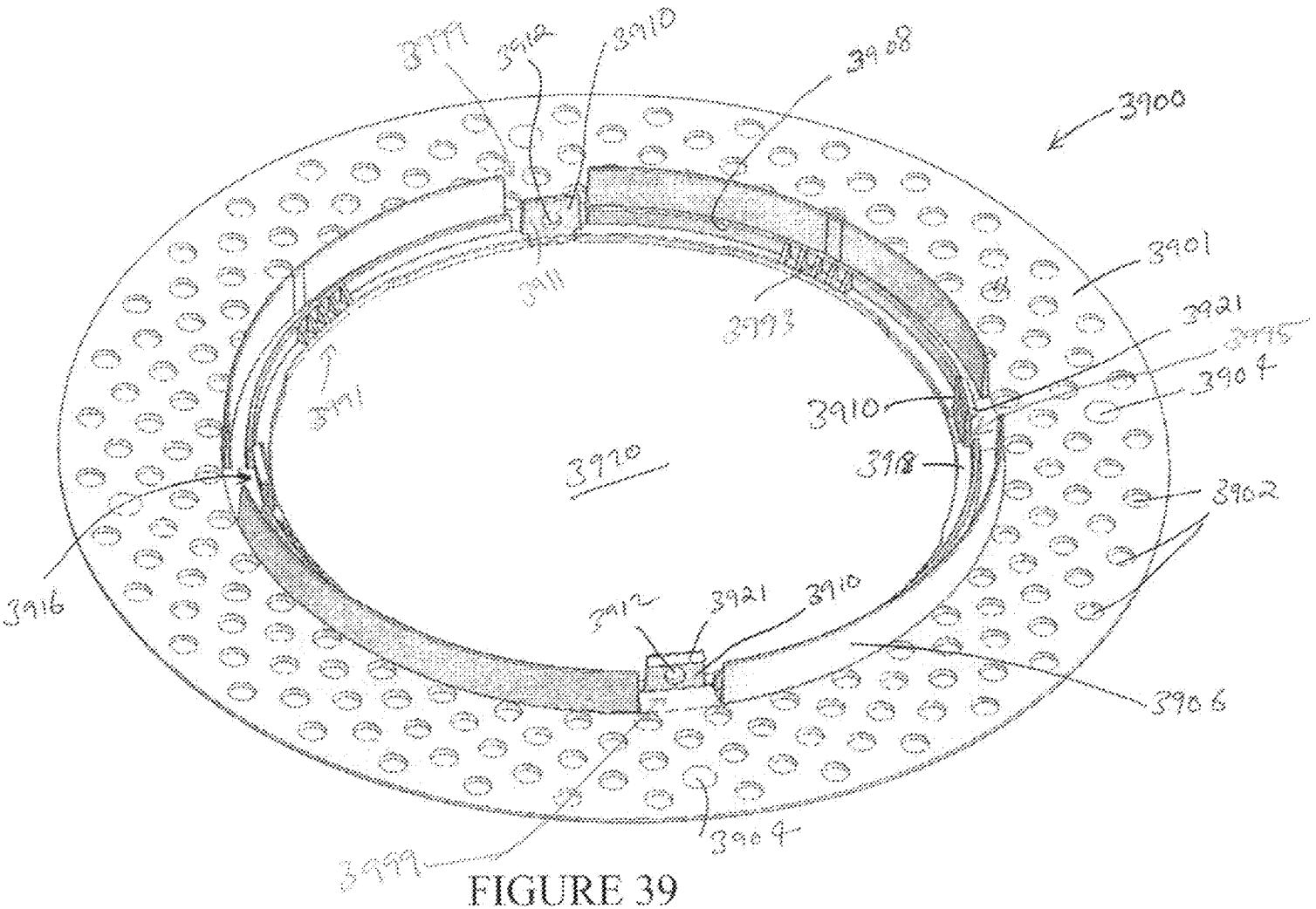
FIG. 39 illustrates a perspective view of an example snap fit lathing ring, in accordance with example embodiments of the present disclosure.
Figure 40:
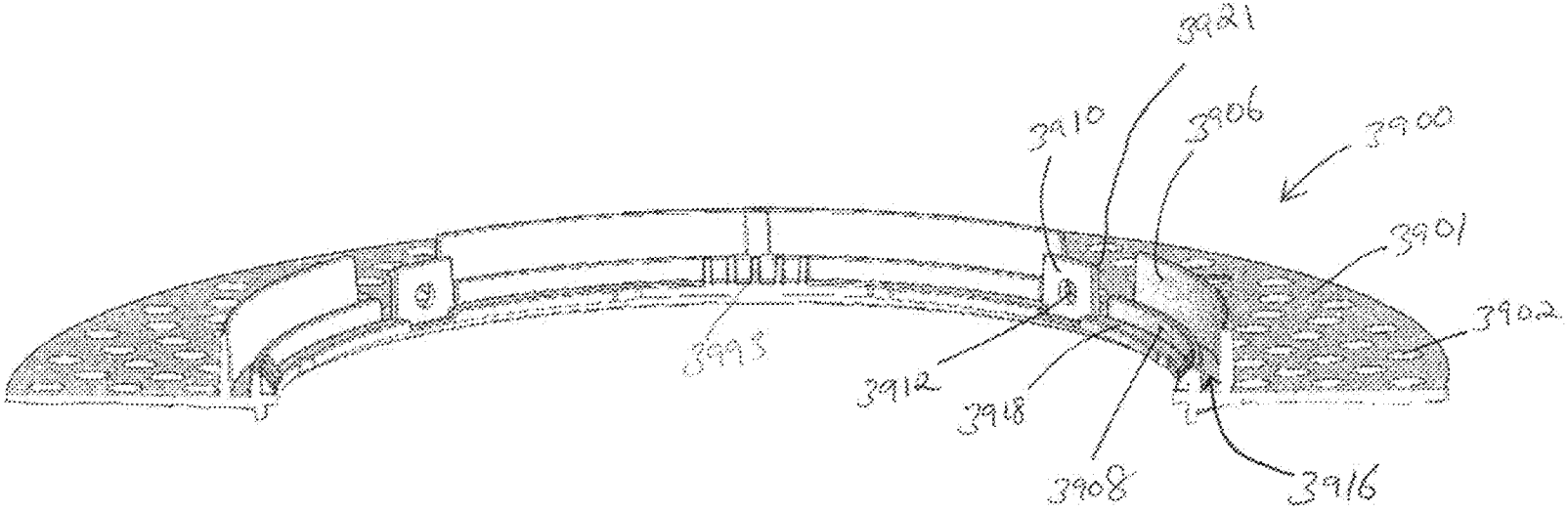
FIG. 40 illustrates a cross-section view of the example snap fit lathing ring of FIG. 39, in accordance with example embodiments of the present disclosure.
Figure 41:
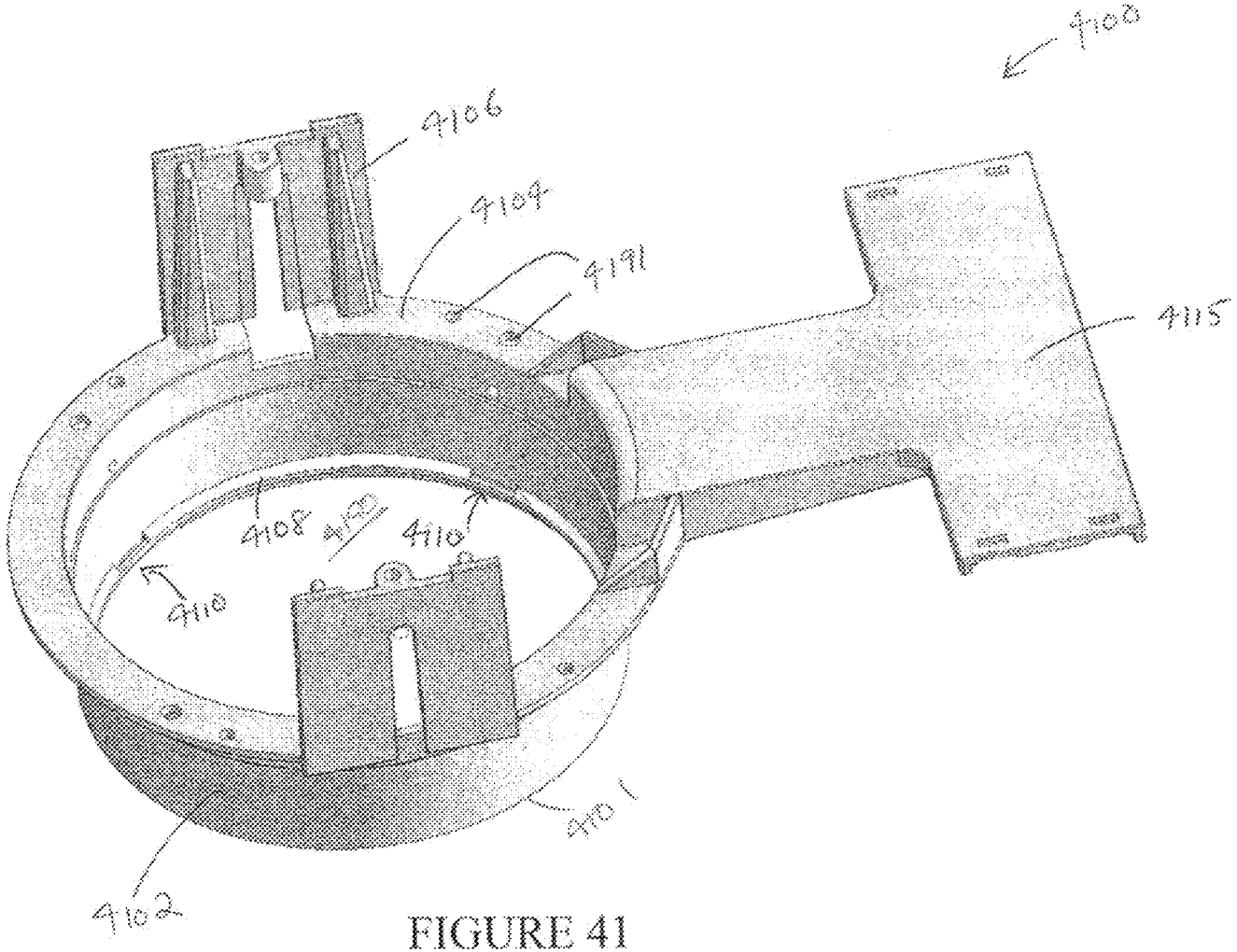
FIG. 41 illustrates a perspective view of a fifth example housing, in accordance with example embodiments of the present disclosure.
Figure 42:
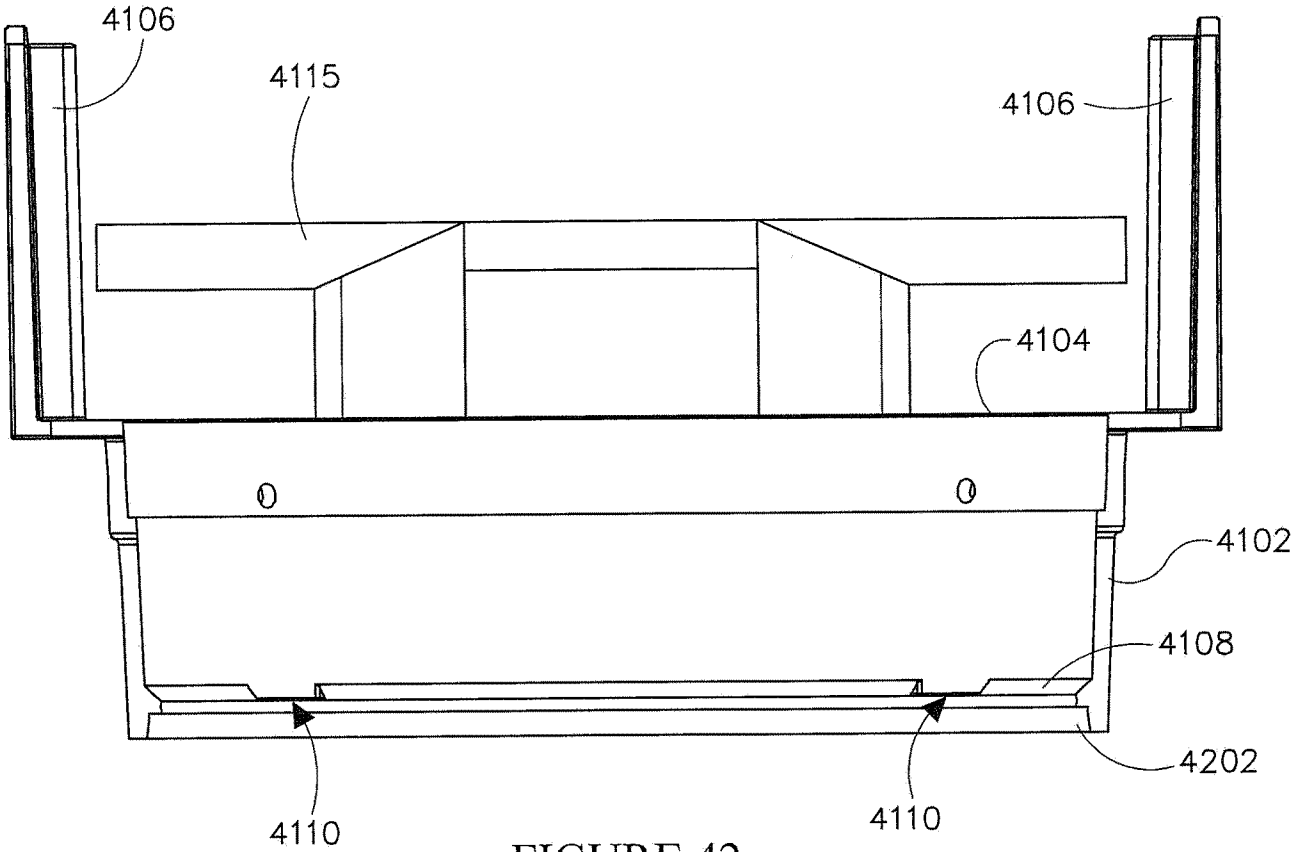
FIG. 42 illustrates a cross-section view of the fifth example housing of FIG. 41, in accordance with example embodiments of the present disclosure.
Figure 43:
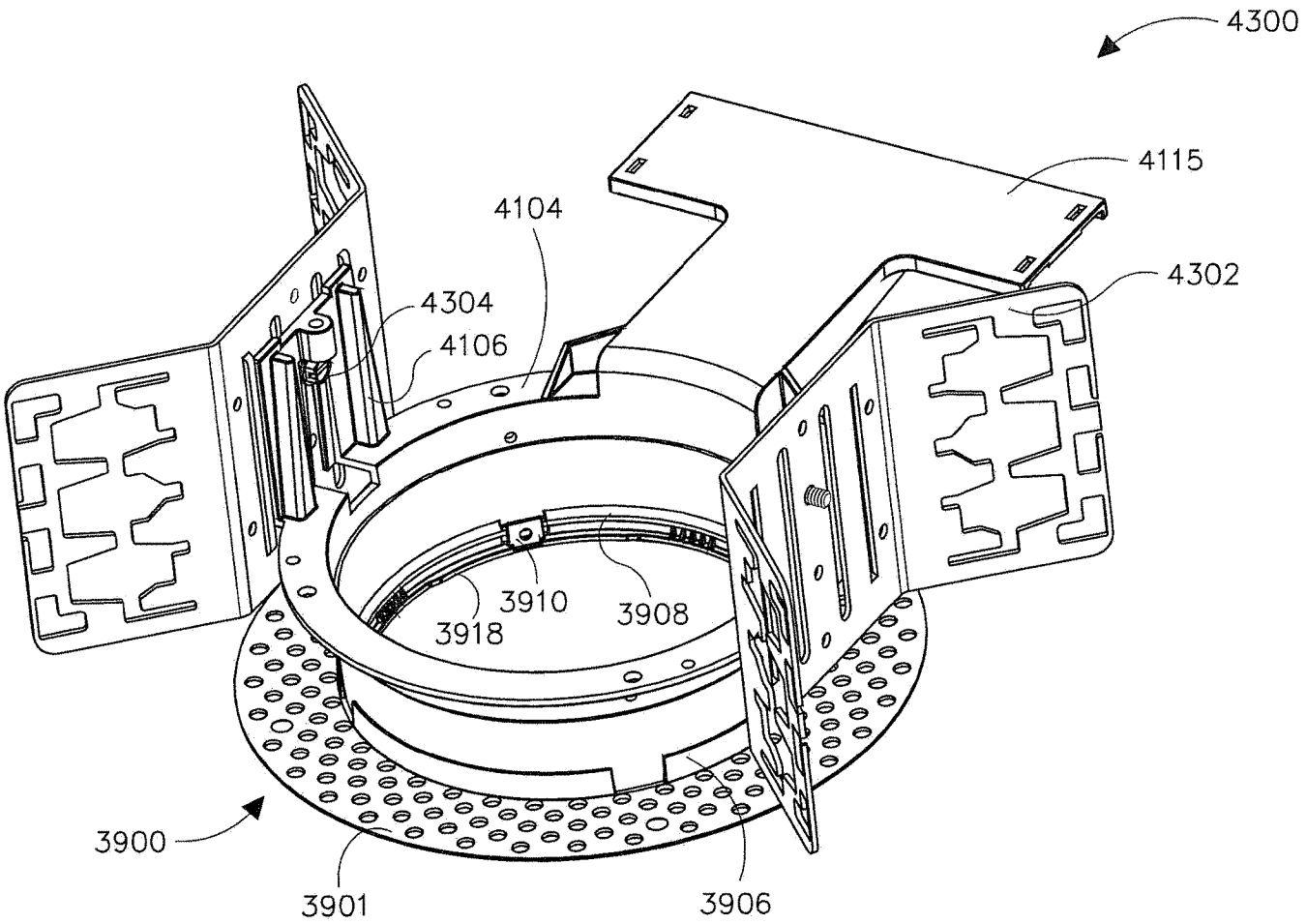
FIG. 43 illustrates a perspective view of the example snap fit lathing ring coupled to the fifth example housing, in accordance with example embodiments of the present disclosure.
Figure 44:
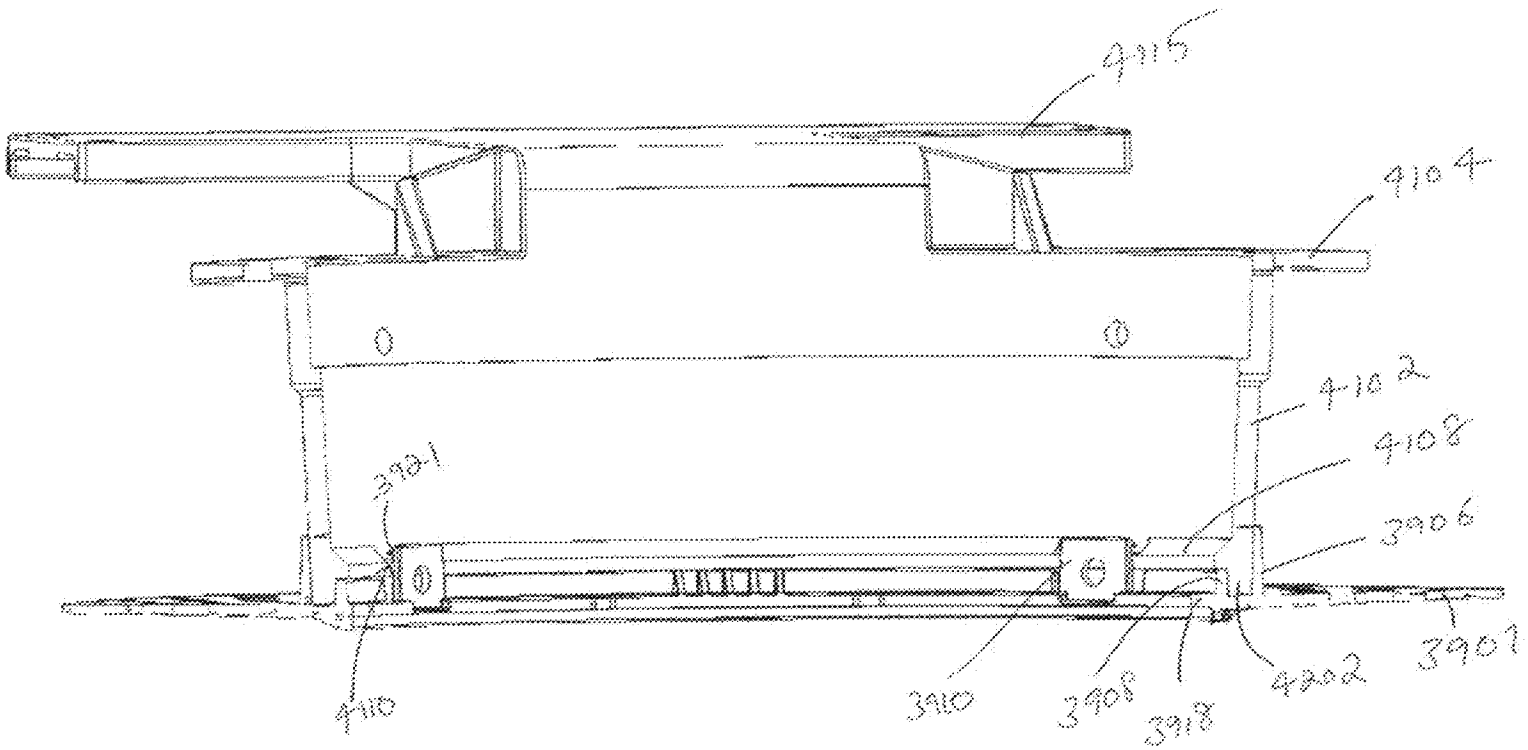
FIG. 44 illustrates a cross-section view of the housing-lathing ring assembly of FIG. 43, in accordance with example embodiments of the present disclosure.
Figure 45:
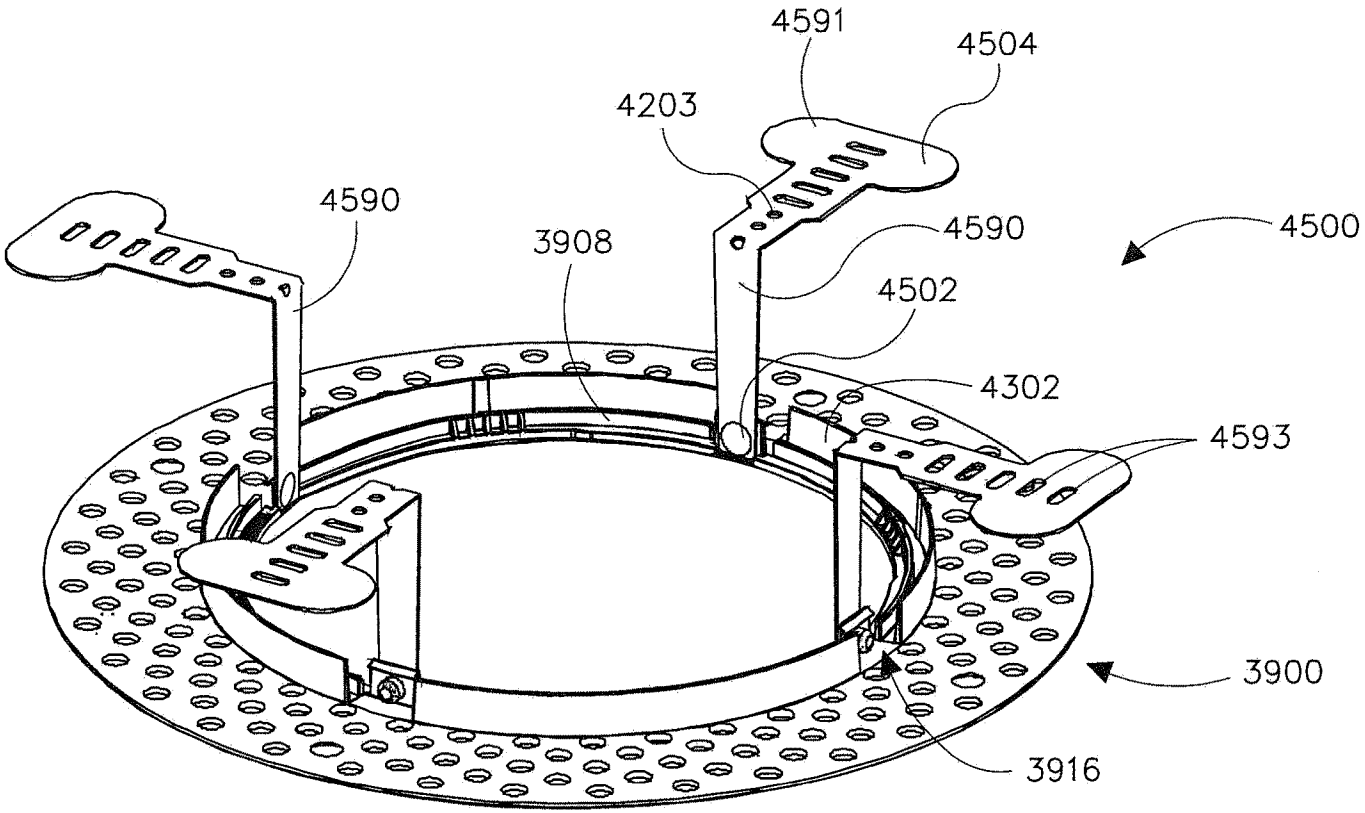
FIG. 45 illustrates the example snap fit lathing ring of FIG. 39 with fold-over tabs coupled thereto, in accordance with example embodiments of the present disclosure.
Figure 46:
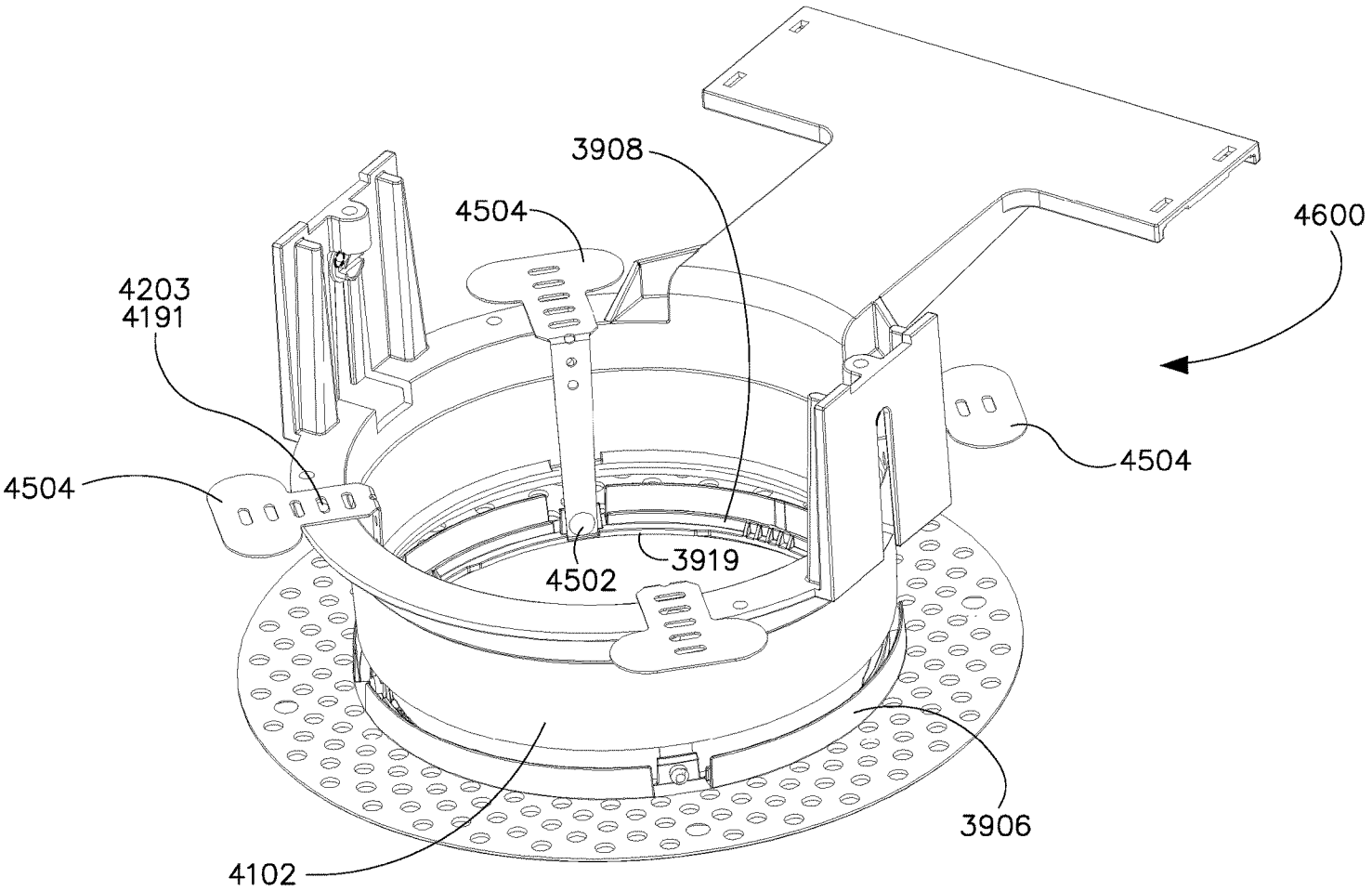
FIG. 46 illustrates a perspective view of the example snap fit lathing ring fitted with the fold-over tabs coupled to the fifth example housing, in accordance with example embodiments of the present disclosure.

FIG. 39 illustrates a perspective view of an example snap fit lathing ring, in accordance with example embodiments of the present disclosure; FIG. 40 illustrates a cross-section view of the example snap fit lathing ring of FIG. 39, in accordance with example embodiments of the present disclosure; FIG. 41 illustrates a perspective view of an fifth example housing, in accordance with example embodiments of the present disclosure; FIG. 42 illustrates a cross-section view of the fifth example housing of FIG. 41, in accordance with example embodiments of the present disclosure; FIG. 43 illustrates a perspective view of the example snap fit lathing ring coupled to the fifth example housing, in accordance with example embodiments of the present disclosure; FIG. 44 illustrates a cross-section view of the housing-lathing ring assembly of FIG. 43, in accordance with example embodiments of the present disclosure; FIG. 45 illustrates the example snap fit lathing ring of FIG. 39 with fold-over tabs coupled thereto, in accordance with example embodiments of the present disclosure; and FIG. 46 illustrates a perspective view of the example snap fit lathing ring fitted with the fold-over tabs coupled to the fifth example housing, in accordance with example embodiments of the present disclosure.

Referring to FIGS. 39-44, the snap fit lathing ring 3900 may include a substantially annular inner wall 3908 that defines an annular opening 3920 and a substantially annular outer wall 3906 that is disposed outside the inner wall 3908 and partially surrounds the inner wall 3908. Further, the inner wall 3908 and the outer wall 3906 may define an annular groove 3916 disposed there between. Both the inner wall 3908 and the outer wall 3906 may include multiple wall sections that are detached from each other by spaces 3995 and 3999, respectively. Furthermore, the snap fit lathing ring 3900 may include one or more snap tabs 3910 that are disposed in the spaces 3995 formed in between the different wall sections of the inner wall 3908. Each snap tab 3910 may include a planar portion 3911 that comprises a coupling aperture 3912, and an angled flange 3921 that extends towards the outer wall 3906 at an angle from the planar portion 3911. Further, the snap fit lathing ring 3900 may include an outer flange 3901 that extends radially outward from the outer wall 3906, and an inner flange 3918 that extends radially inward towards the opening 3920 from the inner wall 3908.

The outer flange 3901 of the snap fit lathing ring 3900 may include a plurality of perforated openings 3902 that are formed circumferentially around the outer flange 3901 and extend through the thickness of the outer flange 3901. The perforated openings 3902 facilitate plastering on the outer flange 3901 since these perforated openings 3902 provide an area for the plaster to adhere itself. Additionally, the outer flange 3901 may include one or more mounting holes 3904 formed around and through the outer flange 3901. The one or more mounting holes 3904 may be configured to receive fasteners (not shown) therethrough to couple the lathing ring 3900 to the housing 4100 using fold-over tabs 4504 (shown in FIGS. 45 and 46. Furthermore, the snap fit lathing ring 3900 may include one or more notches 3991 and ramped surfaces 3993 formed in the inner flange 3918.

As illustrated in FIGS. 41 and 42, the housing 4100 may include a substantially cylindrical side wall 4102 that defines a cavity 4190, an upper collar 4104 that extends radially outward from a top edge of the side wall 4102, one or more mounting arms 4106 extending from the upper collar 4104 for coupling mounting features, such as adjustable hanger brackets 4302 (shown in FIG. 43) to the housing 4100, and a support arm 4115 extending radially outward from the upper collar 4104. Further, the housing 4100 may include an inner flange 4108 that is disposed adjacent a bottom edge of the side wall 4012 and extends radially inward into the cavity 4190 from an inner surface of the side wall 4102. The inner flange 4108 may include notches 4110 formed therein to engage the snap tabs 3910 of the snap fit lathing ring 3900 to couple the snap fit lathing ring 3900 to the housing 4100 as will be described in greater detail below in association with FIGS. 43 and 44. The portion of the housing side wall 4102 that extends between the inner flange 4108 and the bottom edge 4101 of the housing side wall 4102 may be referred to as a lip 4202.

Referring to FIGS. 43 and 44, the snap fit lathing ring 3900 may be coupled to the housing 4100 by positioning the snap fit lathing ring 3900 below the housing 4100 such that the lip 4202 of the housing 4100 is aligned with the annular groove 3916 of the snap fit lathing ring 3900. Then, the snap fit lathing ring 3900 may be pushed up towards the housing 4100 such that: (a) lip 4202 of the housing 4100 sits in the groove 3916 defined between the inner wall 3908 and the outer wall 3906 of the snap fit lathing ring 3900, (b) the outer wall of the snap fit lathing ring 3900 engages an external surface of the housing side wall 4102, (c) the inner wall 3908 of the snap fit lathing ring 3900 engages and is impeded by the housing's inner flange 4108, and (d) snap tabs 3910 of the snap fit lathing ring 3900 snaps into the notches 4110 formed in the inner flange 4108 of the housing 4100. In particular, the angled flange 3921 of the snap tabs 3910 engage the notch surface 4110 of the housing's inner flange 4108 to couple the snap fit lathing ring 3900 to the housing 4100.

Even though FIGS. 43 and 44 illustrate coupling a snap fit lathing ring 3900 to the housing 4100 by snapping the snap tabs 3910 of the snap fit lathing ring 3900 into the notches 4110 formed in the inner flange 4108 of the housing 4100, in other example embodiments, the snap fit lathing ring 3900 may be coupled to the housing 4100 using fold-over tabs 4504 in addition to or instead of snapping the snap tabs 3910 into the notches 4110 formed in the inner flange 4108 of the housing 4100. For example, as illustrated in FIGS. 45 and 46, one or more fold-over tabs 4505 may be coupled to the snap tabs 3910 of the snap fit lathing ring 3900 using fasteners 4502, such as screws or rivets. In particular, a coupling portion 4590 of the fold-over tabs 4504 may include an aperture that may be aligned with the coupling aperture 3912 formed in the snap tabs 3910. Further, fasteners 4502 may be passed through the aligned apertures of the fold-over tabs 4504 and the snap tabs 3910 of the snap fit lathing ring 3900 to couple the fold-over tabs 4504 to the snap fit lathing ring 3900. The fold-over tabs 4504 may include an installation portion 4591 that includes a plurality of installation slots 4593 for coupling to the housing 4100.

As illustrated in FIG. 46, once the snap fit lathing ring 3900 is coupled to the housing 4100 using the snap tabs 3910 as described above, the installation portion 4591 of the fold-over tabs 4504 that are coupled to the snap fit lathing ring 3900 may be folded such that it engages and is impeded by the upper collar 4104 of the housing 4100. In some embodiments, the additional apertures 4203 disposed on the installation portion 4591 of the fold-over tabs 4504 may be aligned with corresponding apertures 4191 on the upper collar 4104 of the housing 4100. The fold-over tabs 4504 may be provided as an additional or alternative coupling mechanism for coupling the snap fit lathing ring 3900 to the housing 4100.

Even though the present disclosure describes lathing rings having a substantially annular collar that defines an annular opening for receiving the recessed housing can, one of ordinary skill in the art can understand and appreciate that in other example embodiments, the collar of the lathing rings (1300, 3900) may have any other geometric or non-geometric shape and may define an opening (1319, 3920) that has any other geometric or non-geometric shape without departing from a broader scope of the present disclosure. Further, even though the present disclosure describes a plaster ground plate disposed on the ceiling, one of ordinary skill in the art can understand and appreciate that in other example embodiments, the plaster ground plate may be omitted from the installation without departing from broader scope of the present disclosure. Furthermore, even though the present disclosure describes a recessed housing can having a substantially cylindrical shape with a ring shaped rim, and finishing sections having a substantially annular trim flange, one of ordinary skill in the art can understand and appreciate that in other example embodiments, the recessed housing can, the rim of the recessed housing can (or the flange of the removably coupled flange clips), the finishing sections, and their trim flanges can have any other appropriate geometric or non-geometric shape without departing from a broader scope of the present disclosure. For example, the recessed housing can may be cuboid or cube shaped in some example embodiments, and the trim flange of the finishing sections may have a square or rectangular profile. Additionally, even though the present disclosure describes the mounting assembly coupled to the recessed housing can as a pawl assembly, one of ordinary skill in the art can understand and appreciate that in other example embodiments, any other appropriate mounting assembly may be used without departing from a broader scope of the present disclosure.

Although the present disclosure is described with reference to example embodiments, it should be appreciated by those skilled in the art that various modifications are well within the scope of the present disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. A lighting system comprising:

a lathing ring comprising:

a collar that defines an annular opening;

an outer flange that extends radially outward from an outer surface of the collar and comprising one or more perforated openings and one or more mounting holes formed therein; and an inner flange that is disposed adjacent to and above the outer flange, the inner flange extending radially inwards towards the annular opening from an inner surface of the collar; and one or more fold-over tabs that are coupled to the collar of the lathing ring and comprising one or more installation slots, wherein the lathing ring is coupled to a ceiling such that the ceiling is disposed between the outer flange of the lathing ring and the one or more fold-over tabs.

2. The lighting system of claim 1, wherein the inner flange of the lathing ring comprises a first set of notches and a second set of notches formed therein.

3. The lighting system of claim 2:

wherein each of the second set of notches formed in the inner flange comprises:

a flange receiving notch formed in a bottom surface of the inner flange, and a pass through notch formed in the flange receiving notch and extending from a top surface of the inner flange to the flange receiving notch, and wherein the pass through notch is deeper and narrower than the flange receiving notch.

4. The lighting system of claim 1, further comprising:

a housing assembly comprising:

a rimmed recessed housing can that comprises a substantially cylindrical side wall that defines an inner cavity and an integral rim that that extends radially outwards from a bottom edge of the substantially cylindrical side wall; and one or more retention systems that are coupled to the rimmed recessed housing can and configured to securely mount the housing assembly in the ceiling fitted with the lathing ring, wherein the housing assembly is disposed in the annular opening defined by the collar of the lathing ring such that the rim of the recessed housing can engages the inner flange of the lathing ring.

5. The lighting system of claim 4:

wherein the one or more retention systems include a pawl assembly, and wherein a first set of notches formed in the inner flange of the lathing ring allows the one or more retention systems coupled to the rimmed recessed housing can to pass through unimpeded.

6. The lighting system of claim 1, further comprising:

a housing assembly comprising:

a rimless recessed housing can that comprises a substantially cylindrical side wall that extends from a top annular edge to a bottom annular edge and defines an inner cavity, one or more flange clips that are removably coupled to the substantially cylindrical side wall of the rimless recessed housing can adjacent the bottom annular edge of the rimless recessed housing can such that a flange of each flange clip extends radially outward from the bottom annular edge of the rimless recessed housing can; and one or more retention systems that are coupled to the rimless recessed housing can and configured to securely mount the housing assembly in the ceiling, wherein the housing assembly is disposed in the annular opening defined by the collar of the lathing ring such that the flange of each flange clip that is removably coupled to the side wall of the rimless recessed housing can engages the inner flange of the lathing ring.

7. The lighting system of claim 6:

wherein a flange receiving notch of a respective second set of notches formed in the inner flange of the lathing ring receives the flange of each flange clip coupled to the rimless housing can to guide the installation of the rimless housing can, wherein the one or more flange clips are removably coupled to the substantially cylindrical side wall of the rimless recessed housing can using fasteners.

8. The lighting system of claim 6, wherein the one or more flange clips are removably coupled to the substantially cylindrical side wall of the rimless recessed housing can using a snap fit mechanism.

9. The lighting system of claim 1, wherein the collar of the lathing ring comprises:

a plurality of tab apertures, and a plurality of guide rail pairs, each guide rail pair disposed adjacent to and on either side of each tab aperture, wherein each fold-over tab comprises a coupling portion that has a coupling aperture and a ceiling installation portion that has the one or more installation slots that are configured to receive installation fasteners therethrough to couple the lathing ring to the ceiling, and wherein the ceiling installation portion of each fold-over tab is flexible with respect to the coupling portion, wherein the ceiling installation portion is adjustable from a first position where the ceiling installation portion is in the same plane as and substantially parallel to the coupling portion to a second position where the ceiling installation portion is in a different plane that is substantially perpendicular to the coupling portion, and wherein the coupling portion of each fold-over tab is disposed in between respective guide rail pairs such that the tab aperture of the fold-over tab is aligned with the coupling aperture in the collar of the lathing ring to receive fasteners therethrough.

10. A lighting system comprising:

a housing assembly comprising:

a rimless housing can that includes a substantially cylindrical side wall that extends from a top annular edge to a bottom annular edge and defines an inner cavity; and one or more flange clips, wherein each flange clip is removably coupled to the substantially cylindrical side wall of the rimless housing can adjacent the bottom annular edge of the rimless housing such that a flange of each flange clip extends radially outward from the bottom annular edge of the rimless housing can; and a lathing ring comprising:

a collar that defines an annular opening;

an outer flange that extends radially outward from an outer surface of the collar; and an inner flange that is disposed adjacent to and above the outer flange, the inner flange extending radially inwards towards the annular opening from an inner surface of the collar, wherein the housing assembly is disposed in the annular opening defined by the collar of the lathing ring such that the flange of each flange clip that is removably coupled to the substantially cylindrical side wall of the rimless housing can engages the inner flange of the lathing ring.

11. The lighting system of claim 10, wherein the rimless housing can comprises:

a plurality of flange notches formed at the bottom annular edge of the rimless housing can, and a plurality of flange apertures, each flange aperture disposed above a respective flange notch.

12. The lighting system of claim 10, wherein the rimless housing can comprises:

a plurality of flange notches formed at the bottom annular edge of the rimless housing can, a plurality of flange apertures, each flange aperture disposed above a respective flange notch, and a plurality of snap slots, each snap slot disposed above a respective flange aperture.

13. The lighting system of claim 11:

wherein each flange clip is removably coupled to the substantially cylindrical side wall of the rimless housing can using a fastener, wherein each flange clip comprises an angled middle portion, a coupling portion disposed on one end of the angled middle portion and comprising a coupling aperture, and a flange disposed on an opposite end of the angled middle portion.

14. The lighting system of claim 13:

wherein each flange clip is removably coupled to the substantially cylindrical side wall of the rimless housing can such that:

the coupling portion of the flange clip engages an inner surface of the substantially cylindrical side wall of the rimless housing can such that the coupling aperture formed in the coupling portion of the flange clip is aligned with the flange aperture of the substantially cylindrical side wall of the rimless housing can to receive the fastener therethrough, the angled middle portion of the flange clip extends out from the substantially cylindrical side wall of the rimless housing can through the corresponding flange notch on the substantially cylindrical side wall of rimless housing can, and the flange of the flange clip is flush with and extends radially out from the bottom annular edge of the rimless housing can.

15. The lighting system of claim 12:

wherein each flange clip is removably coupled to the substantially cylindrical side wall of the rimless housing can using a snap fit mechanism, wherein each flange clip comprises a middle portion comprising a hole, a snap portion disposed on one end of the middle portion and comprising a snap feature, and a feet portion disposed on an opposite end of the middle portion and comprising a flange.

16. The lighting system of claim 15:

wherein to removably couple each flange clip to the substantially cylindrical side wall of the rimless housing can using the snap fit mechanism:

the snap feature of the flange clip is snapped into the snap slot of the rimless housing can such that:

the middle portion of the flange clip engages an inner surface of the substantially cylindrical side wall of the rimless housing can, and the feet portion of the flange clip extends out from the substantially cylindrical side wall of the rimless housing can through the corresponding flange notch on the substantially cylindrical side wall of rimless housing can.

17. The lighting system of claim 10, wherein the flange of each flange clip comprises a detachable portion that reduces the width of the flange from a first width to a second width when detached.

18. A lighting system comprising:

a housing comprising a substantially cylindrical side wall that defines an annular opening and a flange that extends radially inwards towards the annular opening from an inner surface of the side wall, wherein the flange comprises one or more notches, a lathing ring that is coupled to the housing and comprising:

an inner collar, the inner collar comprising a plurality of wall sections that are detached from each other, and one or more snap tabs disposed between adjacent wall sections of the plurality of wall sections, an outer collar disposed outside the inner collar and partially surrounding the inner collar;

a groove formed between the inner collar and the outer collar;

an outer flange that extends radially outward from the outer collar and comprising one or more perforations; and an inner flange that extends radially inwards towards the annular opening from the inner collar.

19. The lighting system of claim 18:

wherein each snap tab comprises a planar portion having a coupling aperture and an angled flange disposed at an end of the planar portion, wherein the lathing ring is coupled to the housing such that:

a bottom edge of the housing is disposed in the groove formed between the inner collar and the outer collar, and the angled flange of each snap tab of the lathing ring engages respective notches formed in the flange of the housing.

20. The light system of claim 18, wherein the lathing ring is coupled to the housing using fold-over tabs that are coupled to the snap tabs of the lathing ring.

* * * * *